US009610781B2

(12) United States Patent
Tashiro et al.

(10) Patent No.: US 9,610,781 B2
(45) Date of Patent: Apr. 4, 2017

(54) IMAGE FORMING DEVICE AND METHOD FOR MANUFACTURING CAN BODY ON WHICH IMAGE IS FORMED

(75) Inventors: Yasushi Tashiro, Tokyo (JP); Shinichi Ojima, Tokyo (JP); Kazunori Ikeda, Tokyo (JP); Kenyu Muraoka, Tokyo (JP); Tetsuo Kashiwazaki, Tokyo (JP); Asumi Suwa, Tokyo (JP)

(73) Assignee: SHOW A ALUMINUM CAN CORPORATION, Shinagawa-ku, Tokyo (JP)

( * ) Notice: Subject to any disclaimer, the term of this patent is extended or adjusted under 35 U.S.C. 154(b) by 0 days.

(21) Appl. No.: 14/113,615

(22) PCT Filed: Apr. 19, 2012

(86) PCT No.: PCT/JP2012/060590
§ 371 (c)(1),
(2), (4) Date: Oct. 24, 2013

(87) PCT Pub. No.: WO2012/147612
PCT Pub. Date: Nov. 1, 2012

(65) Prior Publication Data

US 2014/0049585 A1 Feb. 20, 2014

(30) Foreign Application Priority Data

Apr. 25, 2011 (JP) ..... 2011-096991
Apr. 25, 2011 (JP) ..... 2011-096996
Apr. 17, 2012 (JP) ..... 2012-093850

(51) Int. Cl.
*B41J 11/00* (2006.01)
*B41J 3/407* (2006.01)
(Continued)

(52) U.S. Cl.
CPC ..... *B41J 11/0015* (2013.01); *B41F 17/22* (2013.01); *B41J 3/4073* (2013.01);
(Continued)

(58) Field of Classification Search
CPC .... B41J 11/0015; B41J 3/4073; B41J 11/002; B41F 17/22; B65D 23/0828; Y10T 29/49
(Continued)

(56) References Cited

U.S. PATENT DOCUMENTS 3,195,451 A 7/1965 Hovekamp et al.
5,893,016 A 4/1999 Landa et al.
(Continued)

FOREIGN PATENT DOCUMENTS

EP 2250026 B2 9/2014
JP 11-504278 A 4/1999
(Continued)

OTHER PUBLICATIONS

Communication dated Jan. 13, 2015, issued by the European Patent Office in corresponding European Application No. 12777138.4.
(Continued)

*Primary Examiner* — Henok Legesse
(74) *Attorney, Agent, or Firm* — Sughrue Mion, PLLC

(57) ABSTRACT

A printing device (1) is provided with: a can body conveying mechanism (100) for sequentially conveying can bodies (10); and a can body moving mechanism (200) for moving the can body (10) while forming an image onto the outer circumferential surface of the can body (10) conveyed by the can body conveying mechanism (100). The can body moving mechanism (200) is provided with a rotating member (210) formed in a disc shape and rotating in a clockwise direction in the drawing. The can body moving mechanism (200) is also provided with plural image forming units (220) provided on the rotating member (210) and forming an image onto the outer circumferential surface of the can body (10) while moving the can body (10). The image forming
(Continued)

units (220) are each provided with plural ink ejection devices for ejecting ink onto the outer circumferential surface of the can body (10). This provides an image forming device capable of increasing the number of can bodies on each of which an image can be formed per unit time.

6 Claims, 26 Drawing Sheets

(51) Int. Cl.
*B65D 23/08* (2006.01)
*B41F 17/22* (2006.01)

(52) U.S. Cl.
CPC ..... *B65D 23/0828* (2013.01); *B41J 11/002* (2013.01); *Y10T 29/49* (2015.01)

(58) Field of Classification Search
USPC ..... 347/104, 106, 4, 16, 102
See application file for complete search history.

(56) References Cited

U.S. PATENT DOCUMENTS

| | | | | |
|---|---|---|---|---|
| 6,769,357 | B1 | 8/2004 | Finan | |
| 8,141,970 | B2 * | 3/2012 | Noll | 347/8 |
| 2007/0089619 | A1 | 4/2007 | Finan | |
| 2007/0157559 | A1 | 7/2007 | Till | |
| 2009/0145511 | A1 | 6/2009 | Till | |
| 2010/0091054 | A1 * | 4/2010 | Vesanto et al. | 347/9 |
| 2010/0192517 | A1 * | 8/2010 | Schach | 53/411 |
| 2010/0257819 | A1 | 10/2010 | Schach | |
| 2011/0232514 | A1 | 9/2011 | Putzer et al. | |
| 2013/0019566 | A1 | 1/2013 | Schach | |

FOREIGN PATENT DOCUMENTS

| | | | |
|---|---|---|---|
| JP | 2007-185960 | A | 7/2007 |
| JP | 2010-535112 | A | 11/2010 |
| WO | 2004009360 | A1 | 1/2004 |
| WO | 2010/105726 | A1 | 9/2010 |

OTHER PUBLICATIONS

International Search Report for PCT/JP2012/060590 dated Jul. 17, 2012.

* cited by examiner

IMAGE FORMING DEVICE AND METHOD FOR MANUFACTURING CAN BODY ON WHICH IMAGE IS FORMED

CROSS REFERENCE TO RELATED APPLICATIONS

This application is a National Stage of International Application No. PCT/JP2012/060590 filed Apr. 19, 2012, claiming priority based on Japanese Patent Application Nos. 2011-096991 filed Apr. 25, 2011, 2011-096996 filed Apr. 25, 2011 and 2012-093850 filed Apr. 17, 2012, the contents of all of which are incorporated herein by reference in their entirety.

TECHNICAL FIELD

The present invention relates to an image forming device that forms an image onto a can body, and a method for manufacturing a can body on which an image is formed.

BACKGROUND ART

A printing device is suggested, which includes plural digital print heads that are secured on a main body side of the device to form an image on a can body and a driving mechanism that conveys the can body and rotates the can body at a position facing the digital print heads (for example, refer to Patent Document 1).

CITATION LIST

Patent Literature

Patent Document 1: U.S. Published Application No. 2007/0089619

SUMMARY OF INVENTION

Technical Problem

Currently, image formation onto a can body is generally performed by a printing method referred to as offset printing. On the other hand, in recent years, digital printing by use of ink jet or the like becomes popular. By the way, in the case where ink jet or the like is employed, compared to the offset printing, the speed of forming an image is reduced, to thereby result in decrease of the number of can bodies, on each of which an image can be formed, per unit time.

In addition, image formation onto the can body can be, for example, carried out in the middle of moving the can body by moving image forming units for forming an image onto the can body together with the movement of the can body. By the way, in the case where the image forming units are moved in this manner, an external force acts on the image forming units and it becomes incapable of performing image formation stably, to cause a possibility of deteriorating quality of an image to be formed.

It is an object of the present invention to provide an image forming device or the like capable of increasing the number of can bodies on each of which an image can be formed per unit time.

It is also an abject of the present invention to provide an image forming device capable of suppressing deterioration of image quality possibly caused by moving image forming units.

Solution to Problem

An image forming device to which the present invention is applied includes: a conveying unit that sequentially conveys can bodies; and plural image forming mechanisms provided to correspond to the respective can bodies conveyed by the conveying unit, the plural image forming mechanisms moving together with the can bodies conveyed by the conveying unit and forming images on the can bodies, wherein each of the image forming mechanisms is provided with plural image forming portions that are capable of simultaneously forming images of mutually different colors onto the can body.

Here, each of the image forming mechanisms forms the image on an outer circumferential surface of the can body that is formed cylindrically, and the conveying unit conveys the can body while rotating the can body in a circumferential direction.

Moreover, each of the image forming mechanisms is provided to be capable of keeping a constant attitude.

Further, each of the plural image forming portions is provided to be movable forward and backward with respect to the can body.

Moreover, each of the image forming mechanisms is further provided with a curing unit that cures the images formed on the can body by the plural image forming portions.

Further, each of the plural image forming portions forms the image on the can body by ejecting ink onto the can body from an ink ejection head, and each of the plural image forming portions is arranged so that the ink ejection head faces in any directions other than an upward direction.

Moreover, the image forming device further includes a rotating member that rotates around a predetermined center of rotation, wherein each of the image forming mechanisms, which includes the plural image forming portions, is provided to the rotating member, and arranged at a predetermined interval in a circumferential direction of the rotating member, and each of the image forming mechanisms is provided so that an attitude of the plural image forming portions provided in each of the image forming mechanisms with respect to the center of rotation of the rotating member is same in each of the plural image forming mechanisms.

Further, each of the plural image forming portions forms the image on the can body by ejecting the ink onto the can body from the ink ejection head, and a changing unit that changes an ejection force in ejecting the ink by the ink ejection head is further provided.

From another point of view, an image forming device to which the present invention is applied includes: a conveying unit that sequentially conveys can bodies; and plural image forming mechanisms provided to correspond to the respective can bodies conveyed by the conveying unit, the plural image forming mechanisms moving together with the can bodies conveyed by the conveying unit and forming images on the can bodies, wherein each of the image forming mechanisms is provided with plural image forming portions that are arranged radially around a location where the can body is provided as a center.

Here, the image forming device further includes: a curing unit that, after the image is formed by the image forming mechanism, cures the image; and a coating unit that, after curing of the image by the curing unit is carried out, coats the image with a paint.

Moreover, the image forming device further includes: plural conveying members that are provided to carry out circulating movement and to receive the can bodies, on which the images are formed by the image forming mechanisms, from the conveying unit and convey the can bodies; and plural receiving members that are provided to carry out circulating movement and to receive the can bodies from the conveying members and convey the can bodies, wherein the plural conveying members and the plural receiving members are arranged so that a central shaft in carrying out the circulating movement by the plural conveying members and a central shaft in carrying out the circulating movement by the plural receiving members coincide with each other.

Further, if the present invention is considered as a method for manufacturing a can body on which an image is formed, a method for manufacturing a can body on which an image is formed, to which the present invention is applied, includes: sequentially conveying a can body and an image forming mechanism that includes plural image forming portions to form an image on the can body; and simultaneously operating the plural image forming portions provided in the image forming mechanism in the middle of conveying the can body to form the image on the can body.

From another point of view, an image forming device, to which the present invention is applied, includes: a unit that includes a can body holding portion that holds plural can bodies and an image forming mechanism that forms images on the plural can bodies held by the can body holding portion; and a conveying unit that conveys plural the units, wherein the image forming mechanism provided in the unit is provided with plural image forming portions that face individual can bodies of the plural can bodies held by the can body holding portion, and in the middle of conveying the plural units by the conveying unit, in each of the units, a state of the can body holding portion with respect to the image forming mechanism is changed to switch the can body facing the image forming portion provided in the image forming mechanism.

Here, the image forming mechanism that moves with conveyance of the unit carries out the movement while keeping a constant attitude.

Moreover, each of the plural image forming portions forms the image on the can body by ejecting ink onto the can body from an ink ejection head, and each of the plural image forming portions is arranged so that the ink ejection head faces in any directions other than an upward direction.

Further, the can body holding portion is formed in an annular shape and is arranged outside of the image forming mechanism, and the change in the state of the can body holding portion with respect to the image forming mechanism is caused by rotation of the can body holding portion in a circumferential direction.

Moreover, each of the plural image forming portions is provided to be movable forward and backward with respect to the facing can body.

Further, the image forming mechanism is further provided with a curing unit that cures the image formed on the can body by the image forming portion.

Moreover, the image forming mechanism is further provided with a coating unit that coats the image formed on the can body by the image forming portion with a paint.

Further, the image forming device further includes: plural conveying members that are provided to carry out circulating movement, receive the can bodies on which the images are formed by the image forming mechanism, and convey the can bodies; and plural receiving members that are provided to carry out circulating movement, receive the can bodies from the conveying members, and convey the can bodies, wherein the plural conveying members and the plural receiving members are arranged so that a central shaft in carrying out the circulating movement by the plural conveying members and a central shaft in carrying out the circulating movement by the plural receiving members coincide with each other.

Moreover, the image forming device further includes: a rotating member that rotates around a predetermined center of rotation, wherein each of the units, which includes the image forming mechanism having the plural image forming portions, is provided to the rotating member, and arranged at a predetermined interval in a circumferential direction of the rotating member, and each of the units is provided so that an attitude of the plural image forming portions provided in each of the units with respect to the center of rotation of the rotating member is same in each of the plural units.

Further, each of the plural image forming portions forms the image on the can body by ejecting the ink onto the can body from the ink ejection head, and a changing unit that changes an ejection force in ejecting the ink by the ink ejection head is further provided.

Moreover, if the present invention is considered as a method for manufacturing a can body on which an image is formed, a method for manufacturing a can body on which an image is formed, to which the present invention is applied, includes: conveying plural units, each of which is configured by at least a can body group configured by plural can bodies and an image forming mechanism that forms an image on the can body group by use of plural image forming portions; and changing a state of the can body group with respect to the image forming mechanism in each of the units in the middle of conveying the plural units so as to switch a can body facing the image forming portion included by the image forming mechanism.

From another point of view, an image forming device, to which the present invention is applied, includes: an image forming mechanism that holds a can body and forms an image on an outer surface of the can body; and a moving unit that causes the image forming mechanism holding the can body to perform orbital movement around a predetermined point to move the image forming mechanism along a predetermined annular moving route, wherein the image forming mechanism is provided with an image forming portion that is provided to extend in one direction and ejects ink onto the outer surface of the can body to form the image on the outer surface, and the moving unit moves the image forming mechanism so that the image forming portion is moved along the annular moving route with one end portion of the image forming portion in the one direction being as a leading edge and the other end portion of the image forming portion in the one direction being as a trailing edge.

Here, plural the image forming mechanisms are provided, and the moving unit moves the plural image forming mechanisms along the annular moving route.

Moreover, the image forming portion is arranged above the can body to eject the ink onto the outer surface of the can body that is positioned below.

Further, the image forming mechanism holds the can body by inserting an insertion member having an end portion into an inside of the can body from the end portion side, and the insertion member is arranged in a lying state when image formation onto the can body by the image forming mechanism is performed, and in holding the can body, the insertion member is arranged so that the end portion faces in one of an upward direction and a downward direction.

From another point of view, an image forming device, to which the present invention is applied, includes: a rotating member that rotates around a predetermined center of rotation; and an image forming mechanism that is attached to the rotating member, carries out orbital movement with rotation of the rotating member and holds a can body to form an image onto an outer surface of the can body, wherein the image forming mechanism is provided with an image forming portion that is provided to extend in one direction and ejects ink onto the outer surface of the can body to form the image on the outer surface, and the image forming mechanism is arranged so that a direction in which a straight line extending from the center of rotation of the rotating member toward the image forming mechanism attached to the rotating member and the one direction in which the image forming portion extends cross each other.

Here, the image forming mechanism is arranged so that the direction in which the straight line extending from the center of rotation toward the image forming mechanism and the one direction cross each other at a right angle.

Moreover, the image forming portion is arranged along a horizontal direction.

Advantageous Effects of Invention

According to the present invention, it is possible to provide an image forming device or the like capable of increasing the number of can bodies on each of which an image can be formed per unit time.

According to the present invention, it is also possible to provide an image forming device capable of suppressing deterioration of image quality possibly caused by moving image forming units.

DESCRIPTION OF EMBODIMENTS

First Exemplary Embodiment

Hereinafter, an exemplary embodiment according to the present invention will be described with reference to attached drawings.

Figure 1:
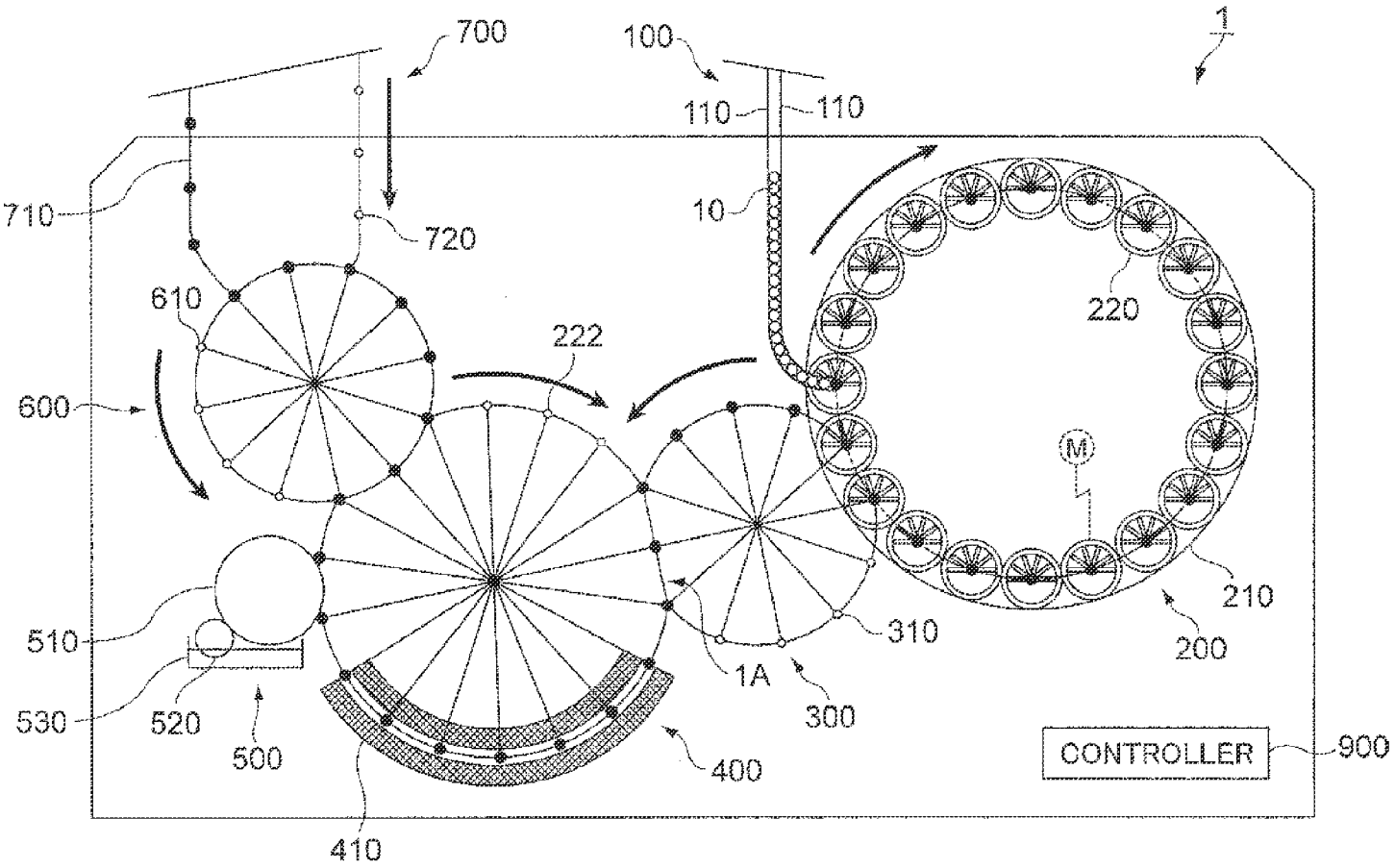
FIG. 1 is a diagram schematically showing an example of a printer that performs printing on a can body.

FIG. 1 is a diagram schematically showing an example of a printer 1 that performs printing on a can body.

The printer 1 as an example of an image forming device is a printer that forms an image on a can body 10 based on digital image information. Here, the printer 1 is provided with: a can body conveying mechanism 100 that sequentially conveys the can bodies 10 having been manufactured in a not-shown can body manufacturing process; a can body moving mechanism 200 that moves the can body 10 while forming an image on an outer circumferential surface of the can body 10 conveyed by the can body conveying mechanism 100; and a first conveying device 300 that conveys the can body 10 on which an image has been formed by the can body moving mechanism 200.

Moreover, the printer 1 is provided with: a heating device 400 that heats the can bodies 10 sequentially conveyed by the first conveying device 300; and a coating device 500, as an example of a coating unit, that coats an outer circumferential surface of the can body 10 (the image having been formed on the can body) heated by the heating device 400 with a predetermined paint. Also, a second conveying device 600 that further conveys the can body 10 heated by the heating device 400 and coated with the paint by the coating device 500 to a downstream side, and a third conveying device 700 that further conveys the can body 10 conveyed by the second conveying device 600 to the downstream side are provided.

Moreover, the printer 1 is provided with a controller 900 that performs control of each device and each mechanism provided in the printer 1. It should be noted that, on the downstream side of the third conveying device 700 in a conveying direction of the can body 10, there is provided a baking device (not shown) that bakes the image formed on the can body 10 and the paint applied to the can body 10 onto the can body 10.

Here, the can body conveying mechanism 100 conveys the can body 10 toward the can body moving mechanism 200 that is positioned below by utilizing a weight of the can body 10. In addition, the can body conveying mechanism 100 includes a guide member 110 provided along the vertical direction and on both sides of a moving route of the can body 10, and conveys the can body 10 toward the can body moving mechanism 200 by use of the guide member 110.

The can body moving mechanism 200 is provided with a rotating member 210 that is formed in a disc shape and rotates in a clockwise direction in the figure. Moreover, the can body moving mechanism 200 is provided with image forming units 220 that are provided at an outer circumferential edge of the rotating member 210, to hold the can body 10 sequentially conveyed by the can body conveying mechanism 100, move with the can body 10, and form an image on an outer circumferential surface of the holding can body 10.

Here, the rotating member 210, which functions as part of the conveying unit, is arranged so that a rotational axis thereof becomes horizontal. Additionally remarking, a mount surface on which the image forming unit 220 is mounted is arranged along the vertical direction. It should be noted that the arrangement mode of the rotating member 210 is not limited to a mode like this. For example, a rotating member 210 may be provided so that the rotational axis is along the vertical direction.

It should be noted that, in the configuration of the exemplary embodiment, arrangement of the rotating member 210 in which the rotational axis is horizontal causes less complexity in processes. Here, in the coating device 500 in the exemplary embodiment, the paint is supplied to a tray 530 as much as a furnisher roll 520 is immersed. By rotation of the furnisher roll 520, the paint having a constant viscosity is stirred within the tray 530. Moreover, by rotation of the furnisher roll 520, the paint in the tray 530 adheres to a roll surface of the furnisher roll 520. The paint adhered to the furnisher roll 520 is transferred to a roll-like member 510, and further transferred to the can body 10. This establishes on the precondition that the paint is applied to the can body 10 while the can body 10 is horizontally oriented (in the state of lying down). In such a case, if the rotating member 210 is provided so that the rotational axis of the rotating member 210 is along the vertical direction, a need for changing the configuration or arrangement of the coating device 500 arises, and there occurs a possibility of causing complexity in the processes.

Here, the image forming units 220, as an example of an image forming mechanism, are provided at the outer circumferential edge of the rotating member 210 as described above. Moreover, a plural number (in the exemplary embodiment, 20) of image forming units 220 are provided, and are arranged in line along the outer circumferential edge of the rotating member 210. Further, each of the provided plural image forming units 220 is arranged with an equal space in the circumferential direction of the rotating member 210.

Figure 2:
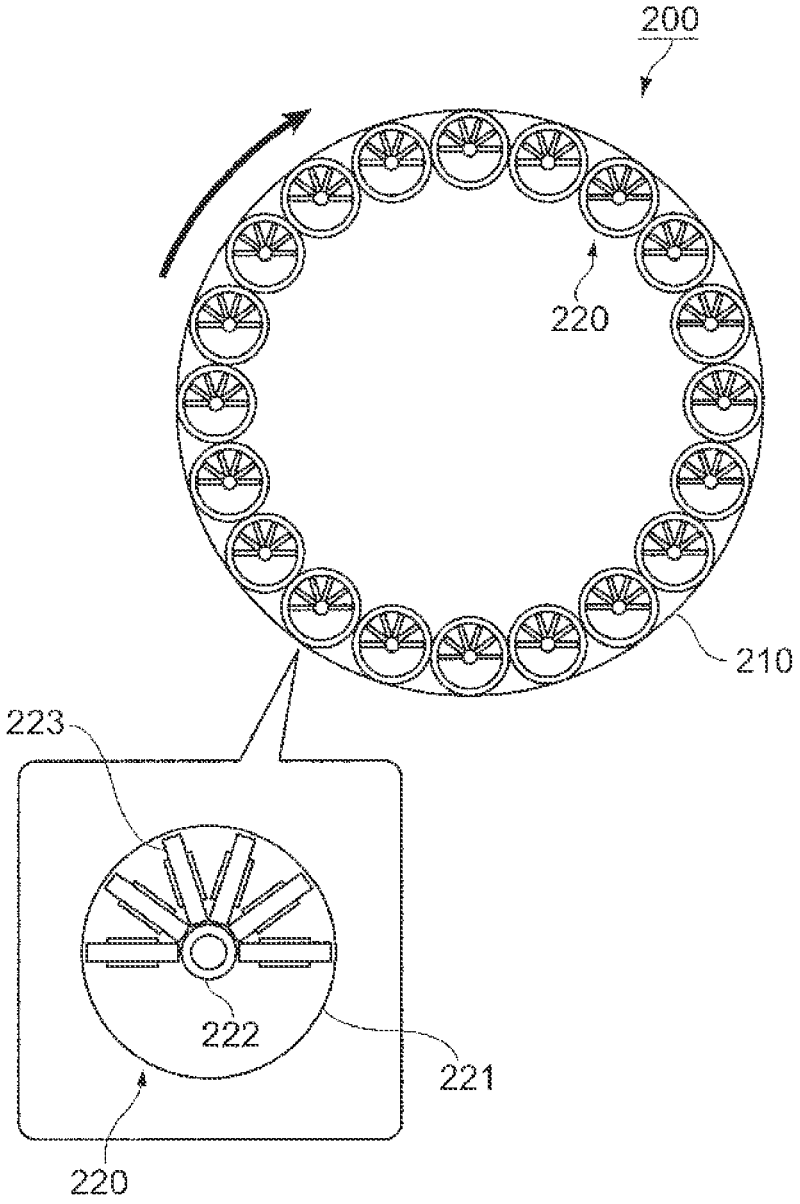
FIG. 2 is a diagram showing an enlarged can body moving mechanism.

FIG. 2 is a diagram showing the enlarged can body moving mechanism 200 that has been enlarged.

As shown in the figure, and as described above, the can body moving mechanism 200 in the exemplary embodiment is provided with the rotating member 210 that is formed in a disc shape and rotates in the clockwise direction in the figure. Moreover, at the outer circumferential edge of the rotating member 210, there are provided the image forming units 220 that hold the can bodies 10 and form the images onto the outer circumferential surfaces of the can bodies 10.

Here, the image forming units 220 will be described in detail.

The image forming unit 220 in the exemplary embodiment is formed in a disc shape, and is provided with a rotating table 221 capable of rotating around a center portion thereof. Moreover, in the exemplary embodiment, at the center portion of the rotating table 221, a holding member (mandrel) 222 is provided to be projected from the rotating table 222 (provided to be projected toward the frontward side in the figure) to hold the can body 10.

Here, in the exemplary embodiment, the holding member 222 is inserted into the can body 10 via an opening formed on one end of the can body 10 that is cylindrically formed. Moreover, the holding member 222 is formed to be hollow, and an air vent is formed at an inner space of the holding member 222, and thereby the holding member 222 holds the can body 10 by evacuating the inside of the can body 10 through the air vent. This regulates movement of the can body 10 relative to the holding member 222. It should be noted that, in the exemplary embodiment, the movement of the can body 10 is regulated by evacuation; however, the movement of the can body 10 can also be regulated by a mechanical configuration, such as pressing a not-shown member against the can body 10.

Moreover, in the image forming unit 220 of the exemplary embodiment, plural ink ejection devices 223 that eject ink onto the outer circumferential surface of the can body 10 held by the holding member 222 are provided around the holding member 222. Additionally remarking, in the exemplary embodiment, plural ink ejection devices 223, which form an image on the can body 10 by the so-called ink-jet method, are provided around the holding member 222. It should be noted that, in the exemplary embodiment, 6 ink ejection devices 223 are provided in the single image forming unit 220, and thereby it is possible to use up to 6 colors of ink.

Here, each of the ink ejection devices 223 as an example of part of an image forming portion contains ink of mutually different color. Moreover, each of the ink ejection devices 223 is arranged to encircle the holding member 222. Further, each of the ink ejection devices 223 is formed in a longitudinal shape. Further, the ink ejection device 223 formed in the longitudinal shape in this manner is arranged to be directed from the center portion toward the outer circumferential edge of the rotating table 221 formed in a disc shape. Further, each of the ink ejection devices 223 is arranged radially regarding the center portion of the rotating table 221 as a center. Additionally remarking, each of the ink ejection devices 223 is arranged radially regarding the holding member 222 as a center.

Moreover, in the exemplary embodiment, as shown in FIG. 2, the ink ejection devices 223 are arranged not to be lower than the holding member 222. Additionally remarking, the ink ejection devices 223 are arranged above the holding member 222 or on lateral sides of the holding member 222. In the case where the ink ejection devices 223 are provided above or on lateral sides of the holding member 222 in this manner, an ink ejection head (not shown) of the ink ejection device 223 faces downward or in the lateral direction (horizontal direction), and accordingly, dust or the like hardly adheres to the ink ejection head. Additionally remarking, in the exemplary embodiment, the ink ejection head of the ink ejection device 223 is configured to face in any directions other than an upward direction, and accordingly, dust or the like hardly adheres to the ink ejection head.

Moreover, in the exemplary embodiment, the rotating table 221 is able to rotate relative to the rotating member 210. In addition, in the exemplary embodiment, as shown in FIG. 2, even if the image forming units 220 move with rotation of the rotating member 210, the rotating table 221 rotates in the counterclockwise direction in the figure so as not to cause change in the attitude of the image forming unit 220.

Here, in the exemplary embodiment, the attitude of the image forming unit 220 is kept by rotating the rotating table 221 in the counterclockwise direction by a motor M or the like shown in FIG. 1; however, it is also possible to decenter the position of the center of gravity of the rotating table 221 by attaching a not-shown weight to a lower portion of the rotating table 221, to thereby keep the attitude of the image forming unit 220 constant so as not to cause a change in the attitude of the image forming unit 220 by decentering the center of gravity. It should be noted that, in FIG. 1, only one motor M is indicated; however, plural motors M are provided to correspond to the respective plural image forming units 220.

Here, in a case where the attitude of the image forming unit 220 is changed, the ink ejection head of the ink ejection device 223 faces upward. Then, in this case, dust or the like is prone to adhere to the ink ejection head. Moreover, in the case where the attitude of the image forming unit 220 is changed, the attitude of the ink ejection device 223 is also changed. Then, in this case, there is a possibility that an amount of ink adhering to the can body 10 varies, or a position of ink adhesion is deviated. For this reason, in the exemplary embodiment, the attitude of the image forming unit 220 is kept constant as described above.

Figure 3A:
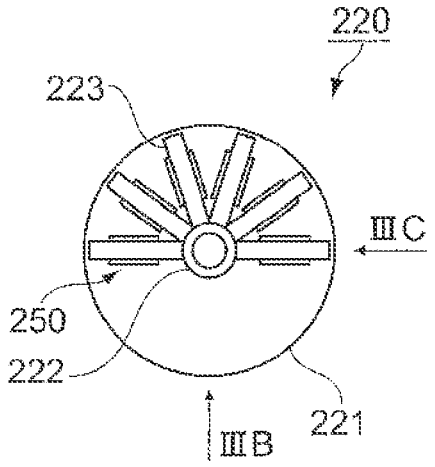
FIGS. 3A to 3C are diagrams for illustrating image forming units.
Figure 3B:
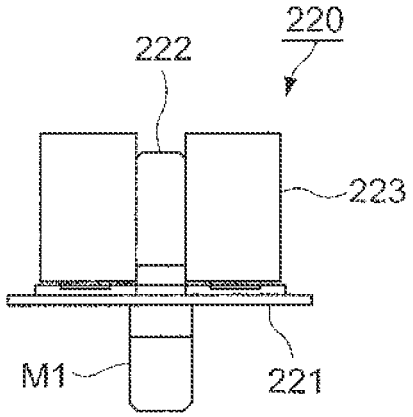
Figure 3C:
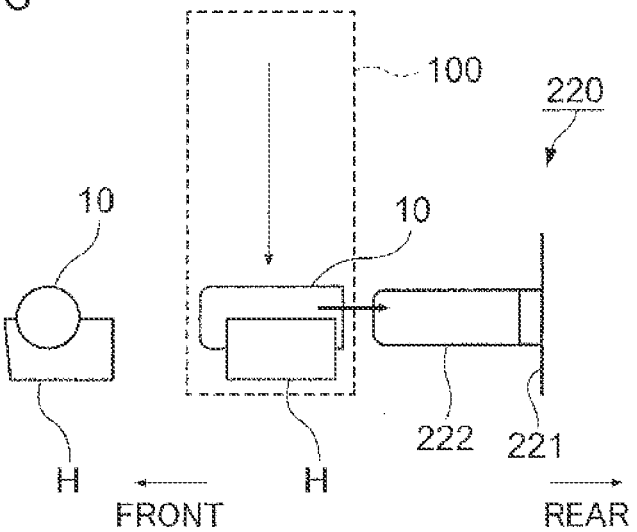

With reference to FIGS. 3A to 3C (diagrams for illustrating the image forming units 220), the image forming units 220 will be further described. It should be noted that FIG. 3A is a front view of the image forming unit 220. Moreover, FIG. 3B is a diagram showing the image forming unit 220 as viewed from the direction of arrow 111B in FIG. 3A, and FIG. 3C is a diagram showing the image forming unit 220 as viewed from the direction of arrow 111C in FIG. 3A.

Here, there are various kinds of can bodies 10, and there exist different diameters depending upon the kinds of can bodies 10. Accordingly, in the exemplary embodiment, the ink ejection device 223 is configured to be movable forward and backward with respect to the holding member 222. Additionally remarking, the image forming unit 220 is configured so that the ink ejection device 223 is able to approach the holding member 222 (the can body 10) and the ink ejection device 223 is able to move away from the holding member 222.

Moreover, in the exemplary embodiment, as shown in FIG. 3A, a forward and backward mechanism 250 that moves the ink ejection device 223 forward and backward with respect to the holding member 222 is provided. It should be noted that the forward and backward mechanism 250 is configured by, for example, a so-called linear actuator including a driving portion that moves linearly. More specifically, the linear actuator is configured with, for example, a linear motor or a servomotor and ball screws.

It should be noted that information about the diameter of the can body 10 (information about the can body 10) is inputted by an operator through a not shown terminal, and is sent to the controller 900 (refer to FIG. 1) from the terminal. Then, upon receiving the information about the diameter of the can body 10, the controller 900 drives the forward and backward mechanism 250 based on the information to arrange the ink election device 223 at a position corresponding to the diameter of the can body 10. It should be noted that it is also possible to arrange the ink election device 223 at the position corresponding to the diameter of the can body 10 by providing a sensor for detecting the can body 10 in each of the ink ejection devices 223 and utilizing the sensor. In this case, it is possible to arrange the ink election device 223 at the position corresponding to the diameter of the can body 10 automatically. Additionally remarking, in the case where the ink ejection device 223 is automatically moved forward and backward by detecting the distance to the can body 10 by the sensor, since it becomes possible to perform ink ejection to the outer circumferential surface in the state where the distance between the outer circumferential surface of the can body 10 and the ink ejection device 223 is kept constant, it becomes possible to form an image not only on the can body 10 having the circular shape, but also on the can body 10 having, for example, an elliptical shape, a rectangular shape or the like. Moreover, by inputting the form data of the can body 10 in advance, it is also possible to automatically move the ink ejection device 223 forward and backward based on the form data. In this case, it is also possible to perform image formation on the can body 10 having a shape other than the circular shape.

Moreover, in the exemplary embodiment, as shown in FIG. 3B, there is provided a servomotor M1 that is attached to the backside of the rotating table 221 and rotates the holding member 222. In the exemplary embodiment, the holding member 222 that is holding the can body 10 is rotated by the servomotor M1. Accordingly, the can body 10 is rotated in the circumferential direction. On the other hand, ink is ejected onto the outer circumferential surface of the can body 10 from each of the ink ejection devices 223. Consequently, an image is formed on the outer circumferential surface of the can body 10.

It should be noted that, though the description was omitted above, in the exemplary embodiment, a holder H, which is referred to as "pocket" that temporarily receives the can body 10 (in FIG. 1, illustration is omitted. Refer to FIG. 3C), is provided in the frontward of the can body moving mechanism 200 in the depth direction of the printer 1 (refer to FIG. 1). The pocket moves on the frontward side of the can body moving mechanism 200 together with the image forming unit 220. The can body 10 is carried out of the can body conveying mechanism 100 and temporarily placed in the pocket. On the deeper side of the pocket, there is the holding member 222 provided in the image forming unit 220. The center of the can body 10 placed in the pocket and the center of the holding member 222 coincide with each other. Here, in the exemplary embodiment, by evacuating the can body 10 by the air vent of the holding member 222, the can body 10 slides in the pocket toward the holding member 222 so that the holding member 222 is inserted into the can body 10, and thereby the can body 10 is held with evacuation by the holding member 222.

Here, a process performed by the can body moving mechanism 200 will be further described.

In the exemplary embodiment, prior to the process by the can body moving mechanism 200, first, the information about the diameter of the can body 10 is obtained by the controller 900. Moreover, image information about the image to be formed on the can body 10 is obtained from an external terminal such as a PC (personal computer). Thereafter, based on the above-described information about the diameter that has been obtained, the forward and backward mechanism 250 (refer to FIG. 3A) is driven, and accordingly, the ink ejection device 223 is arranged at the position corresponding to the diameter of the can body 10.

Thereafter, the can bodies 10 are sequentially supplied from the can body conveying mechanism 100 to the can body moving mechanism 200, and the can bodies 10 are held by the holding members 222. Moreover, ink is ejected from each of the ink ejection device 223. Additionally remarking, in the exemplary embodiment, ink is ejected from the plural ink ejection devices 223 at once. Then, when the can body 10 is brought into a state in which the can body 10 is rotated about 360° after the rotation of the can body 10 is started (when the can body 10 makes about a circuit), rotation of the servomotor M1 is stopped. In addition, ejection of ink by the ink ejection devices 223 is also stopped. This brings a state in which an image is formed on the outer circumferential surface of the can body 10 over whole circumference thereof. It should be noted that, in the exemplary embodiment, ink is ejected from the plural ink ejection devices 223 at once in this manner; however, the timing of starting ejection of the ink or the timing of terminating ejection of the ink may not be the same. For example, in a case where spaces between the ink ejection devices 223 are not equal due to dimensional tolerance or the like, the timing of starting the ink ejection from each of the ink ejection devices 223 is delayed in some cases.

Here, in the exemplary embodiment, the can body 10 is rotated about 360° during the time from putting the can body 10 into the can body moving mechanism 200 to discharge of the can body 10 from the can body moving mechanism 200 (until the can body 10 is passed to the first conveying device 300). Moreover, in the exemplary embodiment, the can bodies 10 are sequentially supplied to the plural image forming units 220 having been provided, and image formation on the can body 10 is performed, not by a single image forming unit 220, but by the plural image forming units 220.

Additionally remarking, in the exemplary embodiment, image formation on the plural can bodies 10 is performed simultaneously (in parallel) in the middle of sequentially conveying the plural can bodies 10. Therefore, in the printer 1 in the exemplary embodiment, it is possible to increase the number of can bodies 10 capable of being processed per unit time compared to a case where, for example, process for the can body 10 is performed by a single image forming unit 220.

Here, currently, image formation on the can body 10 is generally performed by a printing method called as offset printing. In this case, ink is once placed on a plate, then the ink is transferred from the plate to a rubber-like sheet, which is referred to as a blanket, and further, the ink having been transferred to the blanket is transferred onto the can body 10. On the other hand, recently, printing on an object becomes increasingly performed by digital printing, which is represented by ink-jet printing.

In the digital printing, compared to the offset printing, since a plate referred to as a press plate is not used, making of the press plate, registration of the press plate and a printer, cleaning of the press plate in the course of printing and the like are not required. This simplifies an operation referred to as "setups" in a case of changing a lot, and accordingly, it becomes possible to flexibly deal with multi-product small-lot production. Moreover, in the production process of the can body 10, defects frequently occur in the process related to printing; however, it becomes possible to decrease the defects that occur in the process related to printing by switching to the digital printing.

In this manner, an advantage is brought about by switching to the digital printing; however, on the other hand, demerits are also caused. For example, in the printing by use of ink jet, which is widely used in the digital printing, the printing speed is low, and the printing speed of this printing method is, for example, 1/10 of the printing speed in the offset printing. Accordingly, switching to the ink-jet printing is simply carried out, deterioration of productivity is caused.

Here, in the configuration of the exemplary embodiment, though the printing method by use of ink jet is employed, image forming processes on the plural can bodies 10 are performed simultaneously as described above. Moreover, image forming processes for a single can body 10 are performed by the plural ink ejection devices 223. Consequently, in the configuration of the exemplary embodiment, it becomes possible to suppress deterioration of productivity that possibly occurs in the case where the printing method by use of ink jet is employed.

It should be noted that deterioration of productivity can also be suppressed by, for example, providing plural conveying lines for the can bodies 10 and providing a printing device to each of the conveying lines; however, in this case, branching of the conveying lines and merging of the conveying lines are to be carried out, but there occur fluctuations in the processing speed because the individual conveying lines are independent of each other. It is associated with difficulty to merge plural lines having irregular processing speeds into one, and conveying efficiency is deteriorated. Moreover, in this case, an installation area (occupied volume) of the device is increased.

On the other hand, in the configuration of the exemplary embodiment, it is possible to perform printing with a single conveying line without providing plural conveying lines. Therefore, in the configuration of the exemplary embodiment, it becomes possible to suppress deterioration of productivity caused by providing the plural conveying lines. Additionally remarking, in the configuration of the exemplary embodiment, the productivity is hardly deteriorated because the printing process is performed on plural can bodies 10 though the can bodies 10 are sequentially conveyed in series by use of a single conveying line.

Figure 4:
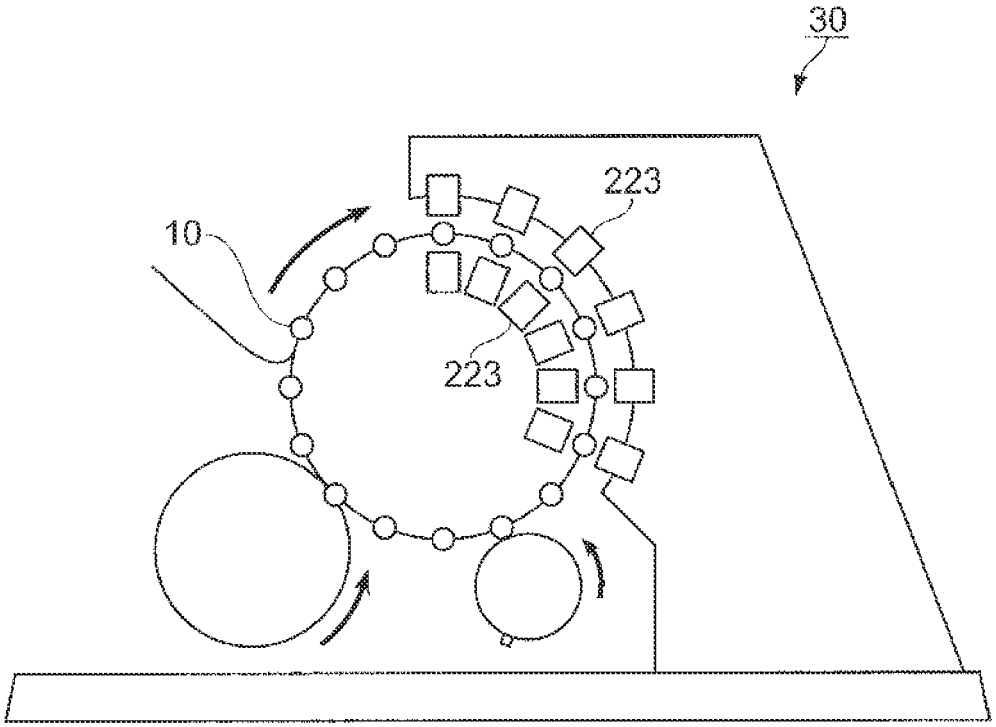
FIG. 4 is a diagram showing a comparative example of the printer.

Here, FIG. 4 is a diagram showing a comparative example of the printer.

In a printer 30 shown in FIG. 4, similar to the printer 1 in the exemplary embodiment, the can body 10 is moved in the state in which the can body 10 is held by the holding member (not shown in the figure). Moreover, rotation of the holding member is carried out and the can body 10 rotates. By the way, in the printer 30, the ink ejection devices 223 do not move with the can bodies 10, but are in a state of being secured on a main body side of the printer 30.

For this reason, in the printer 30, the can body 10 is conveyed to a facing position of the ink ejection device 223 by intermittent feeding, and all the can bodies 10 are temporarily stopped at the facing positions. Then, rotation of the can bodies 10 is carried out at these positions, and ejection of the ink from the ink ejection devices 223 is also performed. Thereafter, the intermittent feeding is carried out again to arrange the can bodies 10 at the facing positions of the adjacent ink ejection devices 223. Then, at these positions, rotation of the can bodies 10 is carried out again, and the ink is ejected onto the can bodies 10 from the adjacent ink ejection devices 223.

Then, in the printer 30, a predetermined image is formed on the can body 10 by repeated performance of operations in this manner. In the case of the printer 30, it is impossible to form all of the image by only a single rotation of the can body 10, and it is required to rotate the can body 10 plural times. Consequently, the number of can bodies 10 that can be conveyed per unit time becomes small.

It should be noted that, in the printer 30, the ink ejection devices 223 are provided on both sides of a moving route of the can bodies 10 to try to reduce the time required for image formation; however, even though the ink ejection devices 223 are provided on both sides like this, it becomes necessary to convey the can body 10 to the adjacent ink ejection devices 223 in a case where an image is to be formed by ink of many colors, such as six colors. Then, in this case, productivity is deteriorated.

Next, description will be given of the first conveying device 300, the heating device 400, the coating device 500, the second conveying device 600 and the third conveying device 700, which have been shown in FIG. 1.

As shown in FIG. 1, the first conveying device 300 includes plural suction members 310. Here, the plural suction members 310 perform the circulating movement along a predetermined route (a route that forms an arc). Additionally remarking, movement in the direction of counterclockwise in the figure is performed. Moreover, the plural suction members 310 are, similar to the can body conveying mechanism 100 shown in FIG. 3C, arranged in the frontward of the can body moving mechanism 200 in the depth direction of the printer 1.

Here, in the first conveying device 300, first, in the can body 10, which is held by evacuation through the air vent formed in the holding member 222 (refer to FIG. 2) provided in the can body moving mechanism 200, a vacuum is broken by replacing the vacuum in the air vent with a compressed air, and a pressure is applied to a bottom portion of the can body 10 by the compressed air, to thereby move the can body 10 in the frontward direction in the space of FIG. 1 to the suction member 310. The suction member 310 holds the can body 10 that has moved by evacuation through an air vent formed on the suction member 310. Then, the suction member 310, without any change, is moved along the above-described predetermined route. This causes the can body 10 on which an image is formed by the can body moving mechanism 200 to be conveyed to the heating device 400.

The heating device 400 includes a member that is similar to the holding member 222 provided in the can body moving mechanism 200 (hereinafter, this member is also referred to as "holding member 222"). Here, the plural holding members 222 are provided. The holding member 222 performs circulating movement along a predetermined route (a route that forms an arc). Additionally remarking, the holding member 222 moves in the clockwise direction in the figure. Moreover, each of the holding members 222 rotates.

Further, the heating device 400 in the exemplary embodiment is arranged on a deeper side than the first conveying device 300 in the depth direction of the printer 1. Here, passing of the can body 10 from the first conveying device 300 to the heating device 400 is carried out as follows. First, in the suction member 310 that holds the can body 10 by evacuation, a vacuum is broken by replacing the vacuum in an air vent formed in the suction member 310 with a compressed air, and a pressure is applied to the bottom portion of the can body 10 by the compressed air, to thereby move the can body 10 to the holding member 222 in the heating device 400. On the other hand, in the holding member 222, evacuation is started through an air vent formed in the holding member 222. This causes the holding member 222 to be inserted into the can body 10 and held by evacuation.

It should be noted that, though the description was omitted above, with respect to a moving trail of the suction member 310, the suction member 310 has a function of moving the position from the center. For example, in the case where the can body 10 is received from the holding member 222 on the image forming unit 220, if the above-described moving function is not provided, there are only two contact points between the holding member 222 and the suction member 310, and the positions of the holding member 222 and the section member 310 momentary coincide with each other twice; therefore, it becomes difficult to pass the can body 10 (refer to FIG. 1). In contrast, in the case where the moving function that causes the trail of the suction member 310 to coincide with the trail of the holding member 222 is provided, the positions of the holding member 222 and the suction member 310 coincide with each other for a certain period of time, and accordingly, the can body 10 is surely passed.

In the same manner, as indicated by a sign 1A in FIG. 1, the suction member 310 of the first conveying device 300 temporarily deviates from the moving route formed like an arc at a point where the first conveying device 300 and the heating device 400 overlap, to thereby move linearly. Moreover, as indicated by the sign 1A, the holding member 222 of the heating device 400 also temporarily deviates from the moving route formed like an arc at the point where the first conveying device 300 and the heating device 400 overlap one another, to thereby move linearly. Further, at the point indicated by the sign 1A, the suction member 310 and the holding member 222 move in the state of overlapping one another. Then, in the exemplary embodiment, the can body 10 is passed from the suction member 310 to the holding member 222 when the overlap occurs between the suction member 310 and the holding member 222 in this manner.

It should be noted that the linear movement of the suction member 310 and the linear movement of the holding member 222 are carried out by use of a cam or the like. In addition, though the description was omitted above, with respect to the contact portion between the roll-like member 510 in the coating device 500 and the holding member 222, as shown in FIG. 1, the holding member 222 moves on an outer circumference of the roll-like member 510. It should be noted that, in a portion where the heating device 400 and the second conveying device 600 overlap one another, the holding member 222 temporarily deviates from a moving route formed to curve outwardly and formed like an arc. This causes the holding member 222 to overlap a suction member 610 provided in the second conveying device 600 (having a configuration and function same as those of the suction member 310 in the first conveying member 300). Moreover, a pin 720 provided in the third conveying device 700 (a rod-like member attached to a chain 710, on which the can body 10 is hooked to be conveyed) also deviates from a moving route formed to curve outwardly and formed like an arc. This causes the pin 720 to overlap the suction member 610.

Here, to describe the heating device 400 in detail, the heating device 400, which functions as a curing unit, includes a heating portion 410 that is provided along the moving route of the can body 10 and heats the can body 10. Here, the heating portion 410 includes an infrared ray lamp or the like (not shown), and carries out heating of the can body 10 by use of the infrared ray lamp or the like. By the heating, the ink applied to the outer circumferential surface of the can body 10 is cured. It should be noted that, in the exemplary embodiment, the holding member 222 provided in the heating device 400 rotates, and thereby unevenness in heating on the can body 10 is hardly generated. Moreover, in the exemplary embodiment, since the heating portion 410 is provided on both sides of the moving route of the can body 10, it is possible to cure the ink in a shorter time compared to a case where the heating portion 410 is provided only on one side of the moving route.

Here, in the exemplary embodiment, the paint is applied to the outer circumferential surface of the can body 10 by the coating device 500; however, if the fluidity of the ink constituting the image on the can body 10 is high, there is a possibility that the image is deformed. Therefore, in the exemplary embodiment, the can body 10 is heated prior to applying the paint by the coating device 500, to thereby cure the ink on the can body 10. It should be noted that, in the exemplary embodiment, the ink is cured by heating; however, in a case where a UV (ultraviolet) cure ink is used, the ink is cured by irradiation by a UV lamp.

Here, in the exemplary embodiment, the coating device 500 is provided on a downstream side of the heating portion 410. The coating device 500 coats the outer circumferential surface of the can body 10 with a predetermined paint. This forms a protection layer on the image formed on the outer circumferential surface of the can body 10. It should be noted that the coating device 500 includes the roll-like member 510, and performs coating the can body 10 with the paint by bringing the roll-like member 510 into contact with the outer circumferential surface of the can body 10.

The can body 10 having been heated by the heating device 400 and coated with the paint by the coating device 500 is further conveyed by the second conveying device 600. The second conveying device 600 is configured similar to the first conveying device 300, and provided with the plural suction members 610. Here, the plural suction members 610 carry out circulating movement along a predetermined route and in the counterclockwise direction.

Moreover, the second conveying device 600 is arranged on the frontward side of the heating device 400 in the depth direction of the printer 1. Here, similar to the first conveying device 300, the second conveying device 600 sucks the can body 10 by facing the suction member 610 toward the bottom portion of the can body 10 held by the holding member 222 of the heating device 400. This causes the can body 10 to be conveyed to the third conveying device 700.

The third conveying device 700 is arranged on the deeper side of the second conveying device 600 in the depth direction of the printer 1. Here, the third conveying device 700 is configured with the chain 710 that carries out orbital movement in the clockwise direction and the plural pins 720 attached to the chain 710. Passing of the can body 10 from the second conveying device 600 to the third conveying device 700 is performed by inserting the pin 720 into the can body 10. Here, in the exemplary embodiment, as described above, the can body 10 is conveyed to a not-shown baking device (process) by the third conveying device 700.

Figure 5:
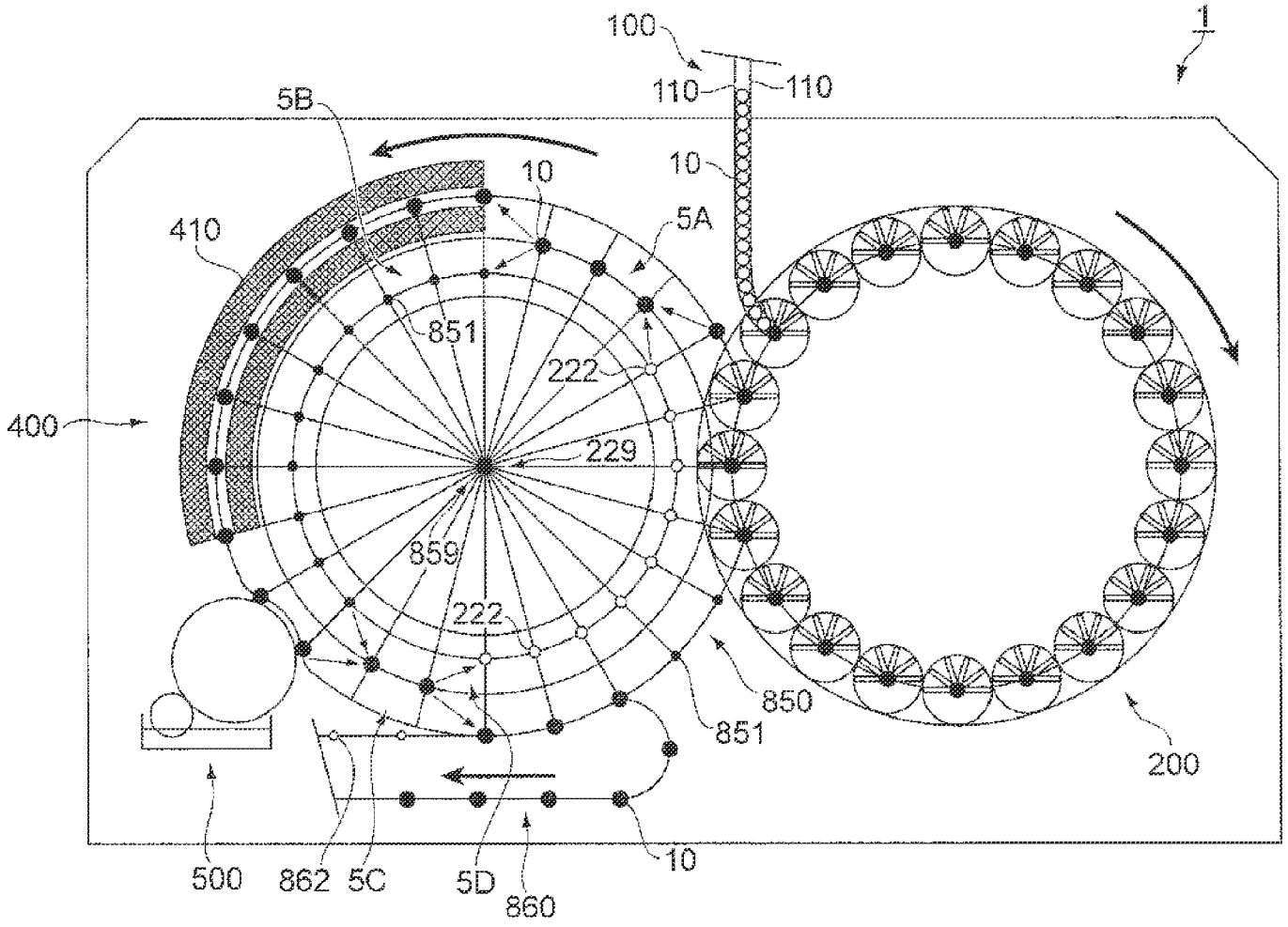
FIG. 5 is a diagram showing another mode of the printer.

FIG. 5 is a diagram showing another mode of the printer 1.

In the printer 1 shown in FIG. 5, similar to the above description, there are provided the can body conveying mechanism 100 that conveys the can body 10 downward and the can body moving mechanism 200 that moves the can body 10 while performing image formation on the outer circumferential surface of the can body 10 having been conveyed by the can body conveying mechanism 100. Moreover, in the exemplary embodiment, the heating device 400 is provided in immediate proximity on the downstream side of the can body moving mechanism 200 in the conveying direction of the can body 10.

Further, in the exemplary embodiment, the heating device 400 is provided to overlap suction members 851 of a first conveying device 850 in the depth direction of the printer 1. Additionally remarking, the heating device 400 and the first conveying device 850 are provided so that the heating device 400 and the first conveying device 850 overlap one another in a case where the printer 1 is viewed from the frontward side. Moreover, the suction members 851 of the first conveying device 850 are at the same positions as the holding members 222 of the can body moving mechanism 200 with respect to the depth direction. Further, in the depth direction of the printer 1, a second conveying device 860 configured similar to the third conveying device 700 (refer to FIG. 1) is provided on the deeper side of the first conveying device 850.

Here, similar to the above description, the first conveying device 850 includes the plural suction members 851 that carry out circulating movement along the route formed like an arc. Then, in the exemplary embodiment, similar to the above description, the suction member 851 faces the can body 10 held by the holding member 222 of the can body moving mechanism 200, and the can body 10 is held by the suction member 851. Additionally remarking, the suction member 851 receives the can body 10 having been conveyed by the holding member 222.

Thereafter, the can body 10 is further conveyed by the suction member 851, which is an example of a conveying member. Thereafter, at the point indicated by the sign 5A in FIG. 5, the can body 10 held by the suction member 851 is received by the holding member 222 (the holding member 222 of the heating device 400) that is positioned on the deeper side and carries out circulating movement along the route formed like an arc, and is held by the holding member 222, which is an example of a receiving member.

Thereafter, the can body 10 is further conveyed by the holding member 222, and similar to the above description, passes through the heating device 400 and the coating device 500. This causes the ink formed on the outer circumferential surface of the can body 10 to be cured, to thereby form a protection layer on the ink. It should be noted that, as indicated by the sign 5B in the figure, the suction member 851 after passing the can body 10 to the holding member 222 of the heating device 400 passes through the inner side of the heating portion 410.

After the protection layer is formed on the can body 10, as indicated by the sign 5C in the figure, the can body 10 moves inwardly due to inward movement of the holding member 222 that holds the can body 10, and the suction member 851 moves outwardly. Then, at the point indicated by the sign 5C, the holding member 222 and the suction member 851 come to overlap one another. Then, at this point, the can body 10 is passed from the holding member 222 positioned on the deeper side to the suction member 851 positioned on the frontward side. It should be noted that the holding member 222 having passed through the point indicated by the sign 5C moves inwardly as indicated by the sign 5D to avoid interference with the holding member 222 provided to the can body moving mechanism 200. Thereafter, in the exemplary embodiment, the can body 10 is passed from the suction member 851 to the second conveying device 860, and the can body 10 is conveyed to the baking device.

Here, in the exemplary embodiment described with reference to FIG. 1, the first conveying device 300 was provided between the can body moving mechanism 200 and the heating device 400 and the second conveying device 600 was provided between the heating device 400 and the third conveying device 700; however, in this exemplary embodiment, the first conveying device 300 and the second conveying device 600 are omitted. Instead, the first conveying device 850 is provided. In the case of the configuration like this, it becomes possible to downsize the printer 1.

Moreover, in the exemplary embodiment, as described above, the heating device 400 and the first conveying device 850 are provided so that the heating device 400 and the first conveying device 850 overlap one another in the case where the printer 1 is viewed from the frontward side. To be described further, in the exemplary embodiment, a central shaft (rotational shaft) 859 around which the plural suction members 851 carry out the circulating movement and a central shaft (rotational shaft) 229 around which the plural holding members 222 carry out the circulating movement coincide with each other. It should be noted that, when the suction member 851 and the holding member 222 perform passing of the can body 10, the moving trail of the suction member 851 and the moving trail of the holding member 222 coincide with each other. Moreover, these suction members 851 and holding members 222 on the image forming unit 220 cause the moving trail to coincide with the holding members 222 on the image forming unit 220 by being provided with a function capable of moving in the axial direction by having a cam or the like. Moreover, with respect to the contact portion between the roll-like member 510 in the coating device 500 and the holding member 222, the holding member 222 moves on the outer circumference of the roll-like member 510. Then, in this case, it becomes possible to reduce the size in the width direction of the printer 1.

Figure 6:
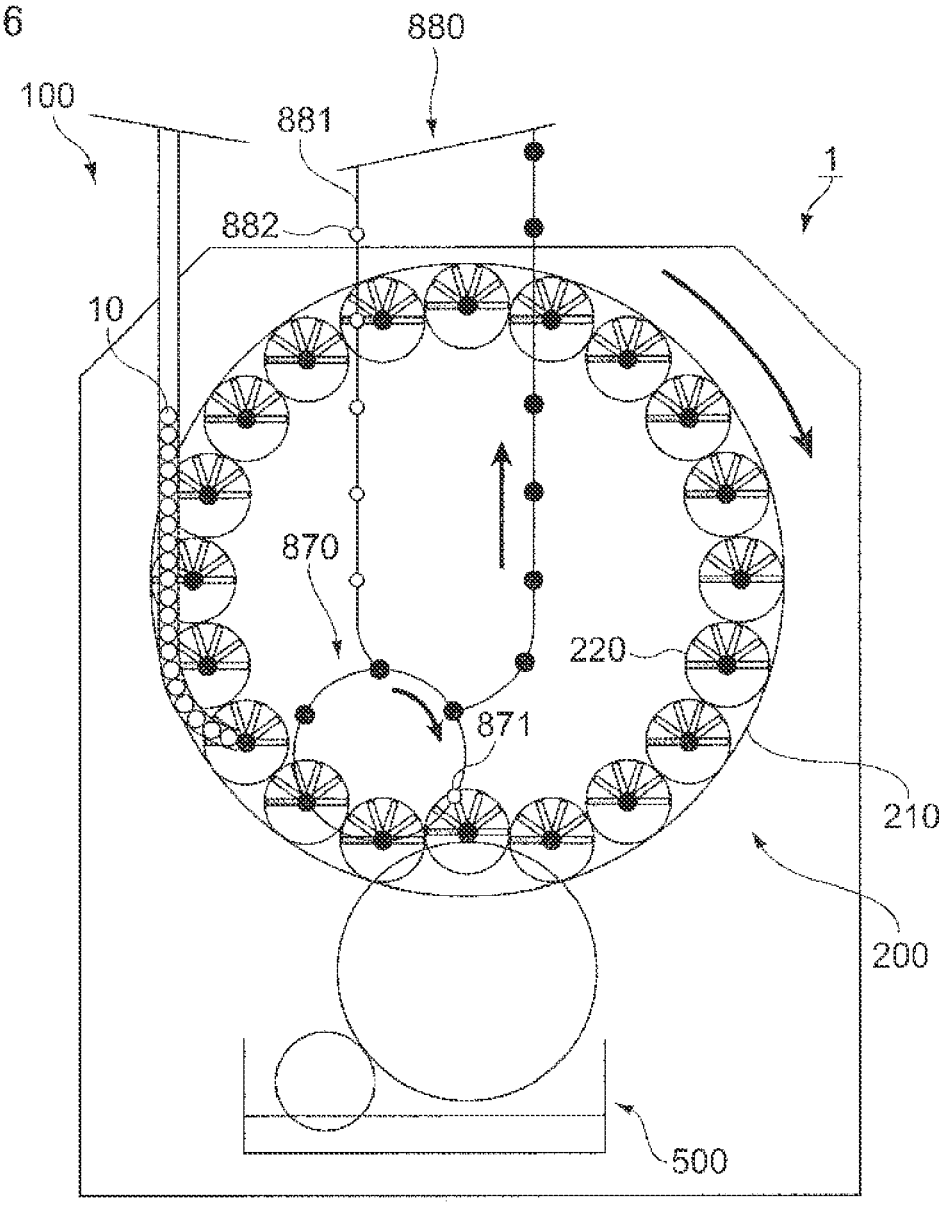
FIG. 6 is a diagram showing still another mode of the printer.
Figure 7:
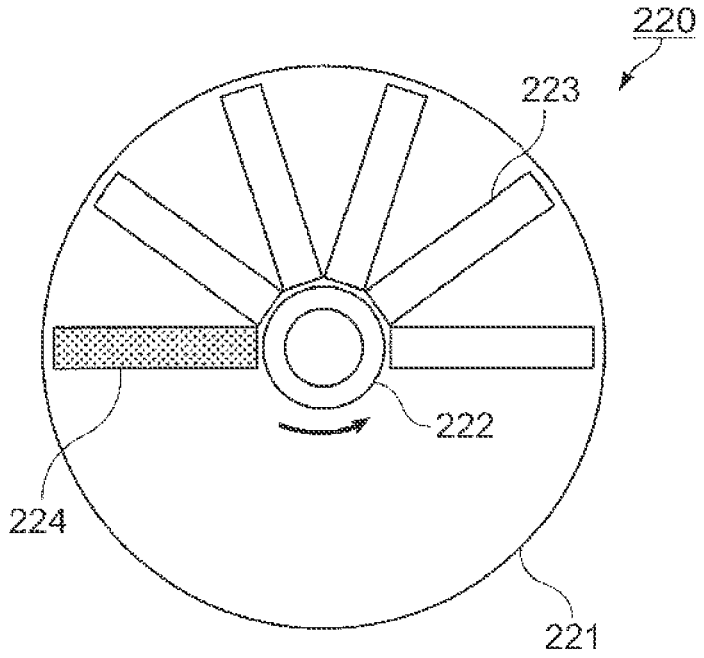
FIG. 7 is a diagram showing the still another mode of the printer.

FIG. 6 and FIG. 7 are diagrams showing still another mode of the printer 1. It should be noted that FIG. 6 is a diagram showing an entire configuration of the printer 1, and FIG. 7 is a diagram enlarging and showing the image forming unit 220.

In the exemplary embodiments described above, configuration was such that the can body 10 was heated by the heating device 400 provided at a place different from the can body moving mechanism 200; however, in this exemplary embodiment, as shown in FIG. 7, a heating unit 224 for heating the can body 10 is incorporated into part of the image forming unit 220, to thereby heat the can body 10 by the heating unit 224.

Here, the heating unit 224 is arranged on the downstream side of the ink ejection device 223 in the rotating direction of the holding member 222 (can body 10) to cure the ink adhered to the can body 10 on the upstream side. In the case of the configuration of the exemplary embodiment, since the ink is cured immediately after the ink is applied, foreign substances hardly enter into the ink.

Here, similar to the above description, the heating unit 224 includes a not-shown infrared ray lamp or the like, and heating of the can body 10 is carried out by use of the infrared ray lamp or the like. It should be noted that, to prevent insufficient heating, heating of the can body 10 is carried out from the start of image formation on the can body 10 until discharge of the can body 10 from the can body moving mechanism 200 in the exemplary embodiment. Moreover, to prevent unevenness in heating, the can body 10 is rotated in the circumferential direction. Here, in the exemplary embodiment, since the heating unit 224 is provided in the image forming unit 220, the heating device 400 shown in FIG. 1 or the like is omitted (refer to FIG. 6). It should be noted that, in the case where the ink of the UV (ultraviolet) cure type is used, a UV lamp is mounted instead of the heating unit 224.

Moreover, in the exemplary embodiment, as shown in FIG. 6, a first conveying device 870 including plural suction members 871 is arranged on the frontward side of the can body moving mechanism 200. Further, similar to the above description, a second conveying device 880 including a chain 881 and pins 882 is arranged on the deeper side of the first conveying device 870. Moreover, to prevent interference between the can bodies 10 hooked on the pins 882 and the can bodies 10 in the can body moving mechanism 200 in the depth direction, the chain 881 is placed to have a certain angle with the can body moving mechanism 200 for avoiding mutual interference, as necessary. Moreover, in the exemplary embodiment, the coating device 500 is provided adjacent to the can body moving mechanism 200, and coating of the can body 10 with a paint is performed in the course of holding the can body 10 by the image forming unit 220. Moreover, the image forming unit 220 is configured to be movable in the direction of the rotation center, and the image forming unit 220 is moved by cam or the like in response to the rotation of the rotating member 210 to cause the trail of the suction members 871 of the first conveying member 870 and the trail of the can body 10 to coincide with each other. Moreover, the can body 10 moves on the outer circumference of the roll-like member 510 in the coating device 500.

Here, also in the exemplary embodiment, similar to the above description, the can body 10 is held by the image forming unit 220 and an image is formed on the can body 10 by the ink ejection devices 223 arranged around the can body 10. Moreover, the can body 10 is heated by the heating unit 224 provided in the image forming unit 220, and thereby the ink on the can body 10 is cured until the can body 10 is discharged from the can body moving mechanism 200.

Thereafter, the can body 10 is held by the first conveying device 870. Specifically, similar to the above description, the can body 10 is sucked and held by the suction member 871. Thereafter, the pin 882 provided to the chain 881 of the second conveying device 880 is inserted into the can body 10, to thereby convey the can body 10 by the second conveying device 880.

In the configuration in the exemplary embodiment, the heating device 400 shown in FIGS. 1 and 5 is omitted, and accordingly, further downsizing of the printer 1 is intended. Moreover, it becomes possible to omit the first conveying device 300 (refer to FIG. 1) that conveys the can bodies 10 from the can body moving mechanism 200 to the heating device 400, the first conveying device 850 (refer to FIG. 5) that conveys the can bodies 10 from the can body moving mechanism 200 to the heating device 400, or the like, and therefore the printer 1 can further be downsized.

It should be noted that, in the exemplary embodiments described above, description was given of the case where the image forming unit 220 (refer to FIG. 1) is rotated and the attitude of the image forming unit 220 is kept constant; however, it is possible to fix the image forming unit 220 to the rotating member 210.

Figure 8:
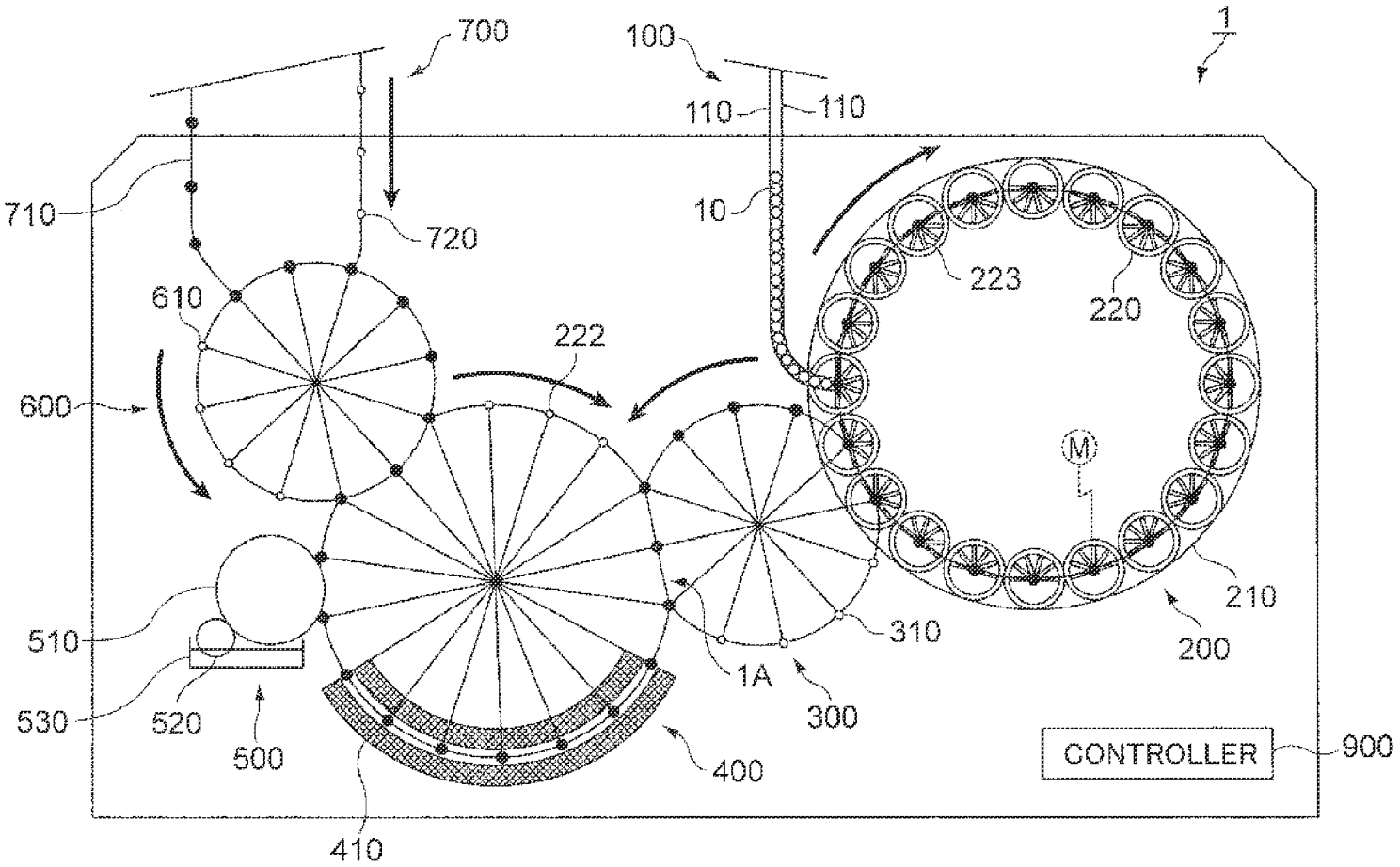
FIG. 8 is a diagram showing another configuration example of the printer.

FIG. 8 is a diagram showing another configuration example of the printer 1. It should be noted that the basic configuration is same as that of the printer 1 shown in FIG. 1, and different points will be described here.

Here, in the exemplary embodiment shown in FIG. 8, each of the ink ejection devices 223 is attached with a certain angle to an axial line that connects the rotation center of the rotating member 210 and the center of each of the holding members 222. Additionally remarking, in the exemplary embodiment, each of the image forming units 220 is arranged so that the attitude of the plural ink ejection devices 223, which are provided to each of the image forming units 220, with respect to the rotation center of the rotating member 210 is the same (constant) in each of the plural image forming units 220.

In the case of the configuration like this, with the rotation of the rotating member 210, the attitude of the ink ejection devices 223 provided in each of the image forming units 220 is changed. Additionally remarking, the attitude with respect to the rotation center of the rotating member 210 is kept constant, but the attitude with respect to other portions is changed. For example, in FIG. 8, the ink ejection devices 223 in the image forming unit 220 at the uppermost portion in the rotating member 210 are positioned below the can body 10; however, the ink ejection devices 223 in the image forming unit 220 at the lowermost portion in the rotating member 210 are positioned above the can body 10.

Here, in the exemplary embodiment, the ink is ejected from the ink ejection devices 223 while the rotating member 210 is rotating, and three forces, namely, centrifugal force, gravity and ejection force (ejection force by the ink ejection device 223) act on the ejected ink. Here, in a case where the rotating member 210 rotates at a constant angular speed, an operating direction when centrifugal force acts on the ink is not changed. However, with respect to gravity, since gravity always acts downwardly in the vertical direction, the direction of gravity acting upon the ink differs depending on the position of the ink ejection devices 223. Then, if the operating direction of gravity differs depending on the position of the ink ejection devices 223 in this manner, there is a possibility that an amount of ink reaching the can body 10 increases or decreases.

Therefore, as shown in FIG. 8, in the case where the configuration in which the attitude of the image forming unit 220 is not kept constant, it becomes desirable to correct (change) the ejection force in ejecting the ink from the ink ejection device 223 corresponding to the attitude (position) of the ink ejection devices 223 (the image forming unit 220).

Additionally remarking, in the configuration of the exemplary embodiment, the ink ejection force acts in the direction of the axial line that connects the ink ejection head of the ink ejection device 223 and the center of the can body 10. Here, gravity acting on the ink ejected from each ink ejection head is divided into a component force in the above-described axial line direction and a component force in a direction orthogonal to the axial line direction, and it becomes desirable to correct (change) the ink ejection force by use of the component force in the axial line direction.

It should be noted that the direction of gravity acting on the ink ejected from each of the ink ejection devices 223 can be grasped based on the position of each of the ink ejection devices 223. Here, the position of each of the ink ejection devices 223 can be grasped, for example, by the rotating angle of the rotating member 210. Here, the rotating angle of the rotating member 210 can be grasped, for example, by attaching a sensor capable of detecting the rotating angle of, for example, a rotary encoder to the rotating member 210.

Moreover, during a period from the start of rotation of the rotating member 210 until the speed of the rotating member 210 becomes constant, centrifugal force acting on each of the image forming units 220 on the rotating member 210 gradually increases. In addition, when the rotating member 210 is stopped or decelerated, centrifugal force acting on each of the image forming units 220 on the rotating member 210 gradually decreases. In such a case, also, it is desirable to correct the ink ejection force. In this case, for example, the angular speed of the rotating member 210 and the angle of the rotating member 210 are detected by use of a rotary encoder or the like, and based on the detected angular speed, a distance from the rotation center to each of the ink ejection device 223 and a mass of the ink, which are known data, centrifugal force acting on each of the ink ejection devices 223 (each ink ejection head) is calculated. Then, by use of the calculated centrifugal force and the angle of each of the ink ejection devices 223 or the like, which is calculated from the detected angle of the rotating member 210, correction is made to the ink ejection force in ejecting the ink from the ink ejection head.

To further describe the printer 1 shown in FIG. 8, in the printer 1 shown in the figure, in the case where each of the plural image forming unit 220 is viewed from the rotation center of the rotating member 210, arrangement mode of the plural ink ejection devices 223 in each of the image forming unit 220 is in the same state. To be described further, in the exemplary embodiment, the state of the image forming unit 220 with respect to the rotating member 210 is not changed even though the rotating member 210 rotates.

Here, in the configuration shown in FIG. 1, since centrifugal force heading upward in the figure acts on the image forming unit 220 positioned at the upper portion of the rotating member 210, the ink becomes hard to be ejected. On the other hand, since centrifugal force heading downward in the figure acts on the image forming unit 220 positioned at the lower portion of the rotating member 210, the ink is readily ejected. Then, in this case, there is a possibility of causing fluctuations in the amount of ink ejection in response to the position of the image forming unit 220. On the other hand, in the configuration shown in FIG. 8, the direction of centrifugal force acting on each of the image forming units 220 is kept constant, and accordingly, fluctuations in the amount of ink ejection caused by the change of the direction in which centrifugal force acts are suppressed.

It should be noted that the change (correction) of the ink ejection force can be carried out for every image forming unit 220 (per image forming unit 220), or for every ink ejection device 223 (per single ink ejection device 223). For example, of the plural image forming units 220 provided in the rotating member 210 in FIG. 8, in the image forming unit 220 in the rightmost position in the figure, with respect to the ink ejected from the ink ejection device 223 positioned above the can body 10, gravity acts in the same direction with the ink ejecting direction. On the other hand, with respect to the ink ejected from the ink ejection device 223 positioned below the can body 10, gravity acts in a direction opposite to the ink ejecting direction. In such a case, for example, it is possible to increase the ejection force in ejecting ink from the ink ejection device 223 positioned below the can body 10, and decrease the ejection force in ejecting ink from the ink ejection device 223 positioned above the can body 10.

Here, in FIG. 8, description was given of the case where the can body moving mechanism 200 in FIG. 1 was changed; however, the can body moving mechanism 200 shown in FIG. 5 and the can body moving mechanism 200 shown in FIG. 6 are able to have configurations same as that of the can body moving mechanism 200 shown in FIG. 8.

It should be noted that, in the can body moving mechanisms 200 shown in FIGS. 1, 5 and 6 (the can body moving mechanism 200 in which the attitude of the image forming unit 220 is kept constant), it is possible to change the ejection force in ejecting ink. For example, in the can body moving mechanism 200 shown in FIG. 1, the acting direction of gravity acting on the ink becomes constant; however, in response to the position of the image forming unit 220, the acting direction of centrifugal force acting on the ink becomes different.

For example, in FIG. 1, of the plural image forming units 220, with respect to the image forming unit 220 is at the rightmost position in the figure, centrifugal force heading in the right direction in the figure comes to act on, while, with respect to the image forming unit 220 is at the leftmost position in the figure, centrifugal force heading in the left direction in the figure comes to act on. Then, in this case, there is a possibility of causing fluctuations in the amount of ink ejection in response to the position of the image forming unit 220.

Accordingly, in this case also, similar to the above description, it is possible to change the ejection force in ejecting the ink in response to the position of the image forming unit 220. To be specifically described, for example, when the image forming unit 220 is at the rightmost position in the figure, the ejection force in ejecting the ink from the ink ejection device 223 at the rightmost position in the image forming unit 220 is increased, and the ejection force in ejecting the ink from the ink ejection device 223 at the leftmost position in the image forming unit 220 is decreased. Moreover, when the image forming unit 220 has moved to the leftmost side in the figure with the rotation of the rotating member 210, the ejection force in ejecting the ink from the ink ejection device 223 at the rightmost position in the image forming unit 220 is decreased, and the ejection force in ejecting the ink from the ink ejection device 223 at the leftmost position is increased.

Second Exemplary Embodiment

Hereinafter, an exemplary embodiment according to the present invention will be described with reference to attached drawings.

Figure 9:
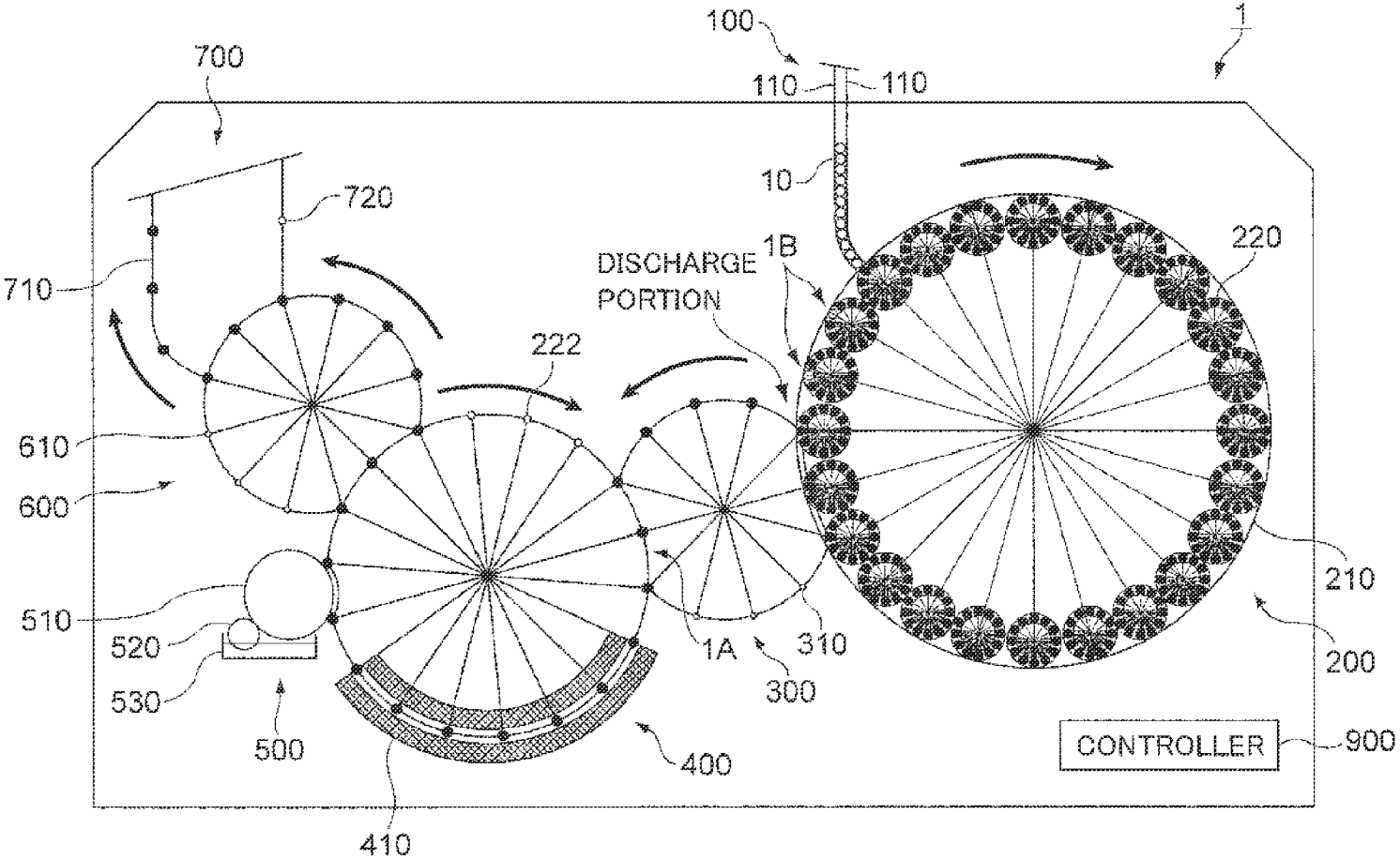
FIG. 9 is a diagram schematically showing an example of a printer that performs printing on a can body.

FIG. 9 is a diagram schematically showing an example of a printer 1 that performs printing on a can body.

The printer 1 as an example of an image forming device is a printer that forms an image on a can body 10 based on digital image information. Here, the printer 1 is provided with, similar to the first exemplary embodiment: a can body conveying mechanism 100 that sequentially conveys the can bodies 10 having been manufactured in a not-shown can body manufacturing process; a can body moving mechanism 200 that moves the can body 10 while forming an image on an outer circumferential surface of the can body 10 conveyed by the can body conveying mechanism 100; and a first conveying device 300 that conveys the can body 10 on which an image has been formed by the can body moving mechanism 200.

Moreover, the printer is provided with: a heating device 400 that heats the can bodies 10 sequentially conveyed by the first conveying device 300; and a coating device 500 that coats an outer circumferential surface of the can body 10 (the image having been formed on the can body) heated by the heating device 400 with a predetermined paint. Also, a second conveying device 600 that further conveys the can body 10 heated by the heating device 400 and coated with the paint by the coating device 500 to a downstream side, and a third conveying device 700 that further conveys the can body 10 conveyed by the second conveying device 600 to the downstream side are provided.

Moreover, the printer 1 is provided with a controller 900 that performs control of each device and each mechanism provided in the printer 1. It should be noted that, on the downstream side of the third conveying device 700 in a conveying direction of the can body 10, there is provided a baking device (not shown) that bakes the image formed on the can body 10 and the paint applied to the can body 10 onto the can body 10.

Here, the can body conveying mechanism 100 conveys the can body 10 toward the can body moving mechanism 200 that is positioned below by utilizing a weight of the can body 10. In addition, the can body conveying mechanism 100 includes a guide member 110 provided along the vertical direction and on both sides of a moving route of the can body 10, and conveys the can body 10 toward the can body moving mechanism 200 by use of the guide member 110.

The can body moving mechanism 200 is provided with a rotating member 210 that is formed in a disc shape and rotates in a clockwise direction in the figure. Moreover, the can body moving mechanism 200 is provided with image forming units 220 that are provided at an outer circumferential edge of the rotating member 210, to hold the plural can bodies 10 sequentially conveyed by the can body conveying mechanism 100, move with the can bodies 10, and form images on outer circumferential surfaces of the holding can bodies 10. Additionally remarking, the can body moving mechanism 200 is provided with the image forming units 220 that hold a can body group configured with the plural can bodies 10, move with the can body group, and form images on the holding can body group.

Here, the rotating member 210, which functions as part of the conveying unit, is arranged so that a rotational axis thereof becomes horizontal. Additionally remarking, a mount surface on which the image forming unit 220 is mounted is arranged along the vertical direction. It should be noted that the arrangement mode of the rotating member 210 is not limited to a mode like this. For example, a rotating member 210 may be provided so that the rotational axis is along the vertical direction.

It should be noted that, similar to the first exemplary embodiment, in the configuration of the exemplary embodiment, arrangement of the rotating member 210 in which the rotational axis is horizontal causes less complexity in processes. Here, in the coating device 500 in the exemplary embodiment, the paint is supplied to a tray 530 as much as a furnisher roll 520 is immersed. By rotation of the furnisher roll 520, the paint having a constant viscosity is stirred within the tray 530. Moreover, by rotation of the furnisher roll 520, the paint in the tray 530 adheres to a roll surface of the furnisher roll 520. The paint adhered to the furnisher roll 520 is transferred to a roll-like member 510, and further transferred to the can body 10. This establishes on the precondition that the paint is applied to the can body 10 while the can body 10 is horizontally oriented (in the state of lying down). In such a case, if the rotating member 210 is provided so that the rotational axis of the rotating member 210 is along the vertical direction, a need for changing the configuration or arrangement of the coating device 500 arises, and there occurs a possibility of causing complexity in the processes.

Here, the image forming units 220 are provided at an outer circumferential edge of the rotating member 210 as described above. Moreover, a plural number (in the exemplary embodiment, 24) of image forming units 220 are provided, and are arranged in line along the outer circumferential edge of the rotating member 210. Further, each of the provided plural image forming units 220 is arranged with an equal space in the circumferential direction of the rotating member 210.

Figure 10:
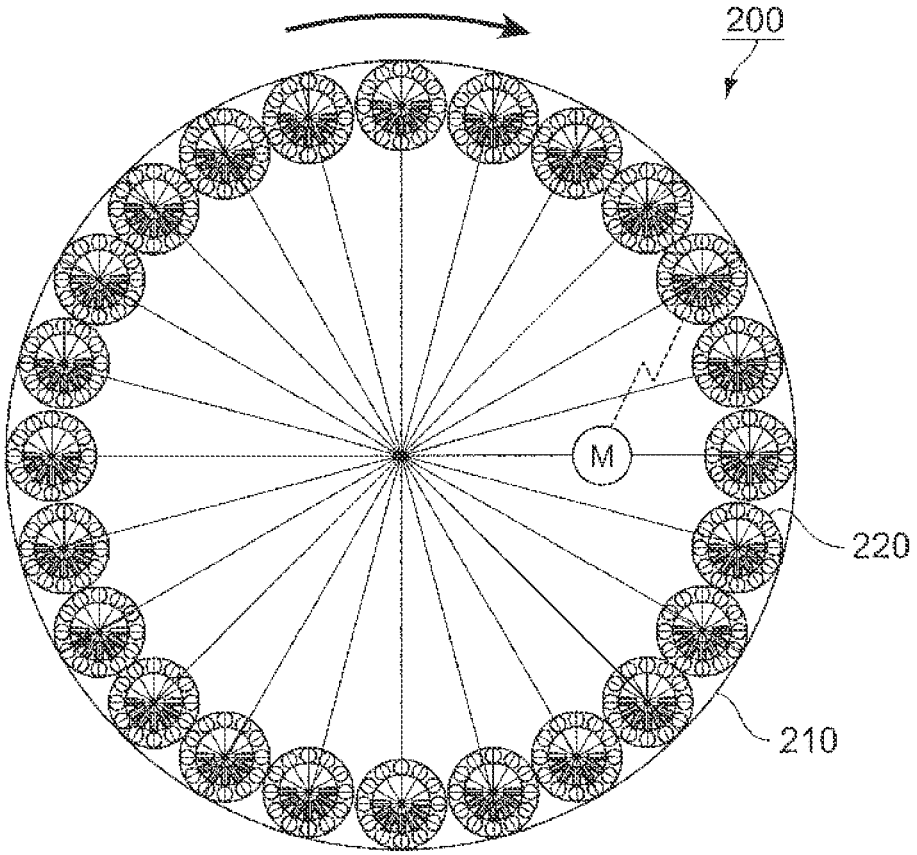
FIG. 10 is a diagram showing an enlarged can body moving mechanism.
Figure 11A:
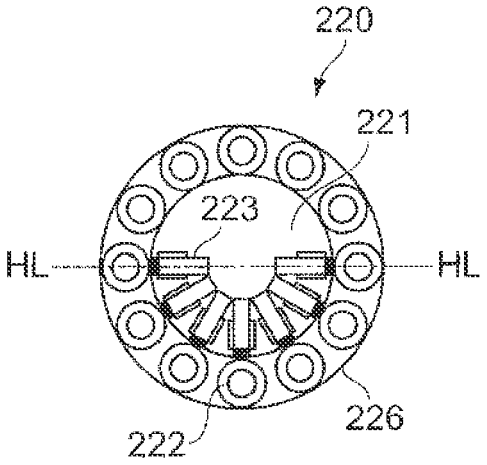
FIGS. 11A to 11C are diagrams for illustrating image forming units.
Figure 11B:
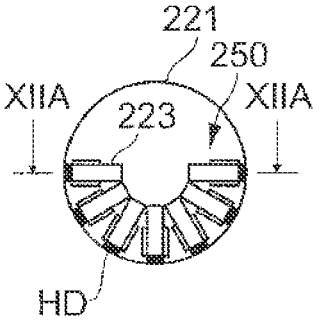
Figure 11C:
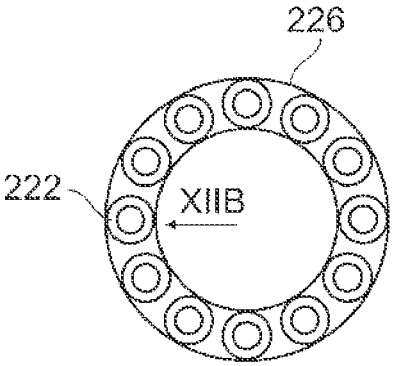
Figure 12A:
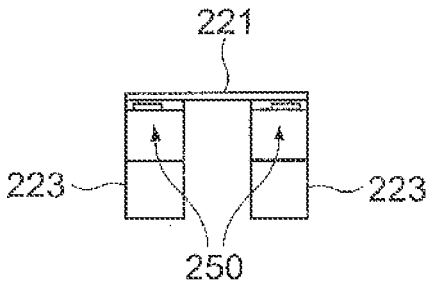
FIGS. 12A and 12B are diagrams for illustrating the image forming units.

FIG. 10 is a diagram showing the enlarged can body moving mechanism 200. Moreover, FIGS. 11A to 12B are diagrams for illustrating the image forming units 220. It should be noted that FIG. 11A is a front view of the image forming unit 220. Moreover, FIG. 11B is a diagram for illustrating a support table 221 that constitutes the image forming unit 220. Moreover, FIG. 11C is a diagram for illustrating a rotating plate 226 that constitutes the image forming unit 220. Moreover, FIG. 12A is a cross-sectional view along the XIIA-XIIA line in FIG. 11B. Moreover, FIG.

12B is a diagram in a case where the rotating plate 226 and the like are viewed from the direction of arrow XIIB in FIG. 11C.

As shown in FIG. 10, and as described above, the can body moving mechanism 200 in the exemplary embodiment is provided with the rotating member 210 that is formed in a disc shape and rotates in the clockwise direction in the figure. Moreover, at the outer circumferential edge of the rotating member 210, there are provided the image forming units 220 that hold the can bodies 10 and form the images onto the outer circumferential surfaces of the can bodies 10.

Here, with reference to FIGS. 11A to 11C, the image forming units 220 will be described in detail.

The image forming unit 220 in the exemplary embodiment is, as shown in FIG. 11A, provided with the support table 221 that is formed in a disc shape and supports the ink ejection devices 223 for ejecting the ink onto the can bodies 10. Moreover, the rotating plate 226 is provided, which moves with the support table 221, and is positioned outside of the support table 221 and formed in a ring shape, and is rotatable relative to the support table 221. It should be noted that a portion of the image forming unit 220 where the ink ejection devices 223 are provided can be grasped as an image forming mechanism that forms images on the can bodies 10 (can body group).

Here, in the exemplary embodiment, as described above, the ink ejection devices 223 that eject ink onto the outer circumferential surfaces of the can bodies 10 are supported by the support table 221. Here, as shown in FIG. 11B, the plural ink ejection devices 223 as an example of an image forming portion are provided. Here, in the exemplary embodiment, each of the ink ejection devices 223 forms an image on the can body 10 by the so-called ink-jet method. It should be noted that, in the exemplary embodiment, the seven ink ejection devices 223 are provided in the single image forming unit 220, to be thereby able to use seven colors of ink at a maximum.

Moreover, in each of the ink ejection devices 223, ink of a color different from each other is contained. Moreover, each of the ink ejection devices 223 is formed in a longitudinal shape. Further, the ink ejection device 223 formed in the longitudinal shape in this manner is arranged to be directed from the center portion toward the outer circumferential edge of the support table 221 formed in a disc shape. Further, each of the ink ejection devices 223 is arranged radially regarding the center portion of the support table 221 as a center.

Moreover, in the exemplary embodiment, the ink ejection devices 223 are not arranged above a horizontal line HL (refer to FIG. 11A), which is a horizontal line passing through a center portion of the support table 221. Additionally remarking, the ink ejection devices 223 are provided in a lower half side of the support table 221. In a case with such an arrangement mode, as shown in FIG. 11B, an ink ejection head HD of the ink ejection device 223 faces downward or in the lateral direction (horizontal direction), and accordingly, dust or the like hardly adheres to the ink ejection head HD. Additionally remarking, in the exemplary embodiment, the ink ejection head HD of the ink ejection device 223 is configured to face in any directions other than an upward direction, and accordingly, dust or the like hardly adheres to the ink ejection head HD.

Moreover, in the exemplary embodiment, the image forming unit 220 is able to rotate relative to the rotating member 210 (refer to FIG. 10). In addition, in the exemplary embodiment, as shown in FIG. 10, even if the image forming unit 220 moves with the rotation of the rotating member 210, the image forming unit 220 rotates in the counterclockwise direction in the figure so as not to cause change in the attitude of the image forming unit 220. It should be noted that the rotation of the image forming unit 220 is carried out by a motor M attached to a backside of the rotating member 210. Here, with respect to the motor M, the plural motors M are provided corresponding to the respective plural image forming units 220.

It should be noted that, in the exemplary embodiment, the attitude of the image forming unit 220 is kept by use of the motor M in this manner; however, for example, it is possible to decenter the position of the center of gravity of the image forming unit 220 by attaching a not-shown weight to a lower portion of the support table 221 (refer to FIG. 11A), to thereby keep the attitude of the image forming unit 220 constant.

Here, in a case where the attitude of the image forming unit 220 is changed, the ink ejection head HD of the ink ejection device 223 faces upward. Then, in this case, dust or the like is prone to adhere to the ink ejection head HD. Moreover, in the case where the attitude of the image forming unit 220 is changed, the attitude of the ink ejection device 223 is also changed. Then, in this case, there is a possibility that an amount of ink adhering to the can body 10 varies, or a position of ink adhesion is deviated. For this reason, in the exemplary embodiment, the attitude of the image forming unit 220 is kept constant as described above.

Moreover, in the exemplary embodiment, as shown in FIGS. 11A and 11C, in the rotating plate 226 that functions as part of a can body holding portion, the plural holding members (mandrels) 222 are provided to be projected from the rotating plate 226 (provided to be projected toward the frontward side in the figure) to hold the can bodies 10. Here, in the exemplary embodiment, the holding member 222 is inserted into the can body 10 via an opening formed on one end of the can body 10 that is cylindrically formed. Moreover, the holding member 222 is formed to be hollow, and an air vent is formed at an inner space of the holding member 222, and thereby the holding member 222 holds the can body 10 by evacuating the inside of the can body 10 through the air vent. This regulates movement of the can body 10 relative to the holding member 222. It should be noted that, in the exemplary embodiment, the movement of the can body 10 is regulated by evacuation; however, the movement of the can body 10 can also be regulated by a mechanical configuration, such as pressing a not-shown member against the can body 10.

Here, there are various kinds of can bodies 10, and there exist different diameters depending upon the kinds of the can bodies 10. Accordingly, in the exemplary embodiment, similar to the first exemplary embodiment, the ink ejection device 223 is configured to be movable forward and backward with respect to the holding member 222. Additionally remarking, the image forming unit 220 is configured so that the ink ejection device 223 is able to approach the holding member 222 (the can body 10) and the ink ejection device 223 is able to move away from the holding member 222. To be described further, the ink ejection device 223 is provided to move along the direction of diameter of the support table 221.

Moreover, in the exemplary embodiment, as shown in FIG. 11B and FIG. 12A, a forward and backward mechanism 250 that moves the ink ejection device 223 forward and backward with respect to the holding member 222 is provided. It should be noted that the forward and backward mechanism 250 is configured by, for example, a so-called linear actuator including a driving portion that moves linearly. More specifically, the linear actuator is configured with, for example, a linear motor or a servomotor and ball screws.

It should be noted that, similar to the first exemplary embodiment, information about the diameter of the can body 10 (information about the can body 10) is inputted by an operator through a not shown terminal, and is sent to the controller 900 (refer to FIG. 9) from the terminal. Then, upon receiving the information about the diameter of the can body 10, the controller 900 drives the forward and backward mechanism 250 based on the information to arrange the ink election device 223 at a position corresponding to the diameter of the can body 10. It should be noted that it is also possible to arrange the ink election device 223 at the position corresponding to the diameter of the can body 10 by providing a sensor for detecting the can body 10 in each of the ink ejection devices 223 and utilizing the sensor. In this case, it is possible to arrange the ink election device 223 at the position corresponding to the diameter of the can body 10 automatically. Additionally remarking, in the case where the ink ejection device 223 is automatically moved forward and backward by detecting the distance to the can body 10 by the sensor, since it becomes possible to perform ink ejection to the outer circumferential surface in the state where the distance between the outer circumferential surface of the can body 10 and the ink ejection device 223 is kept constant, it becomes possible to form an image not only on the can body 10 having the circular shape, but also on the can body 10 having, for example, an elliptical shape, a rectangular shape or the like. Moreover, by inputting the form data of the can body 10 in advance, it is also possible to automatically move the ink ejection device 223 forward and backward based on the form data. In this case, it is also possible to perform image formation on the can body 10 having a shape other than the circular shape.

Figure 12B:
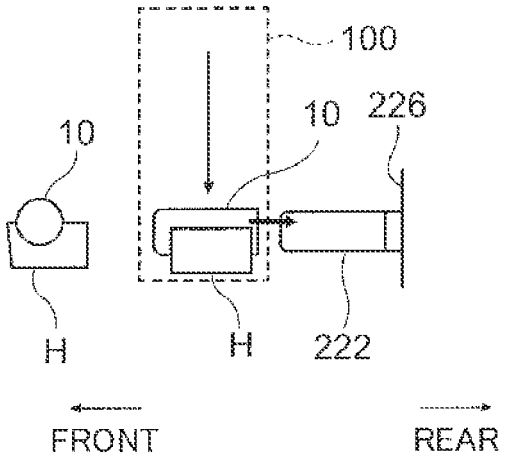

It should be noted that, though the description was omitted above, in the exemplary embodiment, a holder H, which is referred to as "pocket" that temporarily receives the can body 10 (in FIG. 9, illustration is omitted. Refer to FIG. 12B), is provided in the frontward of the can body moving mechanism 200 in the depth direction of the printer 1 (refer to FIG. 9). The pocket moves on the frontward side of the can body moving mechanism 200 together with the image forming unit 220. The can body 10 is carried out of the can body conveying mechanism 100 and temporarily placed in the pocket. On the deeper side of the pocket, there is the holding member 222 provided in the image forming unit 220. The center of the can body 10 placed in the pocket and the center of the holding member 222 coincide with each other. Here, in the exemplary embodiment, by evacuating the can body 10 by the air vent of the holding member 222, the can body 10 slides in the pocket toward the holding member 222 so that the holding member 222 is inserted into the can body 10, and thereby the can body 10 is held with evacuation by the holding member 222.

Moreover, in the exemplary embodiment, the can body 10 having moved from the can body conveying mechanism 100 to the image forming unit 220 (the can body 10 held by the holding member 222) rotates (rotates in the circumferential direction). Here, the rotation of the can body 10 is carried out by a rotating mechanism provided to the image forming unit 220.

Figure 13A:
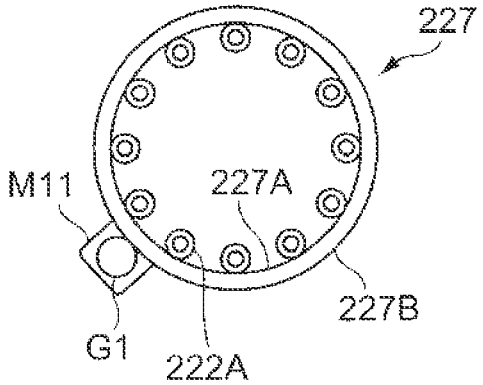
FIGS. 13A and 13B are diagrams for illustrating a rotating mechanism and the like that rotate a holding member in a circumferential direction.
Figure 13B:
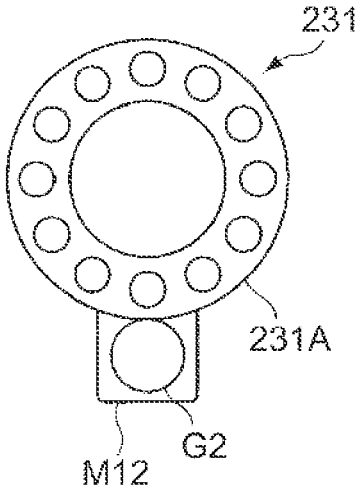

FIGS. 13A and 13B are diagrams for illustrating the rotating mechanism and the like that rotate the holding member 222 (the can body 10) in a circumferential direction.

Though the description was omitted above, on the backside of the rotating plate 226 (refer to FIG. 11A), a ring-shaped gear 227 shown in FIG. 13A is provided. Here, the gear 227 includes plural inner teeth (not shown) on an inner circumferential surface 227A and plural outer teeth (not shown) on an outer circumferential surface 227B. Moreover, in the exemplary embodiment, a driving gear G1 is provided to engage the outer teeth formed on the outer circumferential surface 227B, to thereby rotate the gear 227. Further, there is provided a driving motor M11 that rotates the driving gear G1.

Moreover, though the description was omitted above, in the exemplary embodiment, on the backside of the rotating plate 226 (refer to FIG. 11C), one end portion 222A of the holding member 222 is projected as shown in FIG. 13A. Moreover, in the exemplary embodiment, teeth (not shown) formed on an outer circumferential surface of the one end portion 222A and the inner teeth formed on the inner circumferential surface of the gear 227 engage with each other. Here, in the exemplary embodiment, the driving gear G1 and the gear 227 are rotationally driven by the driving motor M11, and by the gear 227 that is rotationally driven, the one end portion 222A of the holding member 222 is rotated. Accordingly, in the exemplary embodiment, each of the holding members 222 is rotated, and along with this, the can bodies 10 are also rotated.

Moreover, in the exemplary embodiment, as shown in FIG. 13B, similar to the gear 227, a ring-shaped gear 231 is provided. Here, the gear 231 includes plural outer teeth (not shown) on an outer circumferential surface 231A. Moreover, in the exemplary embodiment, a driving gear G2 is provided to engage the outer teeth formed on the outer circumferential surface 231A to rotate the gear 231. Further, there is provided a driving motor M12 that rotates the driving gear G2.

Here, in the exemplary embodiment, the above-described rotating plate 226 (refer to FIG. 11C) and the gear 227 (refer to FIG. 13A) are supported by the gear 231. Here, when the driving gear G2 is rotated by the driving motor M12, the gear 231 is rotated. Then, when the gear 231 is rotated, the rotating plate 226 is rotated, and thereby the holding members 222 supported by the rotating plate 226 are moved. Additionally remarking, the state of the rotating plate 226 with respect to the ink ejection device 223 is changed, and accordingly, positions of the holding members 222 become different. This causes the can body 10 facing a single ink ejection device 223 is switched to another can body 10.

Additionally remarking, in the exemplary embodiment, by the movement of the holding members 222, the can body 10 that has faced a single ink ejection device 223 comes to face another ink ejection device 223 adjacent to the single ink ejection device 223. It should be noted that, in the exemplary embodiment, the can body 10 facing the ink ejection device 223 is switched by rotating the rotating plate 226; however, it is possible to switch the can body 10 facing the ink ejection device 223 by rotating the support table 221. Additionally remarking, in the exemplary embodiment, the state of the rotating plate 226 with respect to the ink ejection device 223 is changed by rotating the rotating plate 226; however, it is also possible to change the state of the rotating plate 226 with respect to the ink ejection device 223 by rotating the support table 221. It should be noted that both of the rotating plate 226 and the support table 221 may be rotated.

Here, a process performed by the can body moving mechanism 200 will be further described.

In the exemplary embodiment, prior to the process by the can body moving mechanism 200, first, the information about the diameter of the can body 10 is obtained by the controller 900. Moreover, image information about the image to be formed on the can body 10 is obtained from an external terminal such as a PC (personal computer). Thereafter, based on the above-described information about the diameter that has been obtained, the forward and backward mechanism 250 (refer to FIG. 11B) is driven, and accordingly, the ink ejection device 223 is arranged at the position corresponding to the diameter of the can body 10.

Thereafter, the can bodies 10 are sequentially supplied from the can body conveying mechanism 100 to the can body moving mechanism 200, and the can bodies 10 are held by the holding members 222. Moreover, the rotation of the can body 10 in the circumferential direction is performed by the rotation of the driving motor M11 (refer to FIG. 13A), and the ink is ejected from each of the ink ejection devices 223. Additionally remarking, in the exemplary embodiment, the ink is ejected from the plural ink ejection devices 223 at the same time. Moreover, in the exemplary embodiment, the driving motor M12 (refer to FIG. 13B) is driven every one rotation of the rotating member 210 (refer to FIG. 10), to thereby rotate the gear 231. It should be noted that, in the exemplary embodiment, the holding members 222 are provided at intervals of 30° in the circumferential direction of the rotating plate 226 (refer to FIG. 11A), and accordingly, in the exemplary embodiment, the gear 231 is rotated 30° every one rotation of the rotating member 210.

As a result, in the exemplary embodiment, the can body 10 on which an image has been formed by the ink ejection device 223 that ejects an ink of one color comes to face an ink ejection device 223 adjacent to the ink ejection device 223. This causes the ink of a different color to be ejected onto the can body 10. Then, in the exemplary embodiment, when the rotating member 210 makes seven rotations after ink ejection of the first color onto the can body 10 was started, the ink ejection of seven colors onto the can body 10 is completed. Thereafter, the can body 10 is discharged from the can body moving mechanism 200.

It should be noted that, in the exemplary embodiment, when the ink of the first color is ejected from the ink ejection device 223 (the ink ejection device 223 positioned at the most upstream side in the rotating direction of the rotating plate 226) (hereinafter, referred to as "first ink ejection device 223" in some cases), an output from the not-shown rotary encoder is grasped by the controller 900 (refer to FIG. 9), and thereby the rotation angle of the can body 10 when the ink is ejected by the first ink ejection device 223 is grasped. It should be noted that, in this specification, the grasped rotation angle is hereinafter referred to as "reference angle".

Thereafter, image data is read from a page memory (not shown) and the image data is supplied by the first ink ejection device 223. Then, by the first ink ejection device 223, an image by the ink of the first color is formed on the outer circumferential surface of the can body 10.

Thereafter, the rotation of the rotating plate 226 is carried out again, and the can body 10 on which the image has been formed by the first ink ejection device 223 reaches the ink ejection device 223 that ejects the ink of a second color (the ink ejection 223 positioned at the second most upstream side in the rotating direction of the rotating plate 226) (hereinafter, referred to as "second ink ejection device 223" in some cases).

Then, the ink is ejected from the second ink ejection device 223 onto the outer circumferential surface of the can body 10. This causes the image by the ink of the second color to be formed on the outer circumferential surface of the can body 10. Here, in the exemplary embodiment, when the ink of the first color is ejected from the ink ejection device 223, also, the output from the rotary encoder is grasped, and thereby the rotation angle of the can body 10 is grasped. Then, the controller 900 subtracts the above-described reference angle from the grasped rotation angle, to thereby obtain an angle difference. Thereafter, the controller 900 starts reading, of the image data stored in a not-shown page memory, from the image data corresponding to the angle difference, and sequentially supplies the read image data to the second ink ejection device 223.

Then, the second ink ejection device 223 forms the image based on the image data corresponding to the angle difference onto the can body 10 first, and thereafter, sequentially forms the images onto the can bodies 10 based on image data supplied subsequent to this image data.

Here, for example, when the image formation by the second ink ejection device 223 is started, it is also possible to carry out image formation onto the can body 10 after setting the rotation angle of the can body 10 at the above-described reference angle and arranging the can body 10 at an origin position. By the way, in this case, it requires time to arrange the can body 10 at the origin position, and therefore the number of can bodies on which image is formed per unit time is apt to be reduced. As in the exemplary embodiment, in the case where reading is started from the image data corresponding to the angle difference, it becomes possible to increase the number of can bodies 10 on which image is formed per unit time.

It should be noted that, here, description was given of the process in which image formation was carried out by the first ink ejection device 223 and the second ink ejection device 223; however, when image formation is performed by the ink ejection devices 223 positioned on a further downstream side of the second ink ejection device 223, similar to the above description, the rotation angle of the can body 10 is grasped, and then the above-described angle difference is obtained. Then, first, an image based on image data corresponding to the angle difference is formed on the can body 10, and subsequently, an image, which is based on image data read from the page memory subsequent to this image data, is formed on the can body 10.

It should be noted that, when a single can body 10 is discharged from the can body moving mechanism 200, as indicated by white circles of the sign 1B in FIG. 9, there occur the holding members 222 that do not hold the can body 10. Here, in the exemplary embodiment, in this case, the rotating plate 226 is rotated 30° by the driving motor M12 (refer to FIG. 13B). Accordingly, in a supply portion of the can body 10 (a supply portion of the can body 10 by the can body conveying mechanism 100), a new can body 10 comes to be supplied to the holding member 222 that does not hold the can body 10.

Here, in the exemplary embodiment, the can bodies 10 are sequentially supplied to the plural image forming units 220 having been provided, and image formation on the can body 10 is performed, not by a single image forming unit 220, but by the plural image forming units 220. Additionally remarking, in the exemplary embodiment, image formation on the plural can bodies 10 is performed simultaneously (in parallel) in the middle of sequentially conveying the plural can bodies 10. Therefore, in the printer 1 in the exemplary embodiment, it is possible to increase the number of can bodies 10 capable of being processed per unit time compared to a case where, for example, process for the can body 10 is performed by a single image forming unit 220.

Here, currently, image formation on the can body 10 is generally performed by a printing method called as offset printing. In this case, ink is once placed on a plate, then the ink is transferred from the plate to a rubber-like sheet, which is referred to as a blanket, and further, the ink having been transferred to the blanket is transferred onto the can body 10. On the other hand, recently, printing on an object becomes increasingly performed by digital printing, which is represented by ink-jet printing.

In the digital printing, compared to the offset printing, since a plate referred to as a press plate is not used, making of the press plate, registration of the press plate and a printer, cleaning of the press plate in the course of printing and the like are not required. This simplifies an operation referred to as "setups" in a case of changing a lot, and accordingly, it becomes possible to flexibly deal with multi-product small-lot production. Moreover, in the production process of the can body 10, defects frequently occur in the process related to printing; however, it becomes possible to decrease the defects that occur in the process related to printing by switching to the digital printing.

In this manner, an advantage is brought about by switching to the digital printing; however, on the other hand, demerits are also caused. For example, in the printing by use of ink jet, which is widely used in the digital printing, the printing speed is low, and the printing speed of this printing method is, for example, 1/10 of the printing speed in the offset printing. Accordingly, switching to the ink-jet printing is simply carried out, deterioration of productivity is caused.

Here, in the configuration of the exemplary embodiment, though the printing method by use of ink jet is employed, image forming processes on the plural can bodies 10 are performed simultaneously as described above. Consequently, in the configuration of the exemplary embodiment, it becomes possible to suppress deterioration of productivity that possibly occurs in the case where the printing method by use of ink jet is employed.

Figure 14:
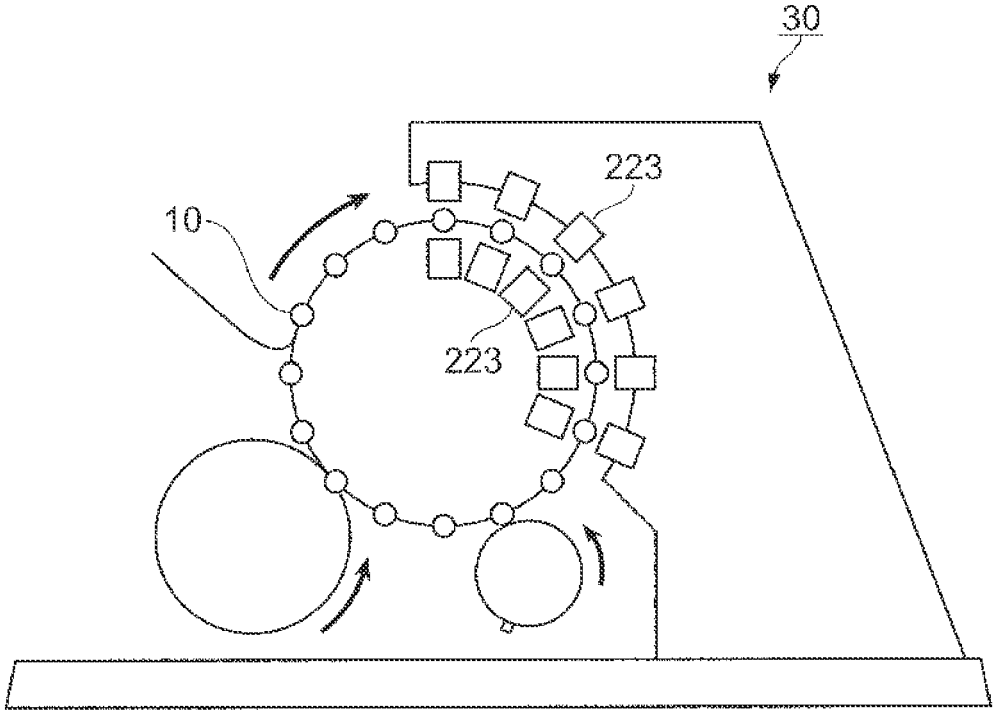
FIG. 14 is a diagram showing a comparative example of the printer.

Here, FIG. 14 is a diagram showing a comparative example of the printer.

In a printer 30 shown in FIG. 14, similar to the printer 1 in the exemplary embodiment, the can body 10 is moved in the state in which the can body 10 is held by the holding member (not shown in the figure). Moreover, rotation of the holding member is carried out and the can body 10 rotates.

By the way, in the printer 30, similar to the exemplary embodiment, an image formed by the ink of six colors is formed on the can body 10 by repetition of intermittent feeding of the can bodies 10 and image formation. Incidentally, in the printer 30, configuration is such that the ink of one color is ejected onto only a single can body 10. On the other hand, in the exemplary embodiment, as a result of providing plural sets of the plural ink ejection devices 223, the ink of one color is ejected not onto a single can body 10, but onto plural can bodies 10. Accordingly, in the configuration of the exemplary embodiment, productivity is increased compared to the configuration shown in FIG. 14.

Next, description will be given of the first conveying device 300, the heating device 400, the coating device 500, the second conveying device 600 and the third conveying device 700, which are shown in FIG. 9.

Similar to the first exemplary embodiment, the first conveying device 300 includes the plural suction members 310 as shown in FIG. 9. Here, these plural suction members 310 carry out circulating movement along a predetermined route (a route forming an arc). Additionally remarking, movement in the counterclockwise direction in the figure is performed. Moreover, these plural suction members 310 are, similar to the can body conveying mechanism 100 shown in FIG. 12B, arranged on the frontward side of the can body moving mechanism 200 in the depth direction of the printer 1.

Here, in the first conveying device 300, first, in the can body 10, which is held by evacuation through the air vent formed in the holding member 222 (refer to FIGS. 11A to 11C) provided in the can body moving mechanism 200, a vacuum is broken by replacing the vacuum in the air vent with a compressed air, and a pressure is applied to a bottom portion of the can body by the compressed air, to thereby move the can body 10 in the frontward direction in the space of FIG. 9 to the suction member 310. The suction member 310 holds the can body 10 that has moved by evacuation through an air vent formed on the suction member 310. Then, the suction member 310, without any change, is moved along the above-described predetermined route. This causes the can body 10 on which an image is formed by the can body moving mechanism 200 to be conveyed to the heating device 400.

The heating device 400 includes a member that is similar to the holding member 222 provided in the can body moving mechanism 200 (hereinafter, this member is also referred to as "holding member 222"). Here, the plural holding members 222 are provided. The holding member 222 performs circulating movement along a predetermined route (a route that forms an arc). Additionally remarking, the holding member 222 moves in the clockwise direction in the figure. Moreover, each of the holding members 222 rotates.

Further, the heating device 400 in the exemplary embodiment is arranged on a deeper side than the first conveying device 300 in the depth direction of the printer 1. Here, passing of the can body 10 from the first conveying device 300 to the heating device 400 is carried out as follows. First, in the suction member 310 that holds the can body 10 by evacuation, a vacuum is broken by replacing the vacuum in an air vent formed in the suction member 310 with a compressed air, and a pressure is applied to the bottom portion of the can body 10 by the compressed air, to thereby move the can body 10 to the holding member 222 in the heating device 400. On the other hand, in the holding member 222, evacuation is started through an air vent formed in the holding member 222. This causes the holding member 222 to be inserted into the can body 10 and held by evacuation.

It should be noted that, similar to the first exemplary embodiment, with respect to a moving trail of the suction member 310, the suction member 310 has a function of moving the position from the center. For example, in the case where the can body 10 is received from the holding member 222 on the image forming unit 220, if the above-described moving function is not provided, there are only two contact points between the holding member 222 and the suction member 310, and the positions of the holding member 222 and the section member 310 momentary coincide with each other twice; therefore, it becomes difficult to pass the can body 10 (refer to FIG. 9). In contrast, in the case where the moving function that causes the trail of the suction member 310 to coincide with the trail of the holding member 222 is provided, the positions of the holding member 222 and the suction member 310 coincide with each other for a certain period of time, and accordingly, the can body 10 is surely passed.

In the same manner, as indicated by a sign 1A in FIG. 9, the suction member 310 of the first conveying device 300 temporarily deviates from the moving route formed like an arc and formed to curve outwardly at the point where the first conveying device 300 and the heating device 400 overlap one another, to thereby move along the moving route of the holding member 222. Further, at the point indicated by the sign 1A, the suction member 310 and the holding member 222 move in the state of overlapping one another. Then, in the exemplary embodiment, the can body 10 is passed from the suction member 310 to the holding member 222 when the overlap occurs between the suction member 310 and the holding member 222 in this manner.

It should be noted that the above-described movement of the suction member 310 at the point indicated by the sign 1A is carried out by use of a cam or the like. In addition, though the description was omitted above, with respect to the contact portion between the roll-like member 510 in the coating device 500 and the holding member 222, as shown in FIG. 9, the holding member 222 moves on an outer circumference of the roll-like member 510. It should be noted that, in a portion where the heating device 400 and the second conveying device 600 overlap one another, the holding member 222 provided in the second conveying device 600 temporarily deviates from a moving route formed to curve outwardly and formed like an arc. This causes the holding member 222 provided in the heating device 400 to overlap a suction member 610 provided in the second conveying device 600 (having a configuration and function same as those of the suction member 310 in the first conveying member 300). Moreover, a pin 720 provided in the third conveying device 700 (a rod-like member attached to a chain 710, on which the can body 10 is hooked to be conveyed) also deviates from a moving route formed to curve outwardly and formed like an arc. This causes the pin 720 to overlap the suction member 610.

Here, the heating device 400 will be described in detail.

The heating device 400 includes, similar to the first exemplary embodiment, a heating portion 410 that is provided along the moving route of the can body 10 and heats the can body 10. Here, the heating portion 410 includes an infrared ray lamp or the like (not shown), and carries out heating of the can body 10 by use of the infrared ray lamp or the like. By the heating, the ink applied to the outer circumferential surface of the can body 10 is cured. It should be noted that, in the exemplary embodiment, the holding member 222 provided in the heating device 400 rotates, and thereby unevenness in heating on the can body 10 is hardly generated. Moreover, in the exemplary embodiment, since the heating portion 410 is provided on both sides of the moving route of the can body 10, it is possible to cure the ink in a shorter time compared to a case where the heating portion 410 is provided only on one side of the moving route.

Here, in the exemplary embodiment, the paint is applied to the outer circumferential surface of the can body 10 by the coating device 500; however, if the fluidity of the ink constituting the image on the can body 10 is high, there is a possibility that the image is deformed. Therefore, in the exemplary embodiment, the can body 10 is heated prior to applying the paint by the coating device 500, to thereby cure the ink on the can body 10. It should be noted that, in the exemplary embodiment, the ink is cured by heating; however, in a case where a UV (ultraviolet) cure ink is used, the ink is cured by irradiation by a UV lamp.

Here, in the exemplary embodiment, similar to the first exemplary embodiment, the coating device 500 is provided on a downstream side of the heating portion 410. The coating device 500 coats the outer circumferential surface of the can body 10 with a predetermined paint. This forms a protection layer on the image formed on the outer circumferential surface of the can body 10. It should be noted that the coating device 500 includes the roll-like member 510, and performs coating the can body 10 with the paint by bringing the roll-like member 510 into contact with the outer circumferential surface of the can body 10.

The can body 10 having been heated by the heating device 400 and coated with the paint by the coating device 500 is further conveyed by the second conveying device 600. The second conveying device 600 is configured similar to the first conveying device 300, and provided with the plural suction members 610. Here, the plural suction members 610 carry out circulating movement along a predetermined route and in the counterclockwise direction.

Moreover, the second conveying device 600 is arranged on the frontward side of the heating device 400 in the depth direction of the printer 1. Here, similar to the first conveying device 300, the second conveying device 600 sucks the can body 10 by facing the suction member 610 toward the bottom portion of the can body 10 held by the holding member 222 of the heating device 400. This causes the can body 10 to be conveyed to the third conveying device 700.

The third conveying device 700 is arranged on the deeper side of the second conveying device 600 in the depth direction of the printer 1. Here, the third conveying device 700 is configured with the chain 710 that carries out orbital movement in the clockwise direction and the plural pins 720 attached to the chain 710. Passing of the can body 10 from the second conveying device 600 to the third conveying device 700 is performed by inserting the pin 720 into the can body 10. Here, in the exemplary embodiment, as described above, the can body 10 is conveyed to a not-shown baking device (process) by the third conveying device 700.

Figure 15:
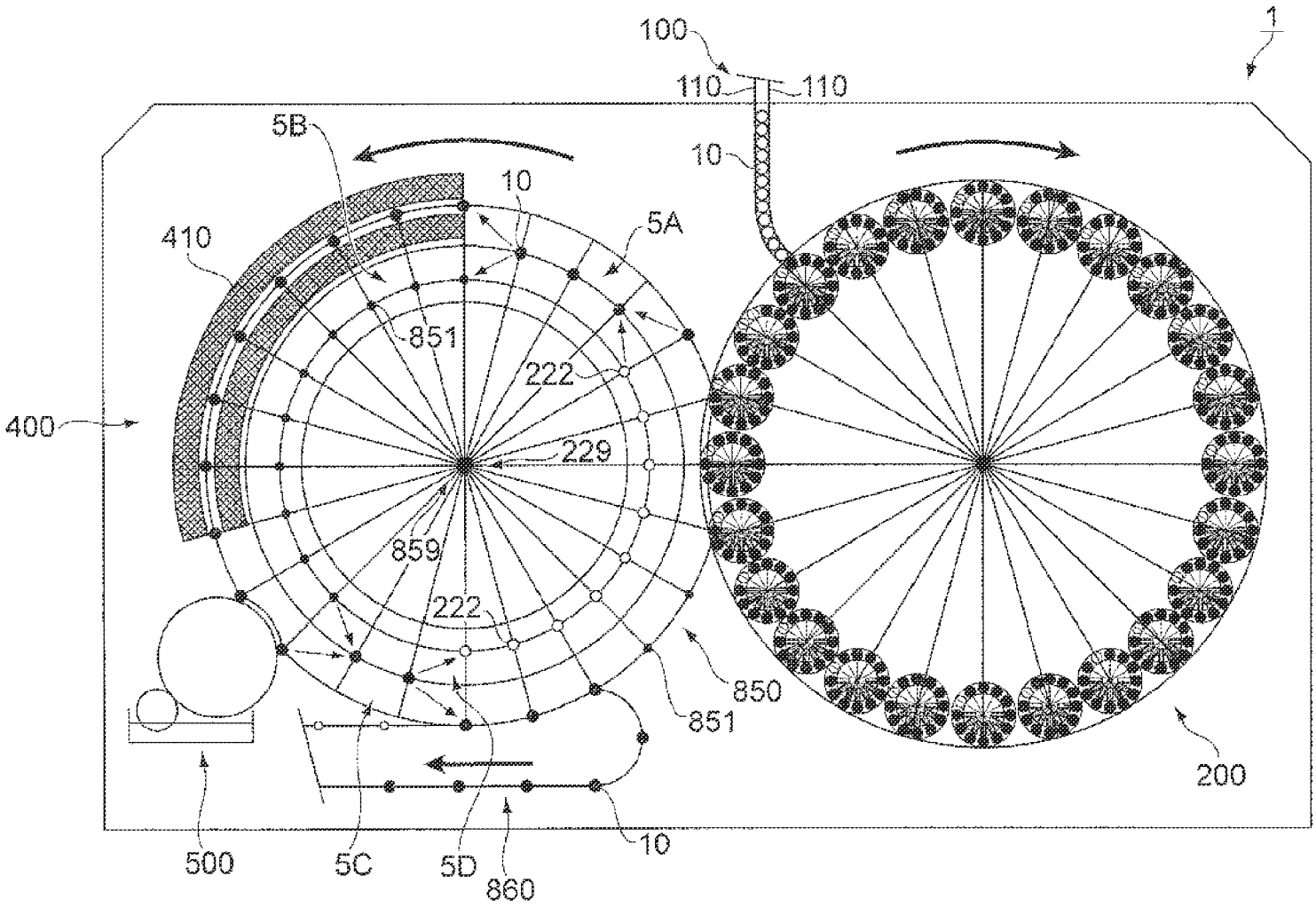
FIG. 15 is a diagram showing another mode of the printer.

FIG. 15 is a diagram showing another mode of the printer 1.

In the printer 1 shown in FIG. 15, similar to the above description, there are provided the can body conveying mechanism 100 that conveys the can body 10 downward and the can body moving mechanism 200 that moves the can body 10 while performing image formation on the outer circumferential surface of the can body 10 having been conveyed by the can body conveying mechanism 100. Moreover, in the exemplary embodiment, the heating device 400 is provided in immediate proximity on the downstream side of the can body moving mechanism 200 in the conveying direction of the can body 10.

Further, in the exemplary embodiment, similar to the first exemplary embodiment, the heating device 400 is provided to overlap suction members 851 of a first conveying device 850 in the depth direction of the printer 1. Additionally remarking, the heating device 400 and the first conveying device 850 are provided so that the heating device 400 and the first conveying device 850 overlap one another in a case where the printer 1 is viewed from the frontward side. Moreover, the suction members 851 of the first conveying device 850 are at the same positions as the holding members 222 of the can body moving mechanism 200 with respect to the depth direction. Further, in the depth direction of the printer 1, a second conveying device 860 configured similar to the third conveying device 700 (refer to FIG. 9) is provided on the deeper side of the first conveying device 850.

Here, similar to the first exemplary embodiment, the first conveying device 850 includes the plural suction members 851 that carry out circulating movement along the route formed like an arc. Then, in the exemplary embodiment, similar to the above description, the suction member 851 faces the can body 10 held by the holding member 222 of the can body moving mechanism 200, and the can body 10 is held by the suction member 851. Additionally remarking, the suction member 851 receives the can body 10 having been conveyed by the holding member 222.

Thereafter, the can body 10 is further conveyed by the suction member 851, which is an example of a conveying member. Thereafter, at the point indicated by the sign 5A in FIG. 15, the can body 10 held by the suction member 851 is received by the holding member 222 (the holding member 222 of the heating device 400) that is positioned on the deeper side and carries out circulating movement along the route formed like an arc, and is held by the holding member 222, which is an example of a receiving member.

Thereafter, the can body 10 is further conveyed by the holding member 222, and similar to the above description, passes through the heating device 400 and the coating device 500. This causes the ink formed on the outer circumferential surface of the can body 10 to be cured, to thereby form a protection layer on the ink. It should be noted that, as indicated by the sign 5B in the figure, the suction member 851 after passing the can body 10 to the holding member 222 of the heating device 400 passes through the inner side of the heating portion 410.

After the protection layer is formed on the can body 10, at the point indicated by the sign 5C in the figure, the can body 10 moves inwardly due to inward movement of the holding member 222 that holds the can body 10. On the other hand, at the point indicated by the sign 5C, the suction member 851 moves outwardly. Then, at the point indicated by the sign 5C, the holding member 222 and the suction member 851 come to overlap one another. Then, at this point, the can body 10 is passed from the holding member 222 positioned on the deeper side to the suction member 851 positioned on the frontward side. Thereafter, in the exemplary embodiment, the can body 10 is passed from the suction member 851 to the second conveying device 860, and the can body 10 is conveyed to the baking device.

Here, in the exemplary embodiment described with reference to FIG. 9, the first conveying device 300 was provided between the can body moving mechanism 200 and the heating device 400 and the second conveying device 600 was provided between the heating device 400 and the third conveying device 700; however, in this exemplary embodiment, the first conveying device 300 and the second conveying device 600 are omitted. Instead, the first conveying device 850 is provided. In the case of the configuration like this, it becomes possible to downsize the printer 1.

Moreover, in the exemplary embodiment, as described above, the heating device 400 and the first conveying device 850 are provided so that the heating device 400 and the first conveying device 850 overlap one another in the case where the printer 1 is viewed from the frontward side. To be described further, in the exemplary embodiment, a central shaft (rotational shaft) 859 around which the plural suction members 851 carry out the circulating movement and a central shaft (rotational shaft) 229 around which the plural holding members 222 carry out the circulating movement coincide with each other. It should be noted that, when the suction member 851 and the holding member 222 perform passing of the can body 10, the moving trail of the suction member 851 and the moving trail of the holding member 222 coincide with each other. Moreover, these suction members 851 and holding members 222 on the image forming unit 220 cause the moving trail to coincide with the holding members 222 on the image forming unit 220 by being provided with a function capable of moving in the axial direction by having a cam or the like. Moreover, with respect to the contact portion between the roll-like member 510 in the coating device 500 and the holding member 222, the holding member 222 moves on the outer circumference of the roll-like member 510. Then, in this case, it becomes possible to reduce the size in the width direction of the printer 1.

Figure 16:
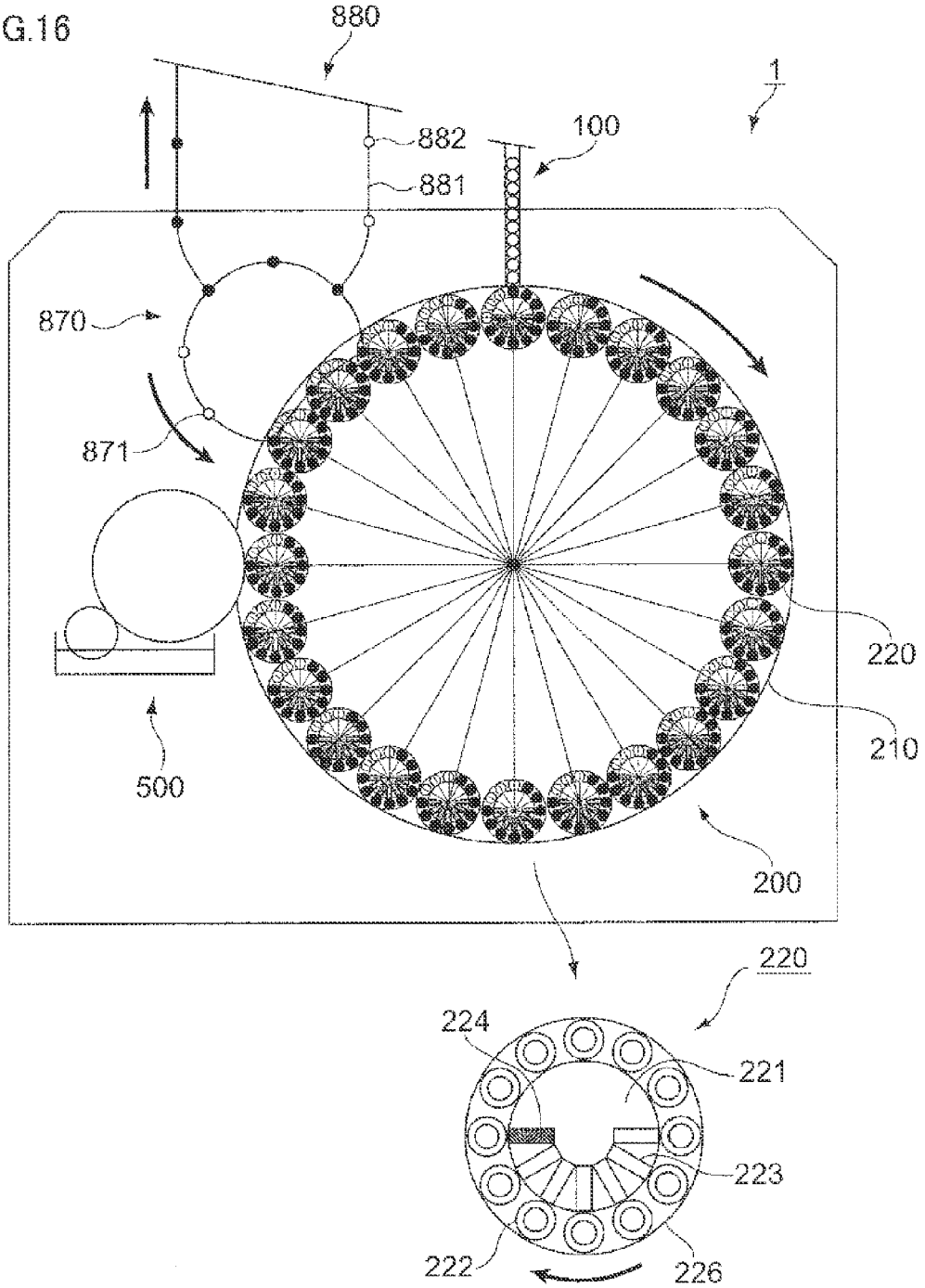
FIG. 16 is a diagram showing still another mode of the printer.

FIG. 16 is a diagram showing still another mode of the printer 1.

In the exemplary embodiments described above, configuration was such that the can body 10 was heated by the heating device 400 provided at a place different from the can body moving mechanism 200; however, in this exemplary embodiment, as shown in FIG. 16, a heating unit 224 for heating the can body 10 is incorporated into part of the image forming unit 220, to thereby heat the can body 10 by the heating unit 224. It should be noted that, in the above description, description was given of the case where the seven ink ejection devices 223 were provided; however, in the exemplary embodiment, one of the ink ejection devices 223 is removed, and instead thereof, the heating unit 224 is provided.

Here, the heating unit 224, as an example of a curing unit, is arranged on the downstream side of the ink ejection device 223 in the rotating direction of the rotating plate 226 (the clockwise direction in the figure) to cure the ink adhered to the can body 10 on the upstream side. In the case of the configuration of the exemplary embodiment, in comparison with the configuration shown in FIG. 9, since the ink is cured immediately after the ink is applied, foreign substances hardly enter into the ink.

Here, similar to the above description, the heating unit 224 includes a not-shown infrared ray lamp or the like, and heating of the can body 10 is carried out by use of the infrared ray lamp or the like. It should be noted that, when heating by the heating unit 224 is carried out, the can body 10 is rotated in the circumferential direction by the driving motor M11 (refer to FIG. 13A), and therefore unevenness in heating of the can body 10 is hardly generated. Here, in the exemplary embodiment, since the heating unit 224 is provided in the image forming unit 220, the heating device 400 shown in FIG. 9 or the like is omitted. It should be noted that, in the case where the ink of the UV (ultraviolet) cure type is used, a UV lamp is mounted instead of the heating unit 224.

Moreover, in the exemplary embodiment, as shown in FIG. 16, a first conveying device 870 including plural suction members 871 is arranged on the frontward side of the can body moving mechanism 200. Further, similar to the above description, a second conveying device 880 including a chain 881 and pins 882 is arranged on the deeper side of the first conveying device 870. Moreover, to prevent interference between the can bodies 10 hooked on the pins 882 and the can bodies 10 in the can body moving mechanism 200 in the depth direction, the chain 881 is placed to have a certain angle with the can body moving mechanism 200 for avoiding mutual interference, as necessary. Moreover, in the exemplary embodiment, the coating device 500 is provided adjacent to the can body moving mechanism 200, and coating of the can body 10 with a paint is performed in the course of holding the can body 10 by the image forming unit 220. Moreover, the image forming unit 220 is configured to be movable in the direction of the rotation center, and the image forming unit 220 is moved by cam or the like in response to the rotation of the rotating member 210 to cause the trail of the suction members 871 of the first conveying member 870 and the trail of the can body 10 to coincide with each other. Moreover, the can body 10 moves on the outer circumference of the roll-like member 510 in the coating device 500.

Here, also in the exemplary embodiment, similar to the above description, the plural can bodies 10 are held by the image forming unit 220 and the images are formed on the can bodies 10 by the ink ejection devices 223 arranged inside the can bodies 10. Moreover, the can body 10 is heated by the heating unit 224 provided in the image forming unit 220, and thereby the ink on the can body 10 is cured until the can body 10 is discharged from the can body moving mechanism 200. Moreover, in the exemplary embodiment, the can body 10 is coated with the paint by the coating device 500 until the can body 10 is discharged from the can body moving mechanism 200.

Thereafter, the can body 10 is held by the first conveying device 870. Specifically, similar to the above description, the can body 10 is sucked and held by the suction member 871. Thereafter, the pin 882 provided to the chain 881 of the second conveying device 880 is inserted into the can body 10, to thereby convey the can body 10 by the second conveying device 880. In the configuration in the exemplary embodiment, the heating device 400 shown in FIGS. 9 and 15 is omitted, and accordingly, further downsizing of the printer 1 is intended. Moreover, it becomes possible to omit the first conveying device 300 (refer to FIG. 9) that conveys the can bodies 10 from the can body moving mechanism 200 to the heating device 400, the first conveying device 850 (refer to FIG. 15) that conveys the can bodies 10 from the can body moving mechanism 200 to the heating device 400, or the like, and therefore the printer 1 can further be downsized.

Figure 17:
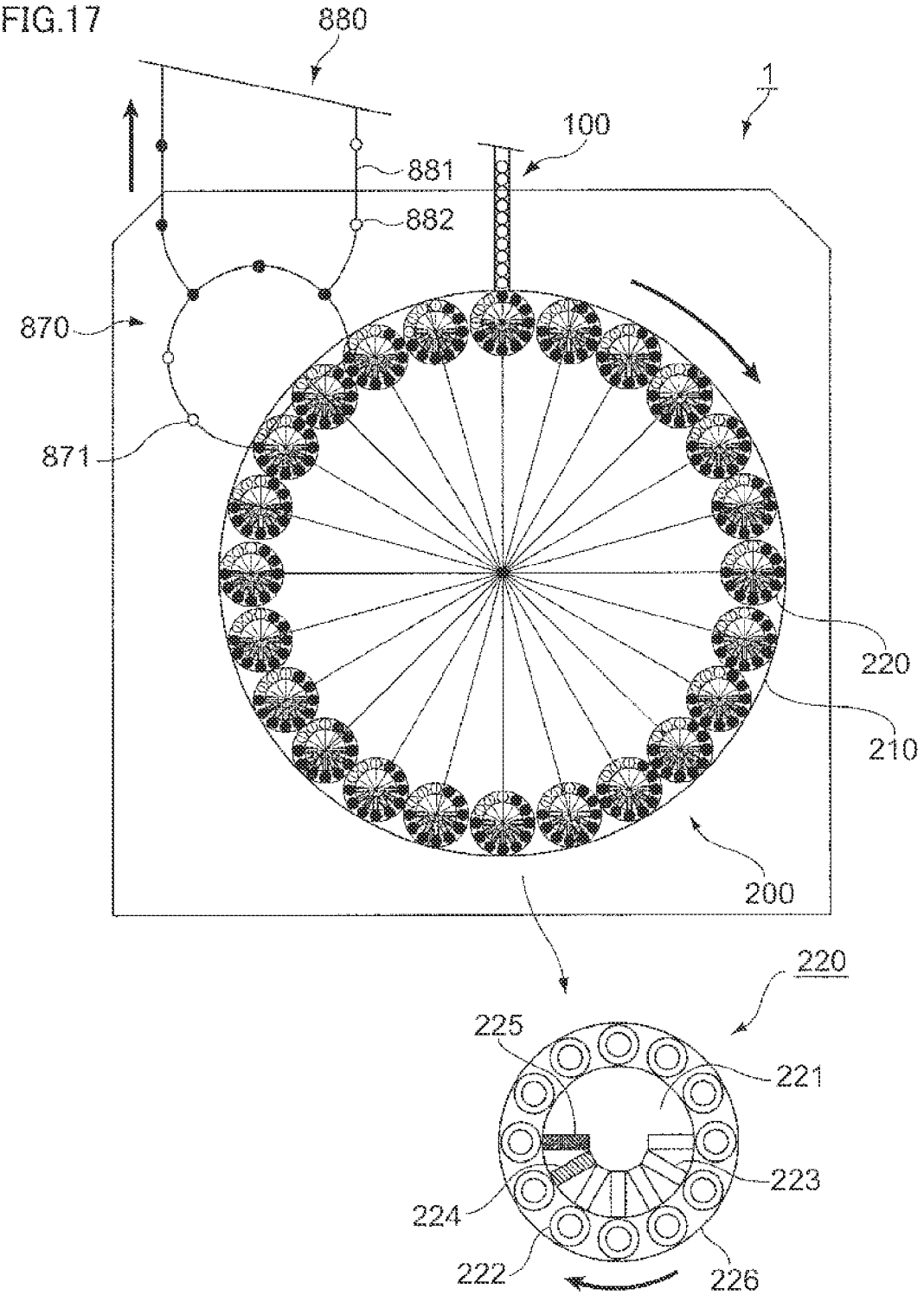
FIG. 17 is a diagram showing still another mode of the printer.

FIG. 17 is a diagram showing still another mode of the printer 1.

It should be noted that the basic configuration is same as that of the printer 1 shown in FIG. 16, and different points will be described here.

In the exemplary embodiment, as shown in FIG. 17, a coating unit 225 that coats the can body 10 with a paint is incorporated into part of the image forming unit 220, and thereby, the can body 10 is coated with the paint by the coating unit 225. It should be noted that, in the exemplary embodiment, since the two units, namely, the heating unit 224 and the coating unit 225, are incorporated, the configuration is such that the five ink ejection devices 223 are provided.

Here, the coating unit 225, as an example of the coating unit, is provided on a downstream side of the ink ejection devices 223, and moreover, on a downstream side of the heating unit 224 in the rotating direction of the rotating plate 226 (the clockwise direction in the figure), to thereby coat the outer circumferential surface of the can body 10, which has been subjected to image formation by the ink and heating process, with the paint and form the protection layer on the can body 10. Here, the coating unit 225 includes a not-shown roll-like member, and performs coating of the can body 10 with the paint by bringing the roll-like member into contact with the outer circumferential surface of the can body 10. It should be noted that the coating with the paint by the coating unit 225 can be performed by use of ink jet.

It should be noted that, in the exemplary embodiment described above, the description was given of the case where the image forming unit 220 (refer to FIG. 9) is rotated and the attitude of the image forming unit 220 is kept constant; however, similar to the first exemplary embodiment, it is possible to fix the image forming unit 220 to the rotating member 210.

Figure 18:
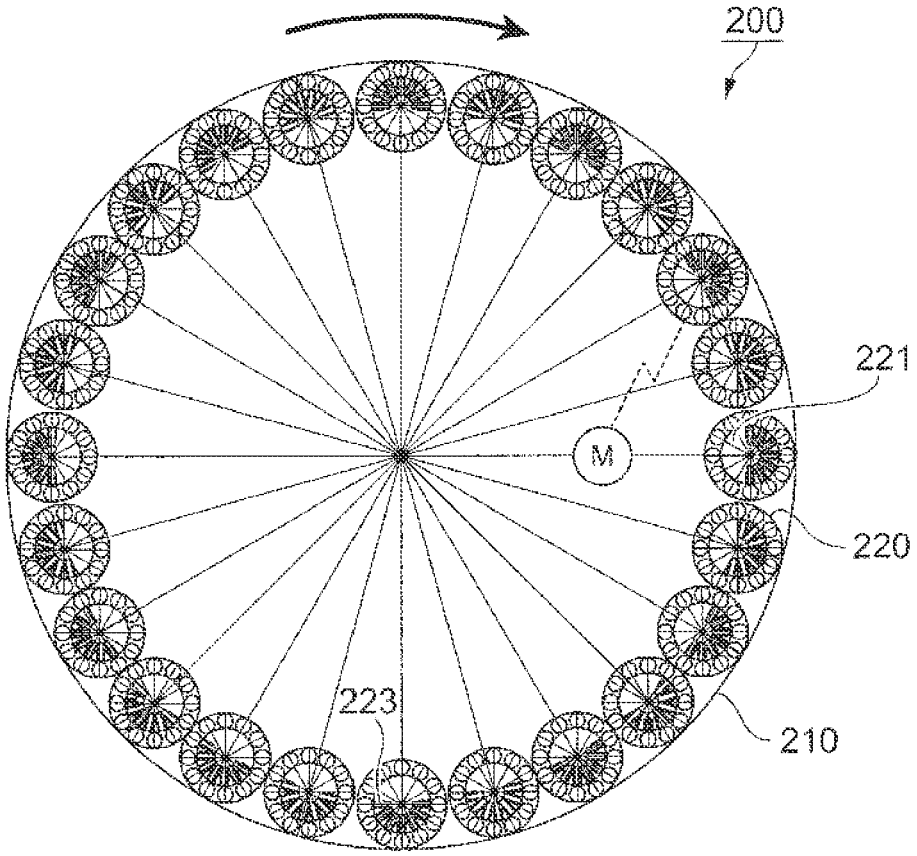
FIG. 18 is a diagram showing a can body moving mechanism in which image forming units are fixed onto a rotating member.

FIG. 18 is a diagram showing the can body moving mechanism 200 in which the image forming units 220 are fixed onto the rotating member 210. Instead of the can body moving mechanism 200 shown in FIGS. 9, 15, 16 and 17, the can body moving mechanism 200 shown in the figure can be used.

Here, in the exemplary embodiment shown in FIG. 18, each of the ink ejection devices 223 is attached with a certain angle to an axial line that connects the rotation center of the rotating member 210 and the center of each of the image forming units 220. Additionally remarking, in the exemplary embodiment, each of the image forming units 220 is arranged so that the attitude of the plural ink ejection devices 223, which are provided to each of the image forming units 220, with respect to the rotation center of the rotating member 210 is the same (constant) in each of the plural image forming units 220.

In the case of the configuration like this, with the rotation of the rotating member 210, the attitude of the ink ejection devices 223 provided in each of the image forming units 220 is changed. Additionally remarking, the attitude with respect to the rotation center of the rotating member 210 is kept constant, but the attitude with respect to other portions is changed. For example, in FIG. 18, the ink ejection devices 223 in the image forming unit 220 at the uppermost portion in the rotating member 210 are positioned on an upper portion side of the image forming unit 220; however, the ink ejection devices 223 in the image forming unit 220 at the lowermost portion in the rotating member 210 are positioned on a lower portion side of the image forming unit 220.

Here, in the exemplary embodiment, the ink is ejected from the ink ejection devices 223 while the rotating member 210 is rotating, and three forces, namely, centrifugal force, gravity and ejection force (ejection force by the ink ejection device 223) act on the ejected ink. Here, in a case where the rotating member 210 rotates at a constant angular speed, an operating direction when centrifugal force acts on the ink is not changed. However, with respect to gravity, since gravity always acts downwardly in the vertical direction, the direction of gravity acting upon the ink differs depending on the position of the ink ejection devices 223. Then, if the operating direction of gravity differs depending on the position of the ink ejection devices 223 in this manner, there is a possibility that an amount of ink reaching the can body 10 increases or decreases.

Therefore, as shown in FIG. 18, in the case where the configuration in which the attitude of the image forming unit 220 (the ink ejection devices 223) is not kept constant, it becomes desirable to correct (change) the ejection force in ejecting the ink from the ink ejection device 223 corresponding to the attitude (position) of the ink ejection devices 223 (the image forming unit 220).

Additionally remarking, in the configuration of the exemplary embodiment, the ink ejection force acts in the direction of the axial line that connects the ink ejection head HD (refer to FIG. 11B) of each of the ink ejection devices 223 and the center of the can body 10. Here, gravity acting on the ink ejected from each ink ejection head HD is divided into a component force in the above-described axial line direction and a component force in a direction orthogonal to the axial line direction, and it becomes desirable to correct (change) the ink ejection force by use of the component force in the axial line direction.

It should be noted that the direction of gravity acting on the ink ejected from each of the ink ejection devices 223 can be grasped based on the position of each of the ink ejection devices 223. Here, the position of each of the ink ejection devices 223 can be grasped, for example, by the rotating angle of the rotating member 210. Here, the rotating angle of the rotating member 210 can be grasped, for example, by attaching a sensor capable of detecting the rotating angle of, for example, a rotary encoder to the rotating member 210.

Moreover, during a period from the start of rotation of the rotating member 210 until the speed of the rotating member 210 becomes constant, centrifugal force acting on each of the image forming units 220 on the rotating member 210 gradually increases. In addition, when the rotating member 210 is stopped or decelerated, centrifugal force acting on each of the image forming units 220 on the rotating member 210 gradually decreases. In such a case, also, it is desirable to correct the ink ejection force. In this case, for example, the angular speed of the rotating member 210 and the angle of the rotating member 210 are detected by use of a rotary encoder or the like, and based on the detected angular speed, a distance from the rotation center to each ink ejection head HD and a mass of the ink, which are known data, centrifugal force acting on each of the ink ejection devices 223 (each ink ejection head HD) on each of the image forming units 220 is calculated. Then, by use of the calculated centrifugal force and the angle of each of the ink ejection devices 223 or the like, which is calculated from the detected angle of the rotating member 210, correction is made to the ink ejection force in ejecting the ink from the ink ejection head HD.

To further describe the can body moving mechanism 200 shown in FIG. 18, in the can body moving mechanism 200 shown in the figure, in the case where each of the plural image forming unit 220 is viewed from the rotation center of the rotating member 210, arrangement mode of the plural ink ejection devices 223 in each of the image forming unit 220 is in the same state. To be described further, in the exemplary embodiment, the state of the image forming unit 220 with respect to the rotating member 210 is not changed even though the rotating member 210 rotates.

Here, in the configuration shown in FIG. 9, since centrifugal force heading upward in the figure acts on the image forming unit 220 positioned at the upper portion of the rotating member 210, the ink becomes hard to be ejected. On the other hand, since centrifugal force heading downward in the figure acts on the image forming unit 220 positioned at the lower portion of the rotating member 210, the ink is readily ejected. Then, in this case, there is a possibility of causing fluctuations in the amount of ink ejection in response to the position of the image forming unit 220. On the other hand, in the configuration shown in FIG. 18, the direction of centrifugal force acting on each of the image forming units 220 is kept constant, and accordingly, fluctuations in the amount of ink ejection caused by the change of the direction in which centrifugal force acts are suppressed.

It should be noted that the change (correction) of the ink ejection force can be carried out for every image forming unit 220 (per image forming unit 220), or for every ink ejection device 223 (per single ink ejection device 223). For example, of the plural image forming units 220 provided in the rotating member 210 in FIG. 18, in the image forming unit 220 in the rightmost position in the figure, with respect to the ink ejected from the ink ejection device 223 positioned below the center of the support table 221, gravity acts in the same direction with the ink ejecting direction. On the other hand, with respect to the ink ejected from the ink ejection device 223 positioned above the center of the support table 221, gravity acts in a direction opposite to the ink ejecting direction. In such a case, for example, it is possible to decrease the ejection force in ejecting ink from the ink ejection device 223 positioned below the center of the support table 221, and increase the ejection force in ejecting ink from the ink ejection device 223 positioned above the center of the support table 221.

It should be noted that, in the can body moving mechanisms 200 shown in FIGS. 9, 15, 16 and 17 (the can body moving mechanism 200 in which the attitude of the image forming unit 220 is kept constant), it is possible to change the ejection force in ejecting ink. For example, in the can body moving mechanism 200 shown in FIG. 9, the acting direction of gravity acting on the ink becomes constant; however, in response to the position of the image forming unit 220, the acting direction of centrifugal force acting on the ink becomes different.

For example, in FIG. 9, of the plural image forming units 220, with respect to the image forming unit 220 is at the rightmost position in the figure, centrifugal force heading in the right direction in the figure comes to act on, while, with respect to the image forming unit 220 is at the leftmost position in the figure, centrifugal force heading in the left direction in the figure comes to act on. Then, in this case, there is a possibility of causing fluctuations in the amount of ink ejection in response to the position of the image forming unit 220.

Accordingly, in this case also, similar to the above description, it is possible to change the ejection force in ejecting the ink in response to the position of the image forming unit 220. To be specifically described, for example, when the image forming unit 220 is at the rightmost position in the figure, the ejection force in ejecting the ink from the ink ejection device 223 at the rightmost position in the image forming unit 220 is decreased, and the ejection force in ejecting the ink from the ink ejection device 223 at the leftmost position in the image forming unit 220 is increased. Moreover, when the image forming unit 220 has moved to the leftmost side in the figure with the rotation of the rotating member 210, the ejection force in ejecting the ink from the ink ejection device 223 at the rightmost position in the image forming unit 220 is increased, and the ejection force in ejecting the ink from the ink ejection device 223 at the leftmost position is decreased.

Third Exemplary Embodiment

Hereinafter, an exemplary embodiment according to the present invention will be further described with reference to attached drawings.

Figure 19:
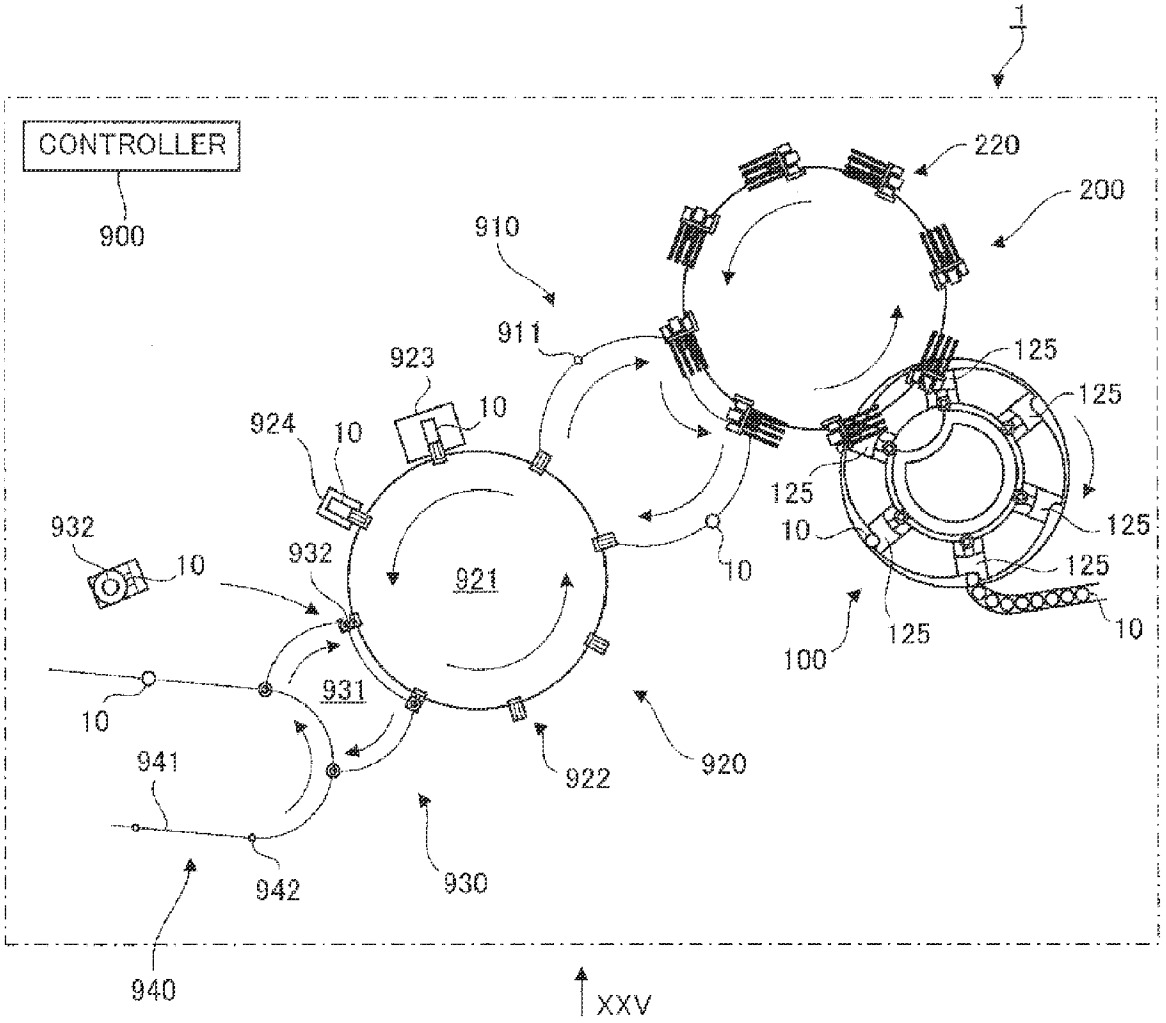
FIG. 19 is a diagram showing the printer that performs printing on a can body as viewed from above.

FIG. 19 is a diagram showing a printer 1 that performs printing on a can body as viewed from above.

The printer 1, as an example of an image forming device, is a printer that forms an image on the can body 10 based on digital image information. Here, the printer 1 is provided with: the can body conveying mechanism 100 that sequentially conveys the can bodies 10 having been manufactured in a not-shown can body manufacturing process; the can body moving mechanism 200 that holds the can body 10, which has been conveyed by the can body conveying mechanism 100, and moves the can body 10 while forming an image on an outer circumferential surface of the can body 10; and a first conveying device 910 that conveys the can body 10 on which an image has been formed by the can body moving mechanism 200.

Moreover, the printer 1 is provided with: a second conveying device 920 that further conveys the can body 10, which has been conveyed by the first conveying device 910, to the downstream side; a third conveying device 930 that further conveys the can body 10, which has been conveyed by the second conveying device 920, to the downstream side; and a fourth conveying device 940 that further conveys the can body 10, which has been conveyed by the third conveying device 930, to the downstream side. Moreover, the printer 1 is provided with the controller 900 that performs control of each device and each mechanism provided in the printer 1. It should be noted that, on the downstream side of the fourth conveying device 940 in a conveying direction of the can body 10, there is provided a baking device (not shown) that bakes the image formed on the can body 10 and the paint applied to the can body 10 onto the can body 10.

Figure 20:
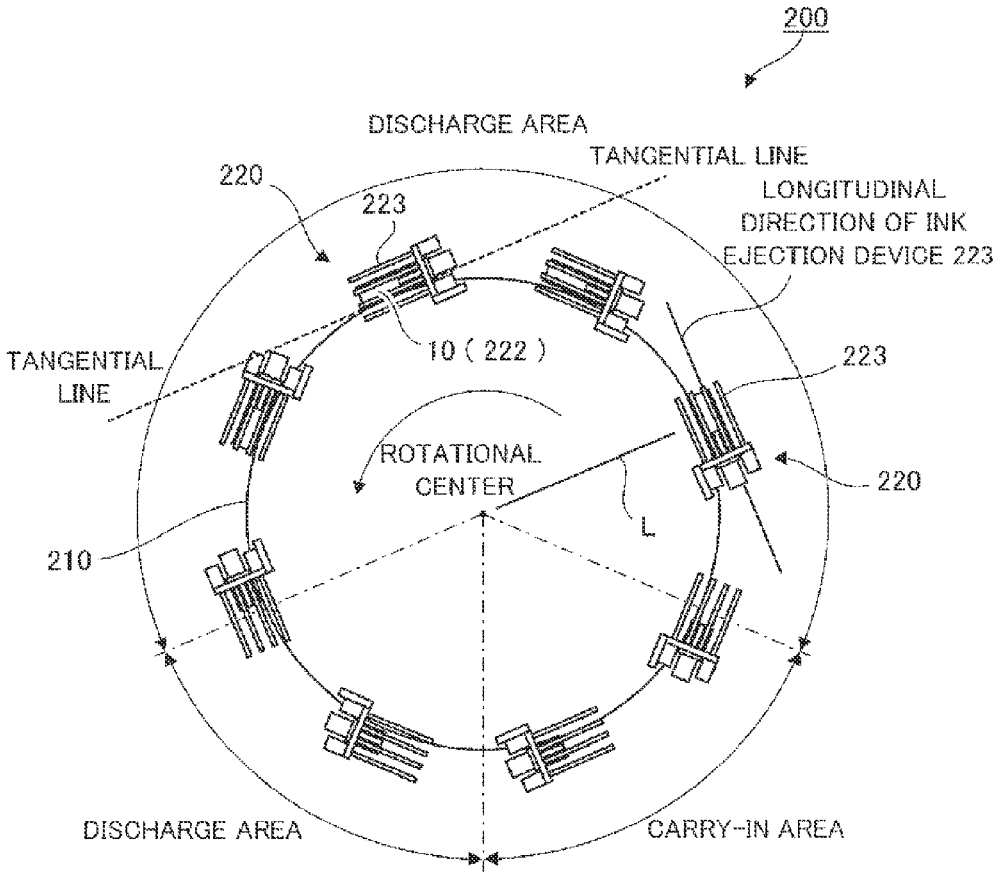
FIG. 20 is a diagram showing the can body moving mechanism as viewed from above.

FIG. 20 is a diagram showing the can body moving mechanism 200 as viewed from above.

Similar to the first exemplary embodiment, the can body moving mechanism 200, as an example of the image forming mechanism, is provided with a rotating member 210 that is formed in a disc shape and rotated by a not-shown motor in a counterclockwise direction in the figure. Moreover, the can body moving mechanism 200 is provided with the plural image forming units 220 that are attached to an outer circumferential edge of the rotating member 210 to form an image on an outer circumferential surface of the can body 10 having been conveyed by the can body conveying mechanism 100. Here, each of the image forming units 220 moves with the can body 10 having been conveyed by the can body conveying mechanism 100 while holding the can body 10, and performs image formation onto the can body 10 in the middle of moving. Moreover, each of the image forming units 220 carries out orbital movement around the rotational center of the rotating member 210, and performs image formation onto the can body 10 while moving along a ring-shaped moving route.

Here, the rotating member 210, which functions as part of a moving unit, is arranged so that a rotational axis thereof is along the vertical direction. Additionally remarking, the rotating member 210 is arranged so that a mount surface on which the image forming unit 220 is mounted is along the horizontal direction. It should be noted that the arrangement mode of the rotating member 210 is not limited to a mode like this, and for example, it is also possible to provide the rotating member 210 so that the rotational axis is along the horizontal direction. It should be noted that, as in the exemplary embodiment, in the case where the rotating member 210 is arranged so that the rotational axis is along the vertical direction, no change is caused in the acting direction of gravity that acts upon each of the image forming units 220.

Here, the image forming units 220 are provided at an outer circumferential edge of the rotating member 210 as described above. Moreover, a plural number (in the exemplary embodiment, 8) of image forming units 220 are provided, and are arranged in line along the outer circumferential edge of the rotating member 210. Further, each of the provided plural image forming units 220 is arranged with an equal space in the circumferential direction of the rotating member 210.

Here, when image formation onto the can body 10 by the image forming unit 220 is performed, first, the can body 10 is received in a carry-in area indicated in FIG. 20. Thereafter, the can body 10 is moved in the counterclockwise direction in the figure with the rotation of the rotating member 210, and in the middle of moving, image formation onto the outer circumferential surface of the can body 10 is performed. Additionally remarking, image formation onto the can body 10 is performed in a print area indicated in FIG. 20. Then, when image formation onto the can body 10 is finished, discharge of the can body 10 is performed in a discharge area indicated in FIG. 20. Thereafter, the can body 10 is conveyed to the further downstream side by the first conveying device 910 (refer to FIG. 19).

Here, with reference to FIGS. 21A to 21C (diagrams for illustrating the image forming units 220), the image forming units 220 will be described in detail. It should be noted that FIG. 21A is a diagram in a case where the image forming unit 220 is viewed from above, FIG. 21B is a diagram in a case where the image forming unit 220 is viewed from the direction of arrow XXIB in FIG. 21A, and FIG. 21C is a diagram in a case where the image forming unit 220 is viewed from the direction of arrow XXIC in FIG. 21B.

Figure 21A:
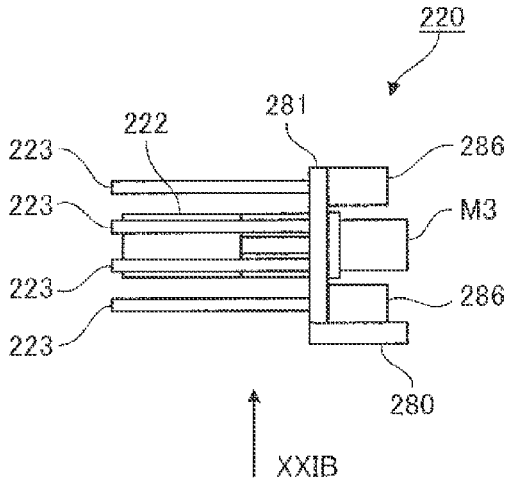
FIGS. 21A to 21C are diagrams for illustrating the image forming units.
Figure 21C:
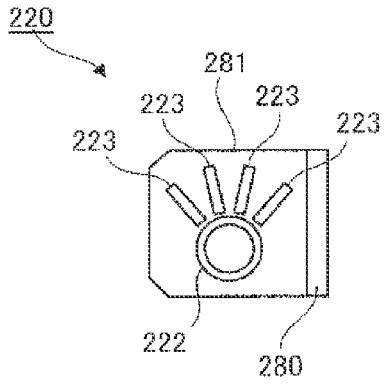
Figure 21B:
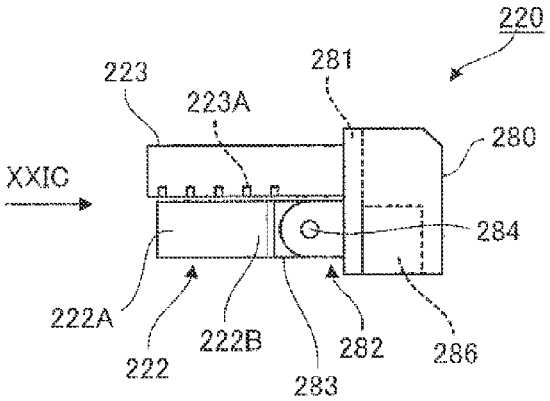

Here, as shown in FIGS. 21A to 21C, each of the image forming units 220 is provided with a first fixing plate 280 that is arranged along the vertical direction and a lower end portion thereof is fixed to the rotating member 210 (refer to FIG. 20). Moreover, as shown in FIGS. 21A and 21C, each of the image forming units 220 is provided with a second fixing plate 281 that is arranged along the vertical direction, arranged in relation of being orthogonal to the first fixing plate 280, and fixed to the first fixing plate 280.

Moreover, as shown in FIG. 21B, each of the image forming units 220 is provided with a support member 282 that is provided to project from the second fixing plate 281, arranged substantially horizontally, and supported by the second fixing plate 281. Further, there are provided the holding member (mandrel) 222 that is inserted into the can body 10 to hold the can body 10, and a connecting member 283 that connects the holding member 222 and the support member 282.

Here, the holding member 222, as an example of an inserting member, is formed cylindrically. Moreover, as shown in FIG. 21B, the holding member 222 has one end portion 222A and the other end portion 222B. It should be noted that, in the exemplary embodiment, when the holding member 222 is inserted into the can body 10, insertion of the holding member 222 into the can body 10 is carried out with the one end portion 222A of the holding member 222 at the head. Moreover, in the exemplary embodiment, a shaft 284 is provided to pierce both of the connecting member 283 and the support member 282, to thereby fix the connecting member 283 to the support member 282.

Here, in the exemplary embodiment, the connecting member 283 is configured to rotate around the shaft 284. Moreover, in the exemplary embodiment, though illustration is omitted, there is provided a rotating mechanism that causes the connecting member 283 to rotate around the shaft 284.

Moreover, in the image forming unit 220 of the exemplary embodiment, a servomotor M3 is provided as shown in FIG. 21A. Here, the servomotor M3 rotates the connecting member 283 around the shaft 284. It should be noted that the servomotor M3 is, as shown in FIG. 21A, supported by the second fixing plate 281. Moreover, the servomotor M3 is provided on a side opposite to the side where the holding member 222 with the second fixing plate 281 being interposed therebetween.

It should be noted that the above-described rotating mechanism can be configured with, for example, the servomotor M3 provided on the back surface of the second fixing plate 281, a worm (not shown) that is contained inside the support member 282 and driven by the servomotor M3, and a worm wheel (not shown) that is provided on the connecting member 283 side to engage the worm.

Figure 22A:
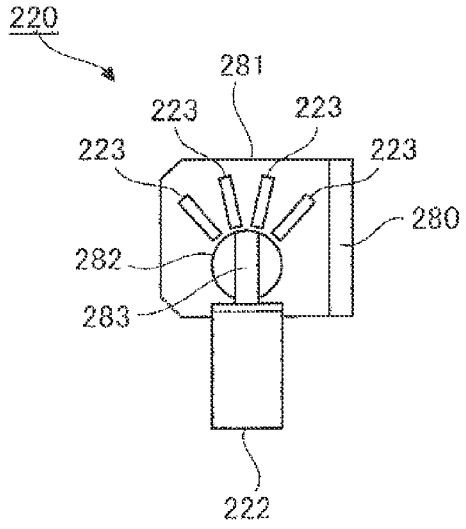
FIGS. 22A and 22B are diagrams showing a state after a connecting member is rotated by a rotating mechanism.
Figure 22B:
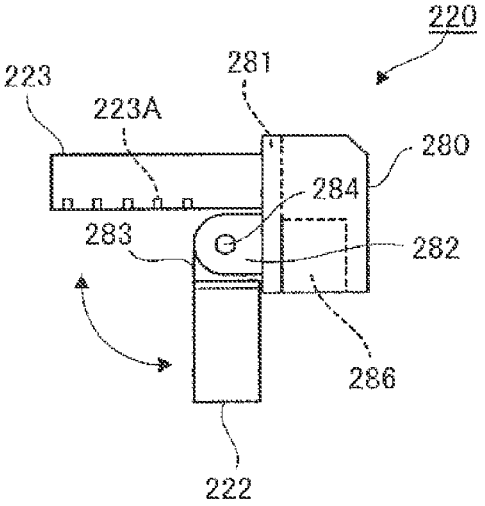

FIGS. 22A and 22B are diagrams showing a state after the connecting member 283 is rotated by the rotating mechanism. When the above-described servomotor M3 provided on the back surface of the second fixing plate 281 is rotated, rotation of the above-described worm contained inside the support member 282 is carried out. Then, by the rotation of the worm, the worm wheel provided on the connecting member 283 side comes to be rotated. Then, in this case, as shown in FIGS. 22A and 22B, the connecting member 283 comes to be rotated around the shaft 284. Then, when the rotation is carried out, as shown in the figures, the holding member 222 comes into a state of hanging, and in a state where the tip end of the holding member 222 faces downward.

Figure 25:
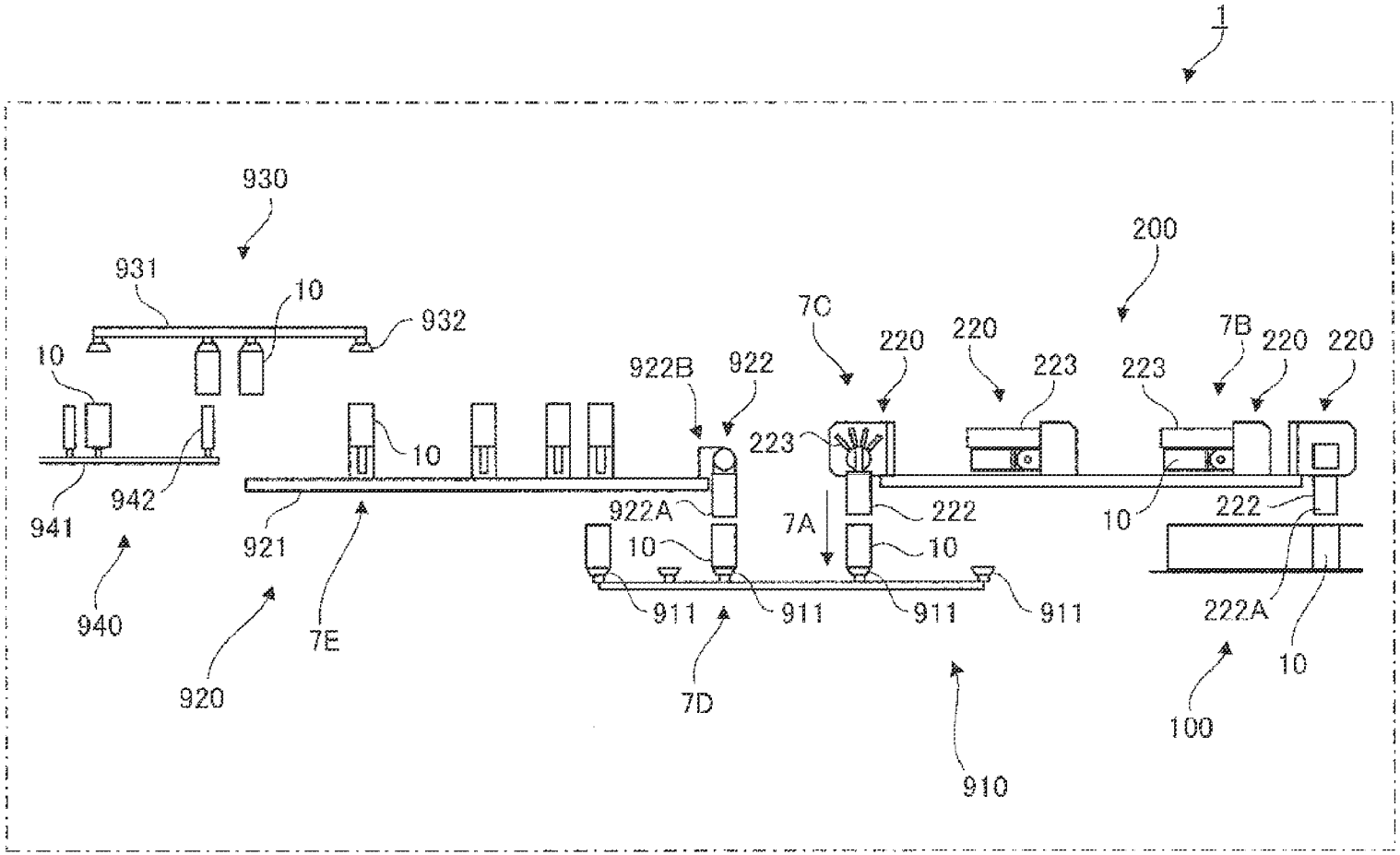
FIG. 25 is a diagram showing the printer as viewed from a direction of arrow XXV in FIG. 19.

It should be noted that, in the case of configuration in which the holding member 222 hangs like this, as shown in FIG. 25 (a diagram showing the printer 1 as viewed from the direction of arrow XXV in FIG. 19), it becomes possible to provide the can body conveying mechanism 100 and the first conveying device 910 below the can body moving mechanism 200. Additionally remarking, it becomes possible to overlap the can body moving mechanism 200 and the can body conveying mechanism 100, and moreover, it becomes possible to overlap the can body moving mechanism 200 and the first conveying device 910. Then, in this case, an occupied area of the printer 1 can be reduced.

It should be noted that, similarly, in the exemplary embodiment, a holding member 922A (refer to FIG. 25) provided in the second conveying device 920 is also movably provided so that a tip end thereof faces downward and movably provided so that a tip end thereof faces upward. This makes it possible to overlap the second conveying device 920 and the first conveying device 910, and moreover, to overlap the second conveying device 920 and the third conveying device 930. Then, in this case, similar to the above description, the occupied area of the printer 1 can be reduced.

It should be noted that, as shown in FIG. 25, the exemplary embodiment has the configuration in which the holding member 222 provided in the image forming unit 220 hangs downward only, the can body 10 is supplied from beneath the holding member 222, and the can body 10 moves downward of the holding member 222, and then the can body 10 is removed. Incidentally, not limited to such a configuration, it is also possible to have a configuration such that the tip end of the holding member 222 faces upward, the can body 10 is supplied from above the holding member 222, and the can body 10 is caused to move upward of the holding member 222, and then the can body 10 is removed. Moreover, for example, it is also possible to have a configuration in which, when the can body 10 is supplied to the holding member 222, the tip end of the holding member 222 is caused to face in one of the directions, upward or downward, and when the can body 10 is removed from the holding member 222, the tip end of the holding member 222 is caused to face in the direction opposite to the one direction.

With reference to FIGS. 21A to 21C again, the image forming unit 220 will be further described.

In the image forming unit 220 of the exemplary embodiment, a servomotor (not shown) is provided in the connecting member 283, and moreover, a rotational shaft of the above-described servomotor is connected to the holding member 222, and accordingly, the holding member 222 is rotated in the circumferential direction by the above-described servomotor.

Here, in the exemplary embodiment, the holding member 222 is inserted into the can body 10 via an opening formed at one end of the can body 10 that is formed cylindrically. It should be noted that the other end of the can body 10 is closed. Moreover, in the exemplary embodiment, the holding member 222 is formed to be hollow, and an air vent (not shown) is formed in the holding member 222. Then, in the exemplary embodiment, the holding member 222 is configured to hold the can body 10 by evacuating the inside of the can body 10 through the air vent. This regulates movement of the can body 10 relative to the holding member 222. It should be noted that, in the exemplary embodiment, the movement of the can body 10 is regulated by evacuation; however, the movement of the can body 10 can also be regulated by a mechanical configuration, such as pressing a not-shown member against the can body 10.

Moreover, in the image forming unit 222 of the exemplary embodiment, similar to the first exemplary embodiment, plural ink ejection devices (ink-jet heads) 223 that eject ink onto the outer circumferential surface of the can body 10 held by the holding member 222 are provided around the holding member 222. Additionally remarking, in the exemplary embodiment, plural ink ejection devices 223, which form an image on the can body 10 by the so-called ink-jet method, are provided around the holding member 222. It should be noted that, in the exemplary embodiment, 4 ink ejection devices 223 are provided in the single image forming unit 220, and thereby it is possible to use up to 4 colors of ink.

Here, each of the ink ejection devices 223 as an example of part of an image forming portion contains ink of mutually different color. Moreover, each of the ink ejection devices 223 is arranged along the axial direction of the holding member 222 (the axial direction of the can body 10), and is formed in a longitudinal shape as shown in FIG. 21A. Moreover, each of the ink ejection devices 223 is in a state where one end portion in the longitudinal direction thereof is supported by the second fixing plate 281. Further, as shown in FIG. 21C, each of the ink ejection devices 223 is arranged radially regarding the center portion of the holding member 222 as a center.

Moreover, in the exemplary embodiment, as shown in FIG. 21C, the ink ejection devices 223 are arranged above the holding member 222. In the case where the ink ejection devices 223 are provided above the holding member 222 like this, ink ejection heads (ink ejection ports) 223A (refer to FIG. 21B) of the ink ejection devices 223 come to face downward, and accordingly, dust or the like hardly adheres to the ink ejection heads 223A.

Moreover, as in the exemplary embodiment, in the case where the ink ejection devices 223 are provided above the holding member 222 to cause the ink to be ejected downward, returning of the ink, which has been ejected from the ink ejection devices 223, to the ink ejection devices 223 is suppressed, and the ink ejection devices 223 hardly get soiled. Then, in this case, it becomes possible to reduce the number of times head cleaning is to be carried out, and thereby ease of maintenance is improved.

Moreover, though the description was omitted above, in the exemplary embodiment, as shown in FIG. 20, the holding member 222 and each of the ink ejection devices 223 are arranged along a tangential line that is tangent to the outer circumferential edge of the rotating member 210 formed in a disc shape. Moreover, in the exemplary embodiment, the plural ink ejection heads 223A (refer to FIG. 21B) provided in each of the ink ejection devices 223 are arranged in line along the longitudinal direction of the ink ejection device 223. To be described further, each of the ink ejection devices 223 is arranged so that the ink ejection heads 223A are arranged in line along the direction in which the above-described tangential line extends. To be described further, in the exemplary embodiment, the holding member 222 and the ink ejection devices 223 are arranged along the tangential line direction of a circle that is to be a moving trail of the image forming unit 220 when the image forming unit 220 is rotated to follow the rotating member 210.

Moreover, in the image forming unit 220, as shown in FIGS. 21A and 21B, an ink containing portion 286 that contains ink to be supplied to each of the ink ejection devices 223 is provided. It should be noted that, in the exemplary embodiment, as shown in FIG. 21B, the ink containing portion 286 is provided below the ink ejection device 223. Here, in a case where the ink containing portion 286 is provided above the ink ejection device 223, the pressure applied to the ink that is supplied to the ink ejection device 223 is prone to be high. Then, in this case, there is a possibility that leakage of the ink from the ink ejection heads 223A occurs. Accordingly, in the exemplary embodiment, the ink containing portion 286 is provided below the ink ejection device 223 as described above. It should be noted that, though illustration is omitted, it is also possible to have a configuration in which a second ink containing portion with a capacity larger than that of the ink containing portion 286 is further provided, and the ink is supplied from the second ink containing portion to the ink containing portion 286.

Moreover, though the description was omitted above, in the exemplary embodiment, as shown in FIG. 21B or the like, the ink ejection device 223 is arranged in the state of lying down (in the horizontal state). Here, in a case where the ink ejection device 223 is arranged in a standing state, there is a possibility that the pressure in supplying the ink to each of the plural ink ejection heads 223A provided in the ink ejection device 223 becomes different from one ink ejection head 223A to another. Additionally remarking, there is a possibility that the pressure in supplying the ink to the ink ejection head 223A positioned on a lower side is increased, and the pressure in supplying the ink to the ink ejection head 223A positioned on an upper side is decreased. Then, in this case, there occurs difficulty in supplying the ink to the ink ejection head 223A positioned on the upper side, in contrast to the ink ejection head 223A positioned on the lower side; and conversely, in the ink ejection head 223A positioned on the lower side, there is a possibility that the ink supplying pressure becomes high compared to the ink ejection head 223A positioned on the upper side, and thereby the ink leaks. Moreover, in such a case, the amount of ink ejection becomes different from one ink ejection head 223A to another. On the other hand, as in the exemplary embodiment, in the case where the ink ejection device 223 is arranged in the state of lying down, inconvenience like this hardly occurs.

Next, the can body conveying mechanism 100 will be described in detail.

Figure 23:
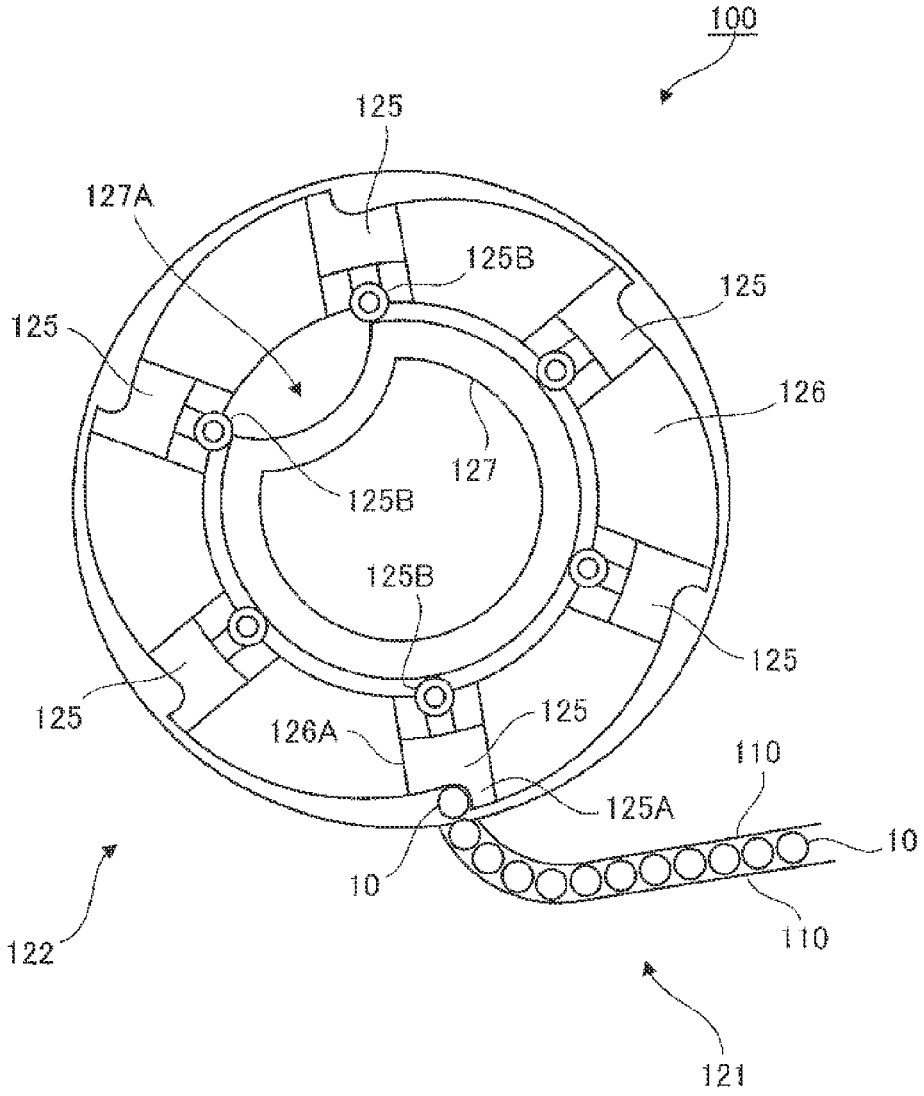
FIG. 23 is a diagram showing a can body conveying mechanism as viewed from above.
Figure 24A:
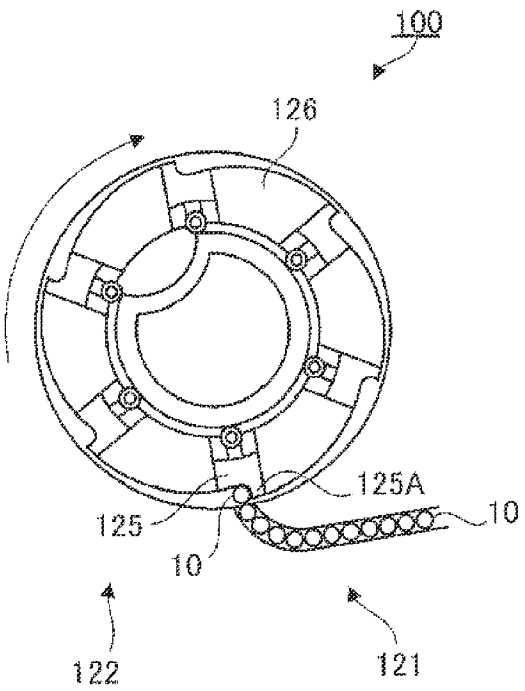
FIGS. 24A to 24C are diagrams for illustrating operations of the can body conveying mechanism.
Figure 24B:
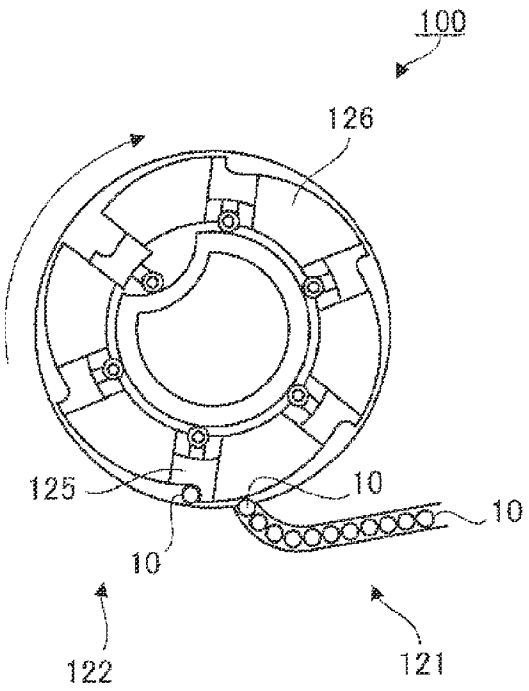
Figure 24C:
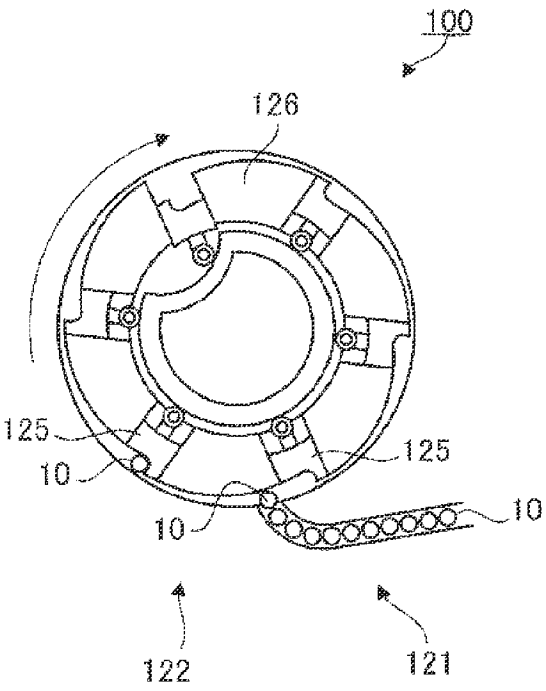

FIG. 23 is a diagram in a case where the can body conveying mechanism 100 is viewed from above, and FIGS. 24A to 24C are diagrams for illustrating operations of the can body conveying mechanism 100.

As shown in FIG. 23, the can body conveying mechanism 100 includes a first conveying portion 121 that sequentially conveys the plural can bodies 10 in a state of being arranged in line, and a second conveying portion 122 that conveys the can bodies 10, which have been conveyed by the first conveying portion 121, one by one.

Here, in the first conveying portion 121, the guide member 110 is provided on both sides of the moving route of the can body 10, and the can bodies 10 are guided by the guide member 101, to be thereby conveyed in the state where the can bodies 10 are arranged in line.

Moreover, in the second conveying portion 122, plural conveying member 125 are provided, each of which receives a single can body 10 from the first conveying portion 121 and conveys the can body 10. Moreover, the second conveying portion 122 is provided with a rotating member 126 that is formed in an annular shape and is rotated in the clockwise direction in the figure while holding the plural conveying members 125.

Here, each of the conveying members 125 has a projecting portion 125A on a side surface thereof positioned on an outer circumferential surface side of the rotating member 126 (on a side surface positioned on an outer side), the projecting portion 125A projecting from the side surface. Here, each of the conveying members 125 conveys the can body 10 to the downstream side in the rotating direction of the rotating member 126 by supporting the can body 10 by a side surface of the projecting portion 125A.

It should be noted that, on a support surface of the projecting portion 125A to support the can body 10 (of the projecting portion 125A, a contact surface with which the can body 10 contacts), a hollow that hollows inward of the projecting portion 125A is formed, and accordingly, dropping off of the can body 10 from the conveying member 125 does not occur because the can body 10 is fitted into the hollow. Moreover, on the support surface that supports the can body 10, an air vent is provided, through which the can body 10 is sucked when the can body 10 is conveyed by the conveying member 125.

Moreover, in the exemplary embodiment, the conveying member 125 is configured to be movable along the radial direction of the rotating member 126. To be described more specifically, in the rotating member 126, through holes 126A are formed from the outer circumferential surface side toward the inner circumferential surface side. Then, in the exemplary embodiment, there is provided a configuration in which the conveying member 125 is housed in the through hole 126A and the conveying member 125 moves while being guided by an inner wall of the through hole 126A. It should be noted that the through holes 126A are arranged at intervals of 60° in the circumferential direction of the rotating member 126, and there are provided 6 through holes 126A in total. Moreover, in the exemplary embodiment, in each of the 6 through holes 126A having been provided, the conveying member 125 is housed.

Moreover, in the exemplary embodiment, a guide member 127 to perform guiding of the conveying member 125 is provided inside the rotating member 126 that is formed in the annular shape. Here, in the guide member 127, the outer circumferential edge is formed in a circular shape and part of the outer circumferential edge is hollowed inward. Accordingly, in the guide member 127, a hollow portion 127A is formed on a part of the outer circumferential edge. It should be noted that the outer circumferential edge of the guide member 127 is formed to draw an arc, and the part where the hollow portion 127A is formed is also formed to draw an arc.

Moreover, in the exemplary embodiment, a roll-like rotating member 125B is attached to each of the conveying members 125. Moreover, in the exemplary embodiment, there is provided a configuration in which the conveying member 125 is pressed against the guide member 127 by a not-shown urging member, and thereby the rotating member 125B is pressed onto the outer circumferential edge of the guide member 127. Here, the rotating member 125B has a role to reduce a frictional force generated between the guide member 127 and the conveying member 125.

With reference to FIGS. 24A to 24C, operations of the can body conveying mechanism 100 will be described.

In the exemplary embodiment, first, as shown in FIG. 24A, of the can bodies 10 conveyed by the first conveying portion 121, a single can body 10 positioned at the most downstream side is supported by the projecting portion 125A of the conveying member 125. Thereafter, as shown in FIGS. 24B and 24C, the can body 10 is moved to the downstream side with the rotation of the rotating member 126 in the clockwise direction. Thereafter, the can body 10 reaches the can body moving mechanism 200 (refer to FIG. 19), and comes to be held by the image forming unit 220 provided in the can body moving mechanism 200.

It should be noted that, when conveyance of the first can body 10 by the conveying member 125 is started, the second can body 10 is supplied to the second conveying portion 122 as shown in FIGS. 24B and 24C. Then, the second can body 10 comes to be supported by another conveying member 125, which is positioned at the upstream side of the conveying member 125 that conveys the first can body 10. Thereafter, the third and subsequent can bodies 10 are sequentially supplied to the second conveying portion 122, and these can bodies 10 are supported by the conveying members 125 that are sequentially approaching, and conveyed to the downstream side.

Next, with reference to FIGS. 19 and 25, description will be given of the first conveying device 910 to the fourth conveying device 940 shown in FIG. 19.

The first conveying device 910 is, as shown in FIG. 25, provided below the can body moving mechanism 200. Moreover, the first conveying device 910 includes plural suction members 911. Here, the plural suction members 911 perform, as shown in FIG. 19, the circulating movement along a predetermined route (a route that forms an arc). Additionally remarking, movement in the clockwise direction in the figure is performed.

Here, in the exemplary embodiment, by evacuation through the air vent formed in the holding member 222 (refer to FIGS. 21A to 21C) provided in the image forming unit 220, the can body 10 is held by the holding member 222. Then, in the exemplary embodiment, when the can body 10 reaches a position above the first conveying device 910, a compressed air is supplied to the inside of the holding member 222 through the above-described air vent.

This breaks a vacuum and applies a pressure to a bottom portion of the can body 10 by the compressed air, to thereby move the can body 10 in the direction indicated by an arrow 7A in FIG. 25 (the downward direction). Thereafter, the suction member 911 that has been on standby below the can body 10 sucks the can body 10, and thereby the can body 10 is held by the suction member 911. Thereafter, the suction member 911 moves along the route shown in FIG. 19 to reach the second conveying device 920.

It should be noted that, in the exemplary embodiment, as shown in FIG. 19, when the suction member 911 moves below the can body moving mechanism 200, the suction member 911 moves along the moving route of the holding member 222 provided in the image forming unit 220. This ensures passing of the can body 10 from the holding member 222 to the suction member 911. Here, in a case where the suction member 911 does not move along the moving route of the holding member 222, there are only two contact points between the holding member 222 and the suction member 911, and therefore, it becomes difficult to pass the can body 10. In contrast, in the exemplary embodiment, the moving trail of the suction member 911 and the moving trail of the holding member 222 coincide with each other, and accordingly, the can body 10 is surely passed.

It should be noted that, for a similar reason, when the suction member 911 moves below the second conveying device 920, the suction member 911 moves along a moving route of a holding unit 922 provided in the second conveying device 920 (refer to FIGS. 19 and 25). Moreover, as shown in FIG. 19, a suction member 932 provided in the third conveying device 930 also moves along the moving route of the holding unit 922 provided in the second conveying device 920 when the suction member 932 passes above the second conveying device 920. Moreover, the suction member 932 provided in the third conveying device 930 moves along the moving route of the pin 942 provided in the fourth conveying device 940 when the suction member 932 passes above the fourth conveying device 940.

Moreover, when the conveying member 125 (refer to FIG. 19) provided in the can body conveying mechanism 100 moves below the can body moving mechanism 200, the conveying member 125 also moves along the moving route of the holding member 222 provided in the image forming unit 220. It should be noted that movement of the conveying member 125 along the moving route of the holding member 222 is actualized by the rotating member 125B entering into the hollow portion 127A formed in the guide member 127 (refer to FIG. 23).

Next, the second conveying device 920 will be described.

The second conveying device 920 is, as shown in FIG. 19, provided with a rotating plate 921 that rotates in the counterclockwise direction and the plural holding units 922 that are attached to the outer circumferential edge of the rotating plate 921 to receive the can bodies 10 having been conveyed by the first conveying device 910.

Here, each of the holding units 922 is arranged at a predetermined certain interval in the circumferential direction of the rotating plate 921. Moreover, as shown in FIG. 25, each of the holding units 922 is provided with the holding member 922A that is formed cylindrically and supports the can body 10 by being inserted into the inside of the can body 10, and a rotating mechanism 922B that supports one end side of the holding member 922A and rotates the holding member 922A around the one end side as a center of rotation. In addition, a servomotor (not shown) that rotates the holding member 922A in the circumferential direction is provided.

The rotating mechanism 922B can be configured with, similar to the rotating mechanism that rotates the connecting member 283 (refer to FIG. 21B) in the image forming unit 220, a motor (not shown), a worm (not shown) driven by the motor, and a worm wheel (not shown) that is provided on the holding member 922A side and engages the worm. Moreover, in the exemplary embodiment, the holding member 922A is provided rotatably in the circumferential direction, and a servomotor (not shown) that rotates the holding member 922A in the circumferential direction is provided.

Moreover, the second conveying device 920 is, as shown in FIG. 19, provided with a heating device 923 that is configured with an infrared heater or the like to heat the can body 10 held by the holding unit 922. Further, on the downstream side of the heating device 923 in the rotating direction of the rotating plate 921, there is provided a paint coating device 924 that coats the outer circumferential surface of the can body 10 with a paint and thereby forms a protecting layer. It should be noted that the paint coating device 924 includes a roll-like member that rotates, and performs coating of the can body 10 with the paint by bringing the roll-like member into contact with the outer circumferential surface of the can body 10.

Here, image formation onto the can body 10 can be carried out by use of an ink that cures by heat or an ink of an ultraviolet cure type. In this case, in addition to the heating device 923, a lamp for radiating the ultraviolet ray is provided. It should be noted that coating of the can body 10 with the paint (formation of the protecting layer) can also be carried out by ejecting the paint onto the can body 10 from the ink ejection device 223 positioned in the most downstream side in the rotating direction of the can body 10, of the plural ink ejection devices 223 provided in the image forming unit 220. Moreover, drying of the paint can be performed in each of the image forming unit 220 by providing an infrared heater in each of the image forming units 220.

Next, the third conveying device 930 will be described.

The third conveying device 930 is, as shown in FIG. 25, arranged above the second conveying device 920. Moreover, the third conveying device 930 is, similar to the first conveying device 910, provided with the plural suction members 932 that suck the bottom portions of the can bodies 10 to hold the can bodies 10. Moreover, the third conveying device 930 is provided with a support member 931 that is arranged above the suction members 932 and supports these suction members 932. Here, in the exemplary embodiment, the bottom portion of the can body 10 having been conveyed by the second conveying device 920 is first supported by the suction member 932. Thereafter, the suction member 932 moves to a position above the fourth conveying device 940. Then, the can body 10 drops downward by canceling the suction by the suction member 932, to thereby pass the can body 10 to the fourth conveying device 940.

Next, the fourth conveying device 940 will be described.

The fourth conveying device 940 is, as shown in FIG. 25, arranged below the third conveying device 930. Moreover, as shown in FIG. 19, the fourth conveying device 940 includes a chain 941 that carries out orbital movement in the counterclockwise direction in the figure and plural pins 942 attached to the chain 941. Here, passing of the can body 10 from the third conveying device 930 to the fourth conveying device 940 is performed by inserting the pin 942 into the inside of the can body 10 dropped off from the third conveying device 930. It should be noted that, in the exemplary embodiment, the can body 10 is conveyed to the not shown baking device (process) by the fourth conveying device 940, and baking of the ink or the paint on the outer circumferential surface of the can body 10 is performed in the baking device.

Next, with reference to FIG. 25, description will be given of a series of operations in the image formation carried out in the exemplary embodiment.

In the exemplary embodiment, first, the can body 10 is conveyed by the can body conveying mechanism 100 to a position below the can body moving mechanism 200. Here, at this time, the holding member 222, which is in a state where the one end portion 222A thereof faces downward, is on standby above the can body 10. Thereafter, the air inside the holding member 222 is discharged through the air vent of the holding member 222, and in association with this, the can body 10 is sucked by the holding member 222. Then, by the suction, the holding member 222 comes to a state of being inserted into the inside of the can body 10.

Figure 26:
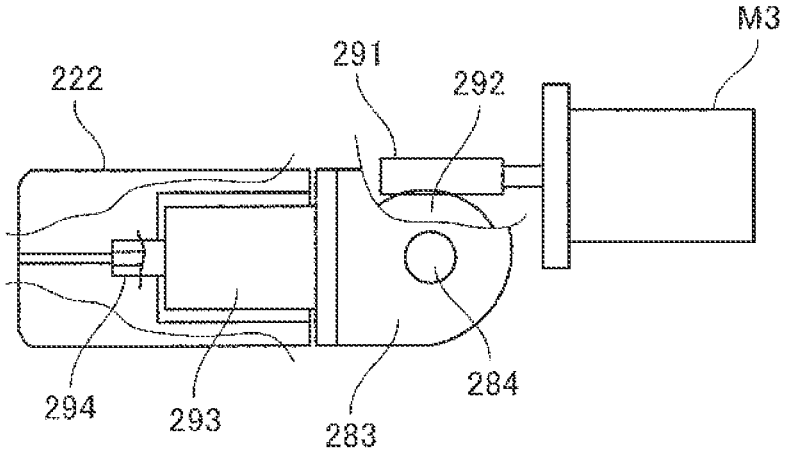
FIG. 26 is a diagram showing a structure of periphery of the holding member.

Thereafter, the rotating mechanism provided in the image forming unit 220 of the can body moving mechanism 200 is driven, to thereby cause the holding member 222 to come to the lying state, and as indicated by the sign 7B in the figure, the can body 10 held by the holding member 222 is brought into the horizontal state. Subsequently, driving of the servomotor is started, and the can body 10 is rotated in the circumferential direction. It should be noted that, though the description was omitted above, as shown in FIG. 26 (a diagram showing a structure of periphery of the holding member 222), a worm 291 is attached to a shaft of the servomotor M3 provided in the second fixing plate 281 (refer to FIG. 21A), a worm wheel 292 is rotated by the rotation of the worm 291, and thereby the connecting member 283 supported by the worm wheel 292 rotates around the shaft 284 as the center of rotation. The connecting member 283 is provided with a servomotor 293 for rotating the holding member 222 in the circumferential direction. Moreover, a shaft 294 of the servomotor 293 is a hollow shaft, to one end of which the holding member 222 is coupled, and an air vent is formed in the holding member 222, and accordingly, the holding member 222 is configured to hold the can body 10 by sucking through the air vent. Moreover, though not illustrated in the figure, a rotatable piping with a built-in bearing is connected to the other end of the shaft 294 of the servomotor 293, and connected to a vacuum pump or a blower via an electro-vacuum valve. Accordingly, regardless of whether the holding member 222 rotates or does not rotate, a negative suction pressure from the vacuum pump or the like reaches the air vent of the holding member 222, as necessary, via the electro-vacuum valve and through a hole provided in the shaft 294 of the servomotor 293, to thereby make it possible to generate the negative suction pressure to cause the holding member 222 to hold the can body 10. Moreover, when the electro-vacuum valve is switched, by supplying an ambient pressure or a compressed air, it becomes possible to break the negative suction pressure at once.

With reference to FIG. 25 again, the description will be further continued.

After the can body 10 comes to the horizontal state, in the exemplary embodiment, ink is ejected from each of the four ink ejection devices 223. Then, when the can body 10 rotates 360°, ejection of the ink is stopped. This brings a state where the image is formed on the outer circumferential surface of the can body 10.

Thereafter, the rotating mechanism provided in the image forming unit 220 is driven again, to thereby bring the can body 10 held by the holding member 222 into the state of facing down, as indicated by the sign 7C in the figure. Additionally remarking, the can body 10 is arranged so that the bottom portion of the can body 10 faces downward. Thereafter, air is supplied to the inside of the holding member 222 through the air vent, and suction by the suction member 911 provided in the first conveying device 910 is started. This causes the can body 10 to be moved downward in the figure, as indicated by the arrow 7A, to be held by the suction member 911.

Thereafter, the can body 10 reaches at a position below the second conveying device 920 with the movement of the suction member 911. Here, at this time, as indicated by the sign 7D in FIG. 25, the holding member 922A, which is in a state where a shaft center thereof is along the vertical direction, is on standby above the can body 10. Thereafter, air inside the holding member 922A is discharged through the air vent, and suction of the can body 10 by the suction member 911 is canceled. This causes the can body 10 to move toward the holding member 922A, and causes the holding member 922A to be inserted into the inside of the can body 10.

Thereafter, the holding member 922A moves toward the third conveying device 930 and is driven by a not-shown servomotor to be rotated in the circumferential direction.

Moreover, the rotating mechanism 922B that rotates the holding member 922A is driven, and thereby the holding member 922A is brought into the horizontally lying state. This makes the can body 10 come to the horizontally lying state. Thereafter, heating by the heating device (refer to FIG. 19) is carried out, to thereby cure the ink adhered to the outer circumferential surface of the can body 10. Subsequently, the outer circumferential surface of the can body 10 is coated with the paint by the paint coating device 924 (refer to FIG. 19) to form the protecting layer.

Thereafter, the rotating mechanism 922B for rotating the holding member 922A is driven again, and as indicated by the sign 7E, the holding member 922A is arranged so that the bottom portion of the can body 10 faces upward. Subsequently, air is supplied to the inside of the holding member 922A through the air vent formed in the holding member 922A, and thereby the can body 10 moves upwardly in the figure. On the other hand, the suction member 932 is on standby above the can body 10.

Then, the can body 10 is held by the suction member 932 and is moved toward the fourth conveying device 940. Then, when the can body 10 reaches a position above the fourth conveying device 940, suction of the can body 10 by the suction member 932 is terminated and the can body 10 drops downward. Thereafter, the can body 10 is supported by the pin 942 and conveyed to the baking process. It should be noted that it is also possible to provide the pin 942 movably in the vertical direction, and arrange the pin 942 closer to the can body 10 when drop of the can body 10 is carried out. Moreover, in a similar way, it is possible to provide the suction member 911 provided in the first conveying device 910 and the suction member 932 provided in the third conveying device 930 movably in the vertical direction.

Here, in the exemplary embodiment, as described by use of FIG. 20, the holding member 222 and the ink ejection device 223 are arranged along the tangential line that is tangent to the outer circumferential edge of the rotating member 210 formed in a disc shape. Additionally remarking, in the exemplary embodiment, when the image forming unit 220 moves along an annular moving route with the rotation of the rotating member 210, the ink ejection device 223 moves with one end portion of the ink ejection device 223 in the longitudinal direction being as a leading edge and the other end portion of the ink ejection device 223 in the longitudinal direction being as a trailing edge. Further, the ink ejection device 223 moves along the above-described annular moving route.

To be described further, as shown in FIG. 20, each of the image forming units 220 is arranged so that a straight line L extending from the center of rotation of the rotating member 210 toward the image forming unit 220 and the longitudinal direction of the ink ejection device 223 (the direction in which the ink ejection device 223 extends) intersect (cross each other at right angles). Then, in the case of this configuration of the exemplary embodiment, variation in the amount of ink ejected onto the can body 10 in the longitudinal direction of the can body 10 is suppressed.

Here, for example, in a case where the holding member 222 and the ink ejection device 223 are arranged along the radial direction of the rotating member 210, centrifugal force acting on the ink ejection device 223 becomes different according to the portion in the ink ejection device 223. Specifically, in a portion of the ink ejection device 223 away from the center of the rotating member 210 (hereinafter, referred to as "outer side portion"), acting centrifugal force becomes large, whereas, in a portion of the ink ejection device 223 closer to the center of the rotating member 210 (hereinafter, referred to as "center side portion"), the acting centrifugal force becomes small.

By the way, in this case, a manner of ink ejection is apt to differ between the outer side portion and the center side portion, and accordingly, the amount of ink to be ejected onto the can body 10 is apt to vary in the longitudinal direction of the can body 10. On the other hand, in the configuration of the exemplary embodiment, variation in centrifugal force according to the portions in the ink ejection device 223 is hardly caused, and variation in the amount of ink to be ejected onto the can body 10 is hardly caused.

REFERENCE SIGNS LIST

1 . . . Printer
10 . . . Can body
200 . . . Can body moving mechanism
210 . . . Rotating member
220 . . . Image forming unit
222 . . . Holding member
223 . . . Ink ejection device
224 . . . Heating unit
225 . . . Coating unit
226 . . . Rotating plate
229 . . . Central shaft
400 . . . Heating device
500 . . . Coating device
851 . . . Suction member
859 . . . Central shaft
HD . . . Ink ejection head

The invention claimed is:

1. An image forming device comprising:

an image forming unit that includes a holding member holding a can body and forms an image on an outer surface of the can body held by the holding member; and a rotating member that causes the image forming unit holding the can body to perform orbital movement around a predetermined point to move the image forming unit along a predetermined annular moving route, wherein the image forming unit is provided with a plurality of ink ejection device that is provided to extend in one direction and ejects ink onto the outer surface of the can body to form the image on the outer surface, and the rotating member moves the image forming unit so that the ink ejection device is moved along the predetermined annular moving route with one end portion of the ink ejection device in the one direction being as a leading edge and the other end portion of the ink ejection device in the one direction being as a trailing edge, wherein the plurality of ink ejection devices are provided circumferentially around the holding member, each of the plurality of ink ejection devices is arranged in a horizontal direction such that a plurality of ink ejection heads of each ink ejection device are aligned in the horizontal direction, and each of the plurality of ink ejection devices is arranged circumferentially around a tangential line where the tangential line acts as an axis for which the plurality of ink ejection devices are arranged around and is tangent to the predetermined annular moving route, and each of the ink ejection devices is arranged above the can body to eject the ink onto the outer surface of the can body that is positioned below.

2. The image forming device according to claim 1, wherein a plurality of the image forming units are provided, and the rotating member moves the plurality of image forming units along the annular moving route.

3. The image forming device according to claim 1, wherein the image forming unit holds the can body by inserting an insertion member having an end portion into an inside of the can body from the end portion side, and the insertion member is arranged in a lying state when image formation onto the can body by the image forming unit is performed, and in holding the can body, the insertion member is arranged so that the end portion faces in one of an upward direction and a downward direction.

4. An image forming device comprising:

a rotating member that rotates around a predetermined center of rotation; and an image forming unit that is attached to the rotating member, carries out orbital movement with rotation of the rotating member and includes a holding member holding a can body to form an image onto an outer surface of the can body held by the holding member, wherein the image forming unit is provided with a plurality of ink ejection device that is provided to extend in one direction and ejects ink onto the outer surface of the can body to form the image on the outer surface, and the image forming unit is arranged so that a direction in which a straight line extending from the center of rotation of the rotating member toward the image forming unit attached to the rotating member and the one direction in which the ink ejection device extends cross each other, wherein the plurality of ink ejection devices are provided circumferentially around the holding member and each of the plurality of ink ejection devices is arranged in a horizontal direction such that a plurality of ink ejection heads of each ink ejection device are aligned in the horizontal direction, and each of the plurality of ink ejection devices is arranged circumferentially around a tangential line where the tangential line acts as an axis for which the plurality of ink ejection devices are arranged around and is tangent to a line of rotation of the rotating member, and each of the ink ejection devices is arranged above the can body to eject the ink onto the outer surface of the can body that is positioned below.

5. The image forming device according to claim 4, wherein the image forming unit is arranged so that the direction in which the straight line extending from the center of rotation toward the image forming unit and the one direction cross each other at a right angle.

6. An image forming device comprising:

an image forming unit that includes a holding member holding a can body and forms an image on an outer surface of the can body held by the holding member; and a rotating member that causes the image forming unit holding the can body to perform orbital movement around a predetermined point to move the image forming unit along a predetermined annular moving route, wherein the image forming unit is provided with a plurality of ink ejection device that is provided to extend in one direction and ejects ink onto the outer surface of the can body to form the image on the outer surface, and the rotating member moves the image forming unit so that the ink ejection device is moved along the predetermined annular moving route, wherein the plurality of ink ejection devices are provided circumferentially around the holding member, and each of the plurality of ink ejection devices is arranged circumferentially around a tangential line where the tangential lines acts as an axis for which the plurality of ink ejection devices are arranged around and is tangent to the predetermined annular moving route.

* * * * *